US010434394B2

(12) United States Patent
Bass et al.

(10) Patent No.: US 10,434,394 B2
(45) Date of Patent: Oct. 8, 2019

(54) MOVABLE SUPPORT FOR EXERCISE EQUIPMENT

(71) Applicant: Saris Cycling Group, Inc., Madison, WI (US)

(72) Inventors: Benjamin Raymond Bass, Madison, WI (US); Dustin Lee Kohl, Verona, WI (US)

(73) Assignee: Saris Cycling Group, Inc., Madison, WI (US)

( * ) Notice: Subject to any disclaimer, the term of this patent is extended or adjusted under 35 U.S.C. 154(b) by 0 days.

(21) Appl. No.: 16/227,624

(22) Filed: Dec. 20, 2018

(65) Prior Publication Data

US 2019/0118058 A1 Apr. 25, 2019

Related U.S. Application Data

(63) Continuation of application No. 15/999,259, filed on Aug. 16, 2018.

(Continued)

(51) Int. Cl.
*A63B 69/16* (2006.01)
*A63B 22/00* (2006.01)

(Continued)

(52) U.S. Cl.
CPC ..... *A63B 69/16* (2013.01); *A63B 21/005* (2013.01); *A63B 21/0058* (2013.01);

(Continued)

(58) Field of Classification Search
CPC ..... A63B 23/0476; A63B 26/003; A63B 22/06–2022/0658; A63B 69/16–2069/168
See application file for complete search history.

(56) References Cited

U.S. PATENT DOCUMENTS 3,659,844 A 5/1972 Cummins
4,817,939 A 4/1989 Augspurger et al.

(Continued)

FOREIGN PATENT DOCUMENTS

KR 20120071425 7/2012
WO 2012146230 11/2012

OTHER PUBLICATIONS

PCT/US2018/000271, International Search Report and Written Opinion, dated Dec. 4, 2018, 15 pages.

*Primary Examiner* — Jennifer M Deichl
(74) *Attorney, Agent, or Firm* — Boyle Fredrickson, S.C.

(57) ABSTRACT

An exercise arrangement includes a movable support that is movable in a fore-aft direction and simultaneously movable laterally, e.g. about a tilt axis. The support may be a platform movably mounted to a base. A roller and track arrangement may be provided between the platform and the base, to provide movement of the platform in the axial direction relative to the base as well as an axially neutral position of the platform relative to the base. The roller and track arrangement may be in the form of one or more curved roller and track engagement surfaces that extend in the axial direction and that provide a gravity bias of the platform toward the neutral position. The roller and track arrangement may provide tilting movement of the movable platform about the tilt axis. A tilt biasing arrangement biases the platform toward a neutral tilt position relative to the base.

35 Claims, 40 Drawing Sheets

Related U.S. Application Data

(60) Provisional application No. 62/546,748, filed on Aug. 17, 2017, provisional application No. 62/637,003, filed on Mar. 1, 2018.

(51) Int. Cl.

| | |
|---|---|
| ***A63B 22/06*** | (2006.01) |
| ***A63B 22/16*** | (2006.01) |
| ***A63B 26/00*** | (2006.01) |
| ***A63B 21/005*** | (2006.01) |
| ***A63B 21/22*** | (2006.01) |
| ***A63B 24/00*** | (2006.01) |

(52) U.S. Cl.

CPC ..... *A63B 21/225* (2013.01); *A63B 22/0023* (2013.01); *A63B 22/0605* (2013.01); *A63B 22/16* (2013.01); *A63B 26/003* (2013.01); *A63B 2022/0641* (2013.01); *A63B 2024/0093* (2013.01); *A63B 2069/163* (2013.01); *A63B 2069/164* (2013.01); *A63B 2069/165* (2013.01); *A63B 2210/50* (2013.01); *A63B 2225/09* (2013.01); *A63B 2225/50* (2013.01)

(56) References Cited

U.S. PATENT DOCUMENTS

| | | | | |
|---|---|---|---|---|
| 4,958,832 | A | 9/1990 | Kim | |
| 5,035,418 | A | 7/1991 | Harabayashi | |
| 5,050,865 | A | 9/1991 | Augspurger et al. | |
| 5,240,417 | A | 8/1993 | Smithson et al. | |
| 6,126,577 | A | 10/2000 | Chang | |
| 6,322,480 | B1 * | 11/2001 | Lim | A63B 26/003 472/103 |
| 7,081,070 | B1 | 7/2006 | Washington et al. | |
| 7,326,151 | B2 | 2/2008 | Peterson et al. | |
| 7,438,672 | B1 | 10/2008 | Rylander et al. | |
| 7,604,575 | B2 * | 10/2009 | Papadopoulos | A63B 69/16 482/54 |
| 7,766,798 | B2 | 8/2010 | Hamilton | |
| 8,439,808 | B2 | 5/2013 | Hamilton | |
| 9,707,443 | B2 | 7/2017 | Warren | |
| 2002/0055422 | A1 | 5/2002 | Airmet et al. | |
| 2004/0053751 | A1 | 3/2004 | Pizolato | |
| 2006/0229163 | A1 | 10/2006 | Waters | |
| 2007/0142184 | A1 | 6/2007 | Schroeder | |
| 2008/0020908 | A1 | 1/2008 | Ibarguren | |
| 2009/0075785 | A1 | 3/2009 | Schroeder | |
| 2009/0186746 | A1 | 7/2009 | Pandolfo | |
| 2010/0062909 | A1 | 3/2010 | Hamilton | |
| 2010/0125029 | A1 | 5/2010 | Nielson et al. | |
| 2010/0288901 | A1 | 11/2010 | Wallach | |
| 2011/0287901 | A1 | 11/2011 | Wan | |
| 2012/0071301 | A1 | 3/2012 | Kaylor et al. | |
| 2013/0130798 | A1 * | 5/2013 | Nir | A63F 13/245 463/36 |
| 2016/0158620 | A1 | 6/2016 | Bauer et al. | |
| 2016/0236036 | A1 | 8/2016 | Kalogiros et al. | |
| 2016/0287931 | A1 | 10/2016 | Tung | |

* cited by examiner

MOVABLE SUPPORT FOR EXERCISE EQUIPMENT

CROSS-REFERENCE TO RELATED APPLICATION

This application is a continuation of U.S. application Ser. No. 15/999,259, filed Aug. 16, 2018, which claims the benefit of U.S. provisional patent application Ser. No. 62/546,748 filed Aug. 17, 2017, and U.S. provisional patent application Ser. No. 62/637,003 filed Mar. 1, 2018, the entire disclosures of which are hereby incorporated by reference.

BACKGROUND AND SUMMARY

Various types of indoor exercise equipment are designed to mimic or simulate exercise activities that are typically done in an outdoor environment. For example, a stationary treadmill allows a user to walk or run indoors as opposed to outdoors. Similarly, a stationary cycle allows the user to experience cycling-type exercise indoors as opposed to outdoors. As an example of the latter, a conventional bicycle can be mounted to an indoor bicycle trainer, which allows the user to adapt a bicycle, which is typically used outdoors, for use in an indoor environment.

While actual outdoor conditions cannot be exactly replicated when exercising on exercise equipment in an indoor environment, exercise equipment can be configured or controlled to simulate outdoor conditions. For example, in the case of the treadmill, the incline of the treadmill belt can be adjusted to simulate running or walking uphill or downhill. Stationary cycles and bicycle trainers, which most commonly are positioned upright and horizontal, have been designed to include features that allow the stationary cycle or bicycle and trainer combination to tilt side-to-side and to adjust an angle of inclination either upwardly or downwardly.

It is an object of the present invention to enable a user to more realistically experience movement that occurs in an outdoor environment when using an item of exercise equipment in an indoor environment. It is another object of the invention to provide movement of an item of exercise equipment in different directions or planes to enhance the user's experience when using the item of exercise equipment. It is a still further object of the invention to provide a support system for an item of exercise equipment that allows movement of the item of exercise equipment in different directions to enhance the user's experience, and that can be either incorporated in the item of exercise equipment during original manufacture or that can be used with existing items of exercise equipment.

In accordance with a first aspect of the invention, an exercise arrangement for use on a support surface includes a user support and input arrangement that is configured to support a user and that includes a user force input arrangement, and a movable support arrangement interposed between the support surface and the user support and input arrangement. The movable support arrangement is movable in a first fore-aft direction that includes a component that is generally parallel to the support surface, and simultaneously movable in a second direction that is non-parallel to the first direction in response to forces applied by the user to the user force input arrangement. Representatively, movement of the movable support arrangement in the first direction may be movement of the movable support arrangement in an axial or fore-aft direction, and movement of the movable support arrangement in the second direction may be tilting movement of the movable support arrangement about a tilt axis that extends in the axial direction.

In one embodiment, the movable support arrangement may be in the form of a platform that is movably mounted to a base, and the user support and input arrangement may be supported on the platform. The user support and input arrangement may be in the form of a bicycle and a bicycle trainer with which the bicycle is engaged. Alternatively, the user support and input arrangement may be in the form of an item of exercise equipment supported on the platform.

The movable support arrangement may be in the form of a roller and track arrangement interposed between the platform and the base, with the roller and track arrangement providing movement of the platform in the axial direction relative to the base in response to forces applied by the user to the user force input arrangement. The roller and track arrangement may be configured to define an axially neutral position of the platform relative to the base, and also configured to bias the platform toward the axially neutral position. Representatively, the roller and track arrangement may be in the form of one or more curved roller and track engagement surfaces that extend in the axial direction and that provide a gravity bias of the platform toward the neutral position.

The roller and track arrangement may be further configured to provide tilting movement of the movable platform about the tilt axis relative to the base. The movable support arrangement may further include a tilt biasing arrangement for biasing the platform toward a neutral tilt position relative to the base. Representatively, the tilt biasing arrangement may be in the form of a pair of springs between the base and the platform, with the pair of springs being located one on either side of the tilt axis.

In one embodiment, the platform may include a front platform section and a rear platform section that are secured together via a pivot connection, which enables the front and rear platform sections to be positioned in an operative use position and folded together about a transverse pivot axis to a folded storage position.

In accordance with another aspect of the invention, a cycle-type exercise system includes a cycle device, which may include pedals for enabling a user to apply input forces, such as pedaling forces, and a movable support arrangement that supports the cycle device above a supporting surface, with the movable support arrangement providing movement of the cycle device in a fore-aft direction along a longitudinal axis and simultaneous tilting movement of the cycle device about a tilt axis that is generally parallel to the longitudinal axis, in response to input forces applied by the user to the pedals of the cycle device. In one form, the cycle device is in the form of a bicycle engaged with a bicycle trainer. In this embodiment, the movable support arrangement is in the form of a platform on which the bicycle and trainer are supported, and a base interposed between the platform and the supporting surface. The platform is mounted to the base for fore-aft movement along the longitudinal axis and for tilting movement about the tilt axis. In another form, the cycle device is in the form of a stationary exercise cycle, and the movable support arrangement is incorporated into a frame of the stationary exercise cycle. In another form, the cycle device is in the form of a bicycle and the movable support is incorporated into the structure of a bicycle trainer with which the bicycle is engaged In an embodiment in which the cycle device is in the form of a bicycle engaged with a bicycle trainer, the movable support arrangement may include a front support and a rear support, with the front support being configured to support a front wheel of the bicycle and the rear support being configured to support the bicycle trainer. Each of the front and rear supports includes a roller arrangement that provides movement of the bicycle and the bicycle trainer in the fore-aft direction along the longitudinal axis. The bicycle trainer is mounted to the rear support via an axially extending central support arrangement that provides tilting movement of the bicycle trainer about the tilt axis, and the front wheel of the bicycle is mounted to the front support via a central front wheel support that accommodates movement of the bicycle and the bicycle trainer about the tilt axis. In an embodiment in which the cycle device is in the form of a bicycle engaged with a bicycle trainer, the movable support arrangement includes a front support and a rear support, with the front support being configured to support a front wheel of the bicycle and the rear support being configured to support the bicycle trainer. Each of the front and rear supports may include an axial roller arrangement that provides movement of the bicycle and the bicycle trainer in the fore-aft direction along the longitudinal axis, and at least the rear support includes a transverse roller arrangement that provides movement of the bicycle trainer about the tilt axis.

In another embodiment, the movable support arrangement may be in the form of a first support, a second support and a third support, with the bicycle and the bicycle trainer being supported on the first support, the first support being supported on the second support via a first roller arrangement that provides movement of the first support in the fore-aft direction, and the second support being supported on the third support via a second roller arrangement that provides movement of the first second support and the first support about the tilt axis.

In yet another embodiment, the movable support arrangement may be in the form of a first support, a second support and a third support, with the bicycle and the bicycle trainer being supported on the first support, the first support being supported on the second support via a first roller arrangement that provides movement of the first support about the tilt axis, and the second support being supported on the third support via a second roller arrangement that provides movement of the second support and the first support in the fore-aft direction.

In a further embodiment, the movable support arrangement may be in the form of a first support on which the bicycle and the bicycle trainer are supported, a base configured to be positioned on a support surface, and a suspension-type engagement arrangement between the base and the first support, with the suspension-type engagement arrangement providing movement of the first support in both the fore-aft direction and about the tilt axis.

In a still further embodiment, the movable support arrangement may be in the form of a first support, a second support and a base, with the bicycle and the bicycle trainer being positioned on the first support, a suspension-type engagement arrangement being interposed between the first support and the second support for providing movement of the first support about the tilt axis, and a roller arrangement being provided between the second support and the base for providing movement of the second support relative to the base in the fore-aft direction.

In a still further embodiment, the movable support arrangement may be in the form of a first support, a second support and a base, with the bicycle and the bicycle trainer being positioned on the first support, a first suspension-type engagement arrangement being interposed between the first support and the second support for providing movement of the first support about the tilt axis, and a second suspension-type engagement arrangement being interposed between the second support and the base for providing movement of the second support in the fore-aft direction.

In a still further embodiment in which the cycle device is in the form of a bicycle engaged with a resistance device, the movable support arrangement may include a base positioned on a support surface, a support on which the bicycle and the bicycle trainer are positioned, a pair of front support arms extending from the base, a pair of rear support arms extending from the base, a suspension-type engagement arrangement interposed between the support and the front and rear support arms for providing movement of the support about the tilt axis, and a pivot connection associated with the front and rear support arms for providing movement of the support in the fore-aft direction.

In a still further embodiment in which the cycle device includes a frame, the movable support arrangement may include a base adapted to be supported on a support surface and a roller and track arrangement interposed between the frame and the base. The roller and track arrangement provides movement of the frame in the fore-aft direction relative to the base in response to forces applied by the user to the user force input arrangement, and further provides tilting movement of the frame about the tilt axis relative to the base. The movable support arrangement includes a fore-aft biasing arrangement for biasing the frame toward a neutral fore-aft position and a tilt biasing arrangement for biasing the frame toward a neutral tilt position. The roller and track arrangement includes one or more curved roller and track engagement surfaces between the frame and the base that extend in the fore-aft direction and that provide a gravity bias of the frame toward the neutral fore-aft position. The frame may include a pair of stabilizers or outriggers, and the tilt biasing arrangement acts on the pair of stabilizers or outriggers for biasing the frame toward the neutral tilt position.

In a still further embodiment in which the cycle device is in the form of a bicycle engaged with a resistance device, the movable support arrangement includes a base positioned on a support surface, a support with which the bicycle and the resistance device are engaged, and a roller and track arrangement interposed between the support and the base. The roller and track arrangement provides movement of the support in the fore-aft direction relative to the base in response to forces applied by the user to the user force input arrangement, and further provides tilting movement of the support about the tilt axis relative to the base. The movable support arrangement includes a fore-aft biasing arrangement for biasing the support toward a neutral fore-aft position and a tilt biasing arrangement for biasing the support toward a neutral tilt position. The roller and track arrangement may include one or more curved roller and track engagement surfaces between the support and the base that extend in the fore-aft direction and that provide a gravity bias of the support toward the neutral fore-aft position. The support may include a pair of stabilizers or outriggers, and the tilt biasing arrangement acts on the pair of stabilizers or outriggers for biasing the support toward the neutral tilt position.

In accordance with yet another aspect of the invention, a support for an exercise arrangement that includes a cycle device with pedals for enabling a user to apply input pedaling forces includes a base adapted to be positioned on a support surface and a movable support engaged with the base and that is configured to support the cycle device above the base. The movable support is movably mounted to the base for movement in a fore-aft direction along a longitudinal axis in response to input pedaling forces applied by the user to the pedals of the cycle device. The movable support is further movably mounted to the base for simultaneous tilting movement of the cycle device about a tilt axis that is coincident with the longitudinal axis. The cycle device may be in the form of a bicycle and trainer combination or a cycle-type exercise device. In one form, the movable support may be in the form of a platform mounted to the base for movement in the fore-aft direction and for movement about the tilt axis. The platform may include a front platform section and a rear platform section that are secured together via a pivot connection that enables the front and rear platform sections to be positioned in an operative use position and folded together about a transverse pivot axis to a folded storage position.

In accordance with a still further aspect of the invention, a cycle-type exercise device includes a frame configured to support a user, a pedal arrangement movably mounted to the frame for enabling a user to apply input pedaling forces, and a support structure to which the frame is secured and that supports the frame above a support surface. The support structure provides movement of the frame in a fore-aft direction along a longitudinal axis in response to input pedaling forces applied by the user to the pedal arrangement. The support structure may further provide tilting movement of the frame about a tilt axis that is coincident with the longitudinal axis in response to input pedaling forces applied by the user to the pedal arrangement. Representatively, the support structure may include a base positioned on the support surface, and the frame includes a movable mounting arrangement by which the frame is mounted to the base, with the movable mounting arrangement providing movement of the frame in both the fore-aft direction along the longitudinal axis and tilting movement of the frame about the tilt axis. The movable mounting arrangement may include a roller and track arrangement interposed between the frame and the base, and the roller and track arrangement may provide movement of the frame in the fore-aft direction relative to the base and tilting movement of the frame about the tilt axis relative to the base in response to forces applied by the user to the pedal arrangement. The roller and track arrangement is configured to define an axially neutral position of the frame relative to the base in the fore-aft direction, and is further configured to bias the frame toward the axially neutral position. The roller and track arrangement may further include one or more curved roller and track engagement surfaces that extend in the fore-aft direction and that provide a gravity bias of the base toward the neutral position.

Other aspects, features and advantages of the invention will become apparent to those skilled in the art from the following detailed description and accompanying drawings. It should be understood, however, that the detailed description and specific examples, while indicating certain embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements can be several views, and in which.

Figure 1:
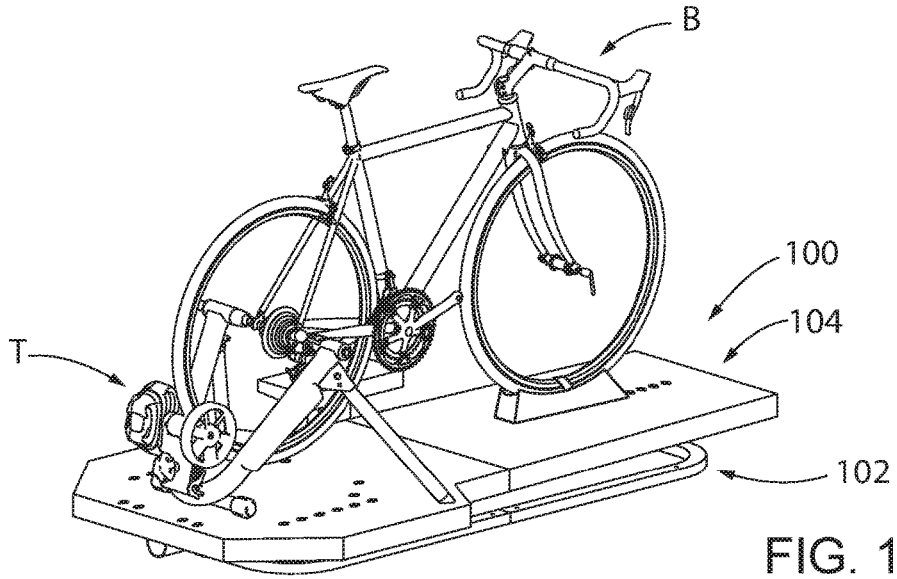
FIG. 1 is an isometric view of an embodiment of a movable support for an item of exercise equipment in accordance with the present invention, in which the item of exercise equipment is in the form of a bicycle mounted to a bicycle trainer.
Figure 2:
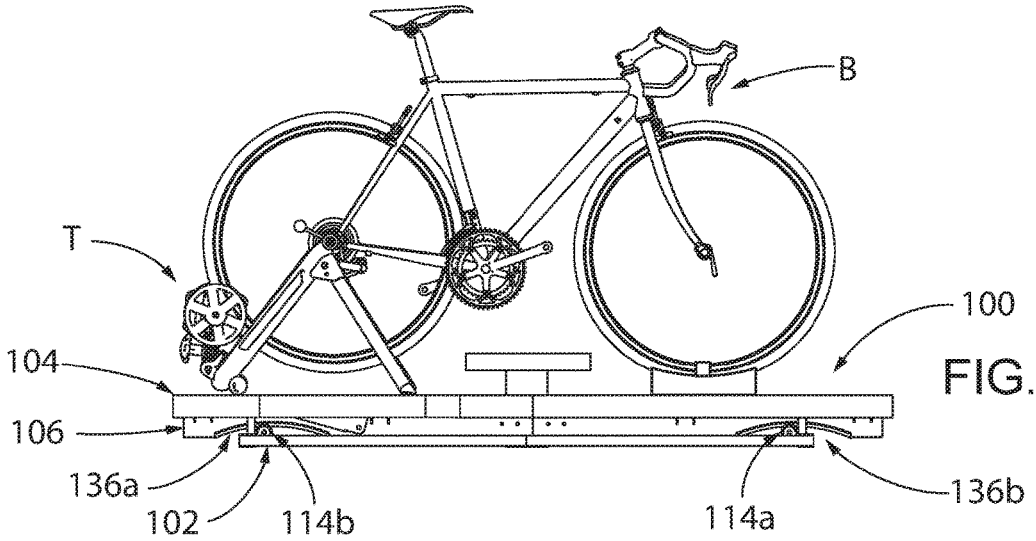
FIG. 2 is a side elevation view of the movable exercise equipment support and bicycle and trainer combination of FIG. 1.
Figure 3:
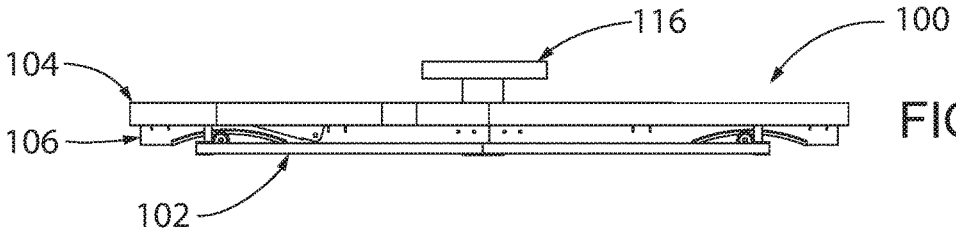
FIG. 3 is a view similar to FIG. 2, showing the movable exercise equipment support without the bicycle and trainer combination.

In describing the embodiments of the invention which are illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the words "connected," "attached," or terms similar thereto are often used. They are not limited to direct connection or attachment, but include connection or attachment to other elements where such connection or attachment is recognized as being equivalent by those skilled in the art.

DETAILED DESCRIPTION

The various features and advantageous details of the subject matter disclosed herein are explained more fully with reference to the non-limiting embodiments described in detail in the following description.

Referring to the following description in which like reference numerals represent like parts throughout the disclosure, a first embodiment of a movable exercise equipment support in accordance with the present invention is shown generally at 100 in FIGS. 1-18. In this embodiment, the movable exercise equipment support 100 is separate from, but adapted to support, an item of exercise equipment. In the illustrated embodiment, the item of exercise equipment is in the form of a bicycle B engaged with a bicycle trainer T. The bicycle trainer T is illustrated as a relatively conventional trainer that engages the rear wheel of the bicycle B and provides resistance when the user applies input forces to the pedals of bicycle B, in a manner as is known. Trainers of this type are commonly available, such as under the brand CycleOps manufactured by Saris Cycling Group, Inc. of Madison Wis. It is understood, however, that any other type of bicycle trainer, such as a director drive trainer, may be employed. It is further understood that the item of exercise equipment supported by the movable exercise equipment support 100 need not be limited to equipment such as a bicycle and trainer combination, and that any type of stationary exercise equipment to which repetitive or cyclic forces are applied by a user during operation may be employed.

Figure 4:
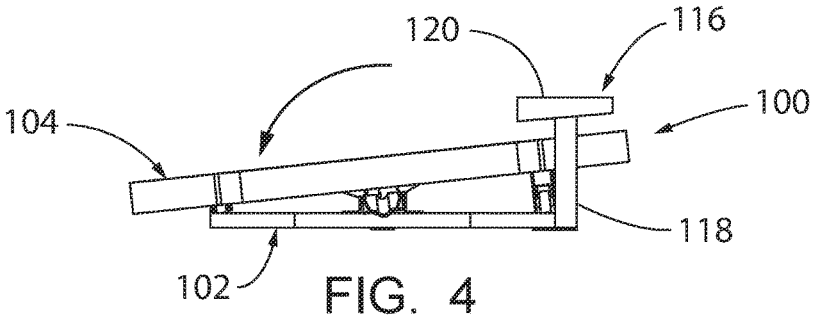
FIG. 4 is an end elevation view of the movable exercise equipment support of FIGS. 1-3, showing tilting movement of the support in a first direction.
Figure 5:
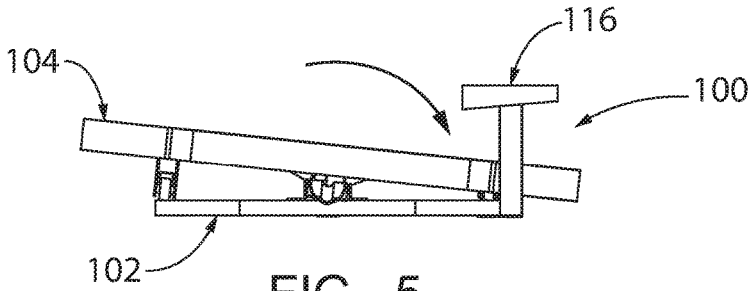
FIG. 5 is an end elevation view of the movable exercise equipment support of FIGS. 1-4, showing tilting movement of the support in a second direction opposite the first direction.

The movable exercise equipment support 100 generally includes a base 102 that is adapted to be positioned on a supporting surface such as a floor, a platform 104, and a frame 106. The bicycle B and trainer T are positioned on an upwardly facing surface defined by the platform 104. The platform 104 is secured to the frame 106, and the frame 106 is movably mounted to the base 102, in a manner to be explained. The frame 106 is movable relative to the base 102 in response to input forces applied by the user to the pedals of bicycle B during use, as will also be explained. In a first direction of movement, as shown in FIGS. 4 and 5, the platform 104 and frame 106 are movable in clockwise and counterclockwise directions about a longitudinal tilt axis, which enables the bicycle B, trainer T and the user to move from side-to-side in response to input forces applied by the user to the pedals of bicycle B.

Figure 6:
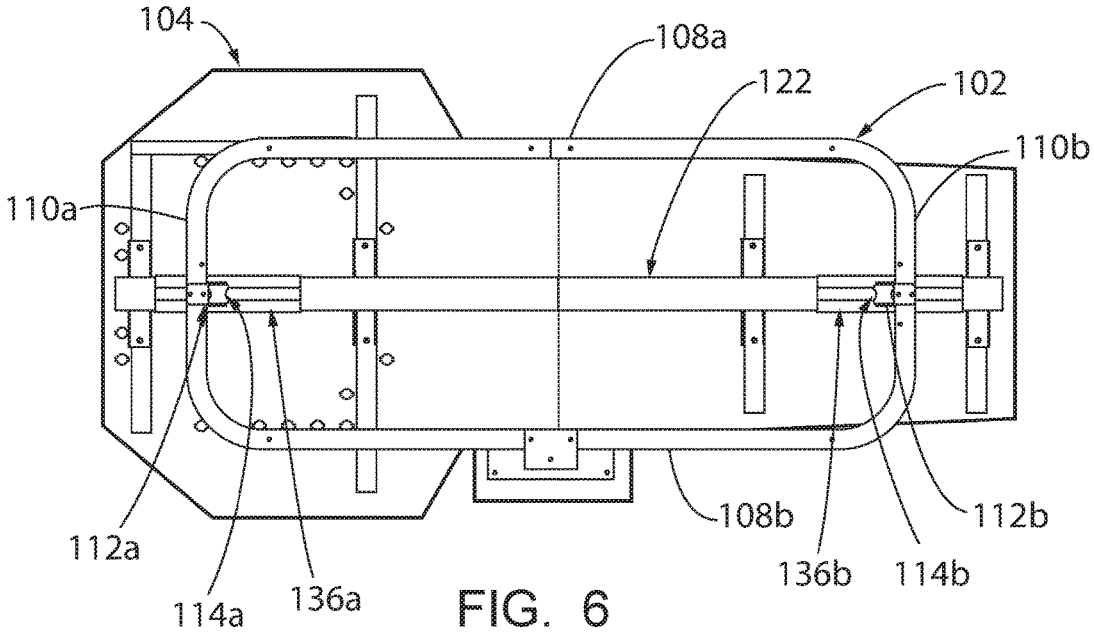
FIG. 6 is a bottom plan view of the movable exercise equipment support of FIGS. 1-5.
Figure 7:
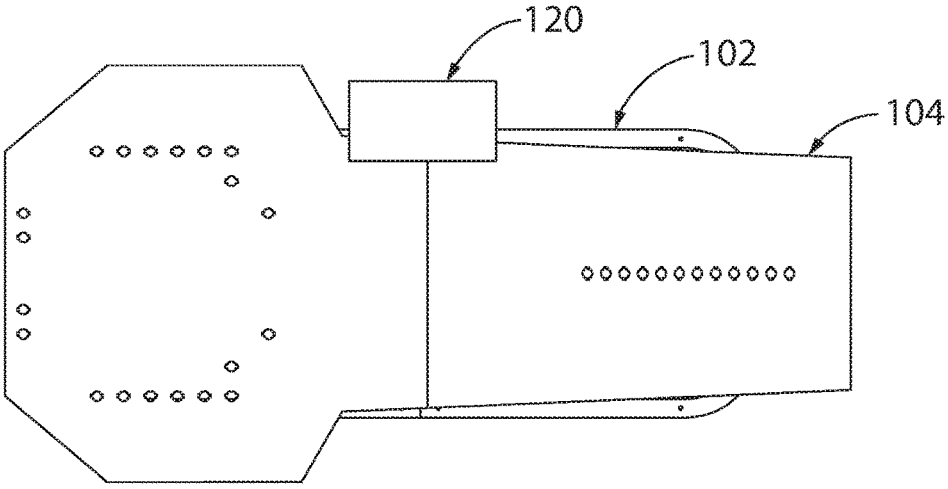
FIG. 7 is a top plan view of the movable exercise equipment support of FIGS. 1-6.
Figure 8:
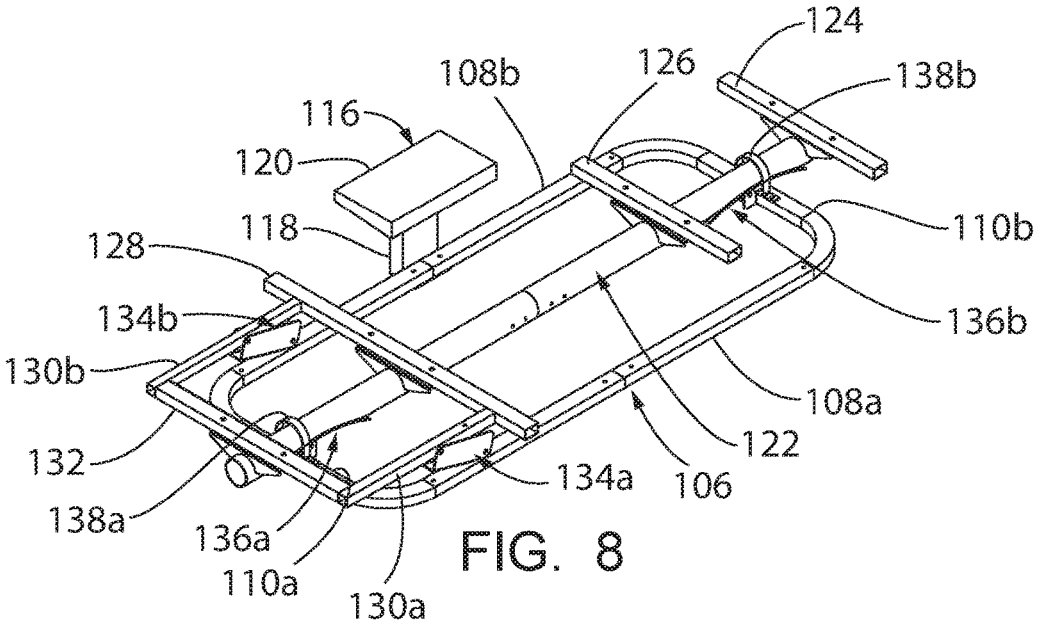
FIG. 8 is an isometric view of a base and frame forming a part of the movable exercise equipment support of FIGS. 1-7.

As shown in FIGS. 6 and 8, the base 102 may be formed of tubular metal members that are secured together in a generally rectangular configuration, although other satisfactory materials and configurations may be employed. In the illustrated embodiment, the base 102 includes a pair of side members 108*a*, 108*b* and a pair of end members 110*a*, 110*b*. A bracket 112*a* is mounted to the end member 110*a*, and a bracket 112*b* is mounted to the end member 110*b*. The bracket 112*a* rotatably supports a grooved roller 114*a*, and the bracket 112*b* rotatably supports a grooved roller 114*b*.

A step 116 is secured to one of the base side members 108*a*, 108*b*. In the illustrated embodiment, the step 116 includes an upright post 118 that is secured at its lower end to the base side member 108*b*, and a generally horizontal step member 120 secured to the upper end of the post 118. The step 116 is stationarily secured to the base 102, and is adapted to support the weight of the user above the platform 104 as the user mounts and dismounts the bicycle B.

In the illustrated embodiment, the frame 106 includes a longitudinal frame member 122 that overlies the base 102 and that extends beyond the ends of base 102. A series of platform mounting members are located above and secured to the longitudinal frame member 122. Representatively, the platform mounting members may include a front transverse platform mounting member 124, an intermediate transverse platform mounting member 126, and a rear transverse platform mounting member 128. A rear subframe, which includes a pair of side subframe members 130*a*, 130*b* and an end subframe member 132, is secured to the rear transverse platform mounting member 128, extending rearwardly therefrom. A pair of tilt biasing bracket assemblies 134*a*, 134*b*, the construction and operation of which will later be explained, are pivotably mounted to side subframe members 130*a*, 130*b*.

The platform 104 overlies and is secured to the platform mounting members 124, 126, 128, 130*a*, 130*b* and 132 of frame 106. The platform 104 may be have a generally flat, planar configuration, defining an upwardly facing top surface on which the bicycle B and trainer T can be positioned. If desired, the platform 104 may include a series of holes or apertures, which may receive fasteners, straps, etc. that can be used to secure the bicycle B and trainer T in position. Suitable fasteners are adapted to extend through openings in the platform mounting members 124, 126, 128, 130*a*, 130*b* and 132 and into engagement with the platform 104 for securing the platform 104 to the frame 106. The platform 104 may have any configuration as desired, and in the illustrated embodiment has a somewhat wider rear area for accommodating the trainer T and a narrower forward area on which the front wheel of the bicycle B is positioned.

Figure 9:
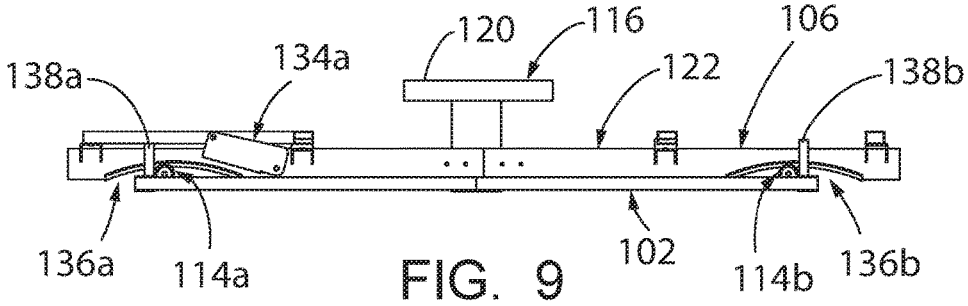
FIG. 9 is a side elevation view of the movable exercise equipment support base and frame of FIG. 8.
Figure 10:
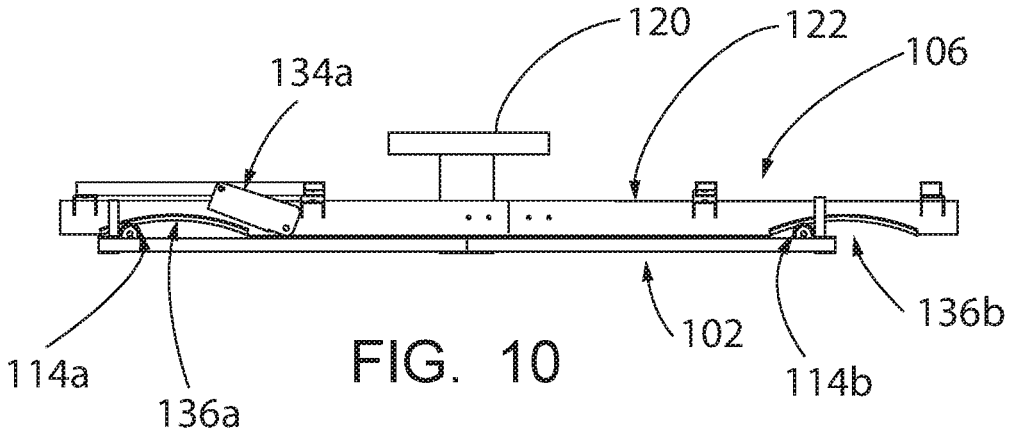
FIG. 10 is a view similar to FIG. 9, showing axial or fore-aft movement of the frame relative to the base in a first direction.
Figure 11:
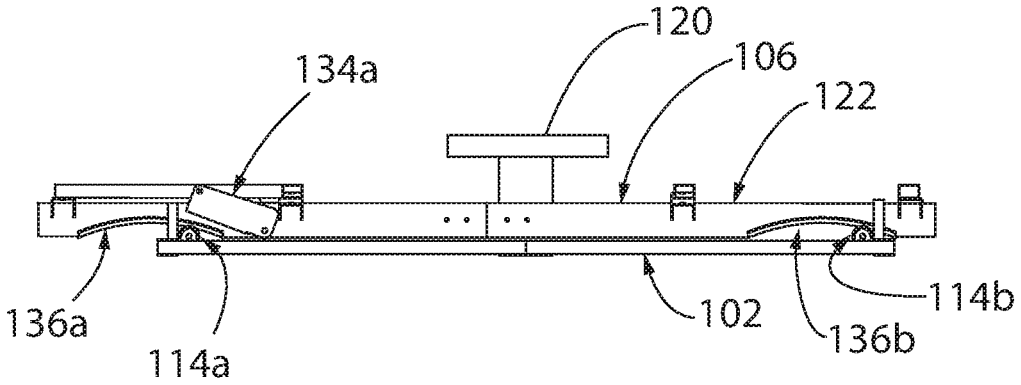
FIG. 11 is a view similar to FIGS. 9 and 10, showing axial or fore-aft movement of the frame relative to the base in a second direction opposite the first direction
Figure 12:
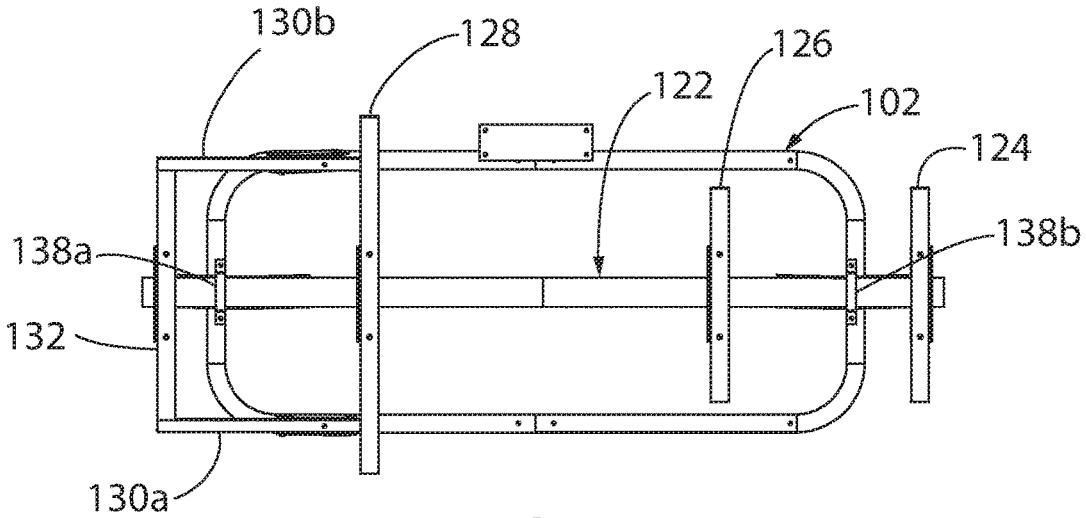
FIG. 12 is a top plan view of the movable exercise equipment support base and frame of FIG. 8.
Figure 13:
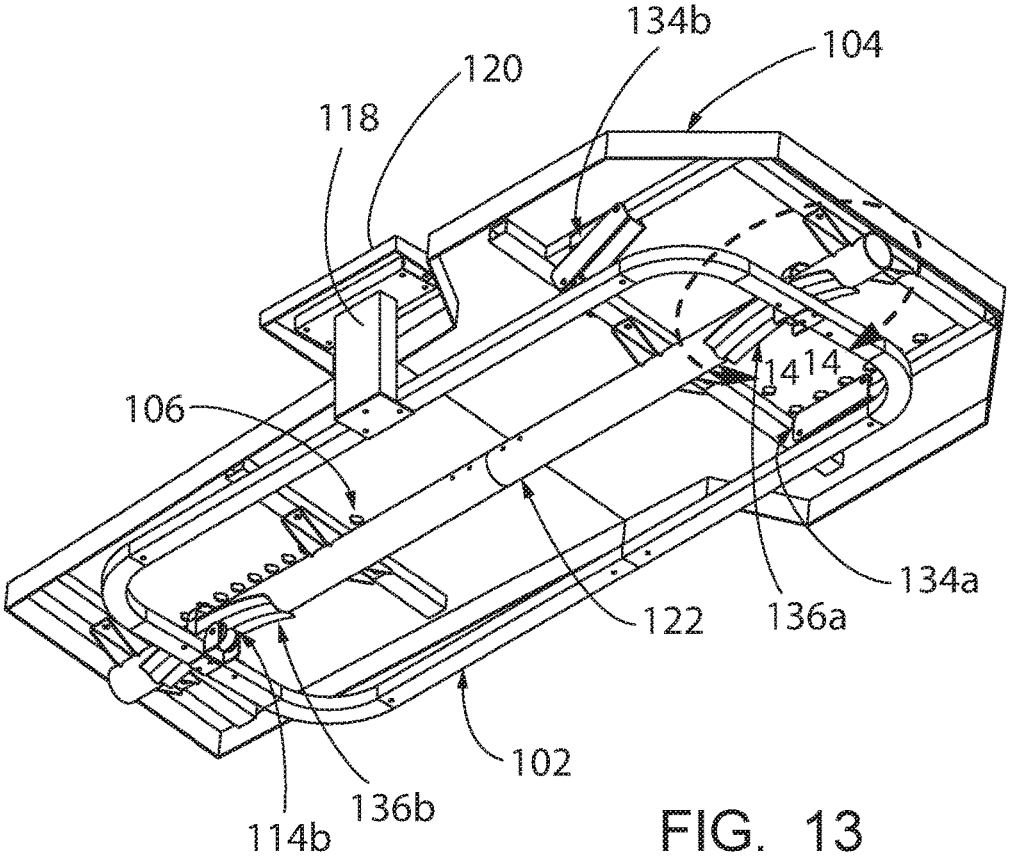
FIG. 13 is isometric view of the underside of the movable exercise equipment support of FIGS. 1-7.
Figure 14:
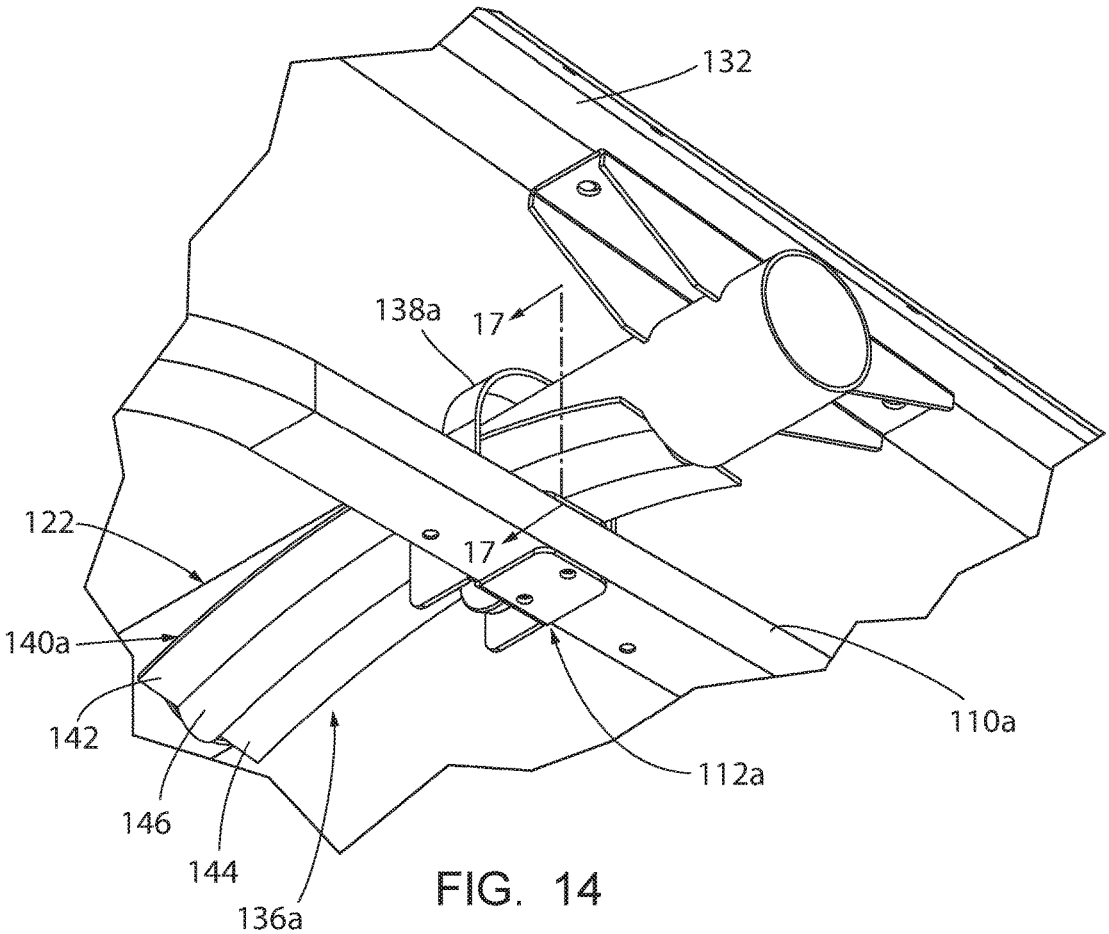
FIG. 14 is an enlarged partial isometric view of the portion of FIG. 13 designated by the line 14-14.
Figure 15:
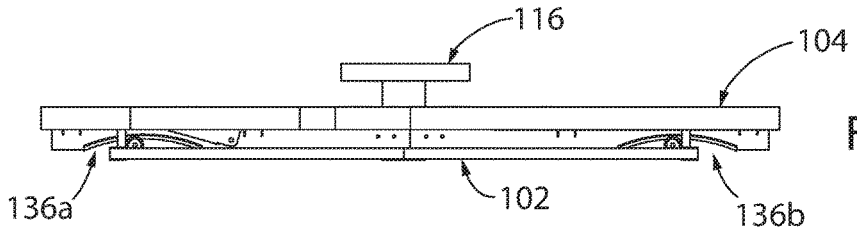
FIGS. 15 and 16 are views similar to FIGS. 9 and 10, respectively, showing the base and frame portions of the movable exercise equipment support with a platform portion of the movable exercise equipment support removed.
Figure 16:
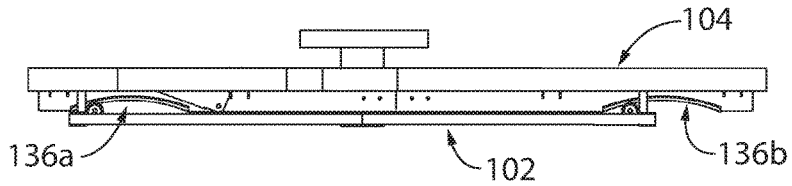

The longitudinal frame member 122 is provided with rear and front engagement areas 136*a*, 136*b*, respectively. The rear and front engagement areas 136*a*, 136*b* rest on and are supported by the rear and front grooved rollers 114*a*, 114*b*, respectively, to allow frame 106, and thereby platform 104 and bicycle B and trainer T supported thereabove, to move in an axial or fore-aft direction relative to the base 102 in response to input forces applied by the user to the pedals of bicycle B. The rear and front engagement areas 136*a*, 136*b* are identically constructed, and have an arcuate configuration that provides movement of the frame 106 upwardly and downwardly as the frame 106 is moved in the axial or fore-aft direction relative to the base 102. In this regard, the frame 106 is gravity biased toward an axially neutral position, as shown in FIG. 9, due to the arcuate configuration of the engagement areas 136*a*, 136*b*. The frame 106 can be moved rearwardly and upwardly relative to the base 102 as shown in FIG. 10, as well as forwardly and upwardly relative to the base 102 as shown in FIG. 11, in reaction to forces that are experienced by the platform 104 and frame 106 in response to application of input forces by the user to the pedals of the bicycle B. Semicircular retainer brackets 138*a*, 138*b* are secured to rear and front end members 110*a*, 110*b*, respectively, and extend over the rear and front end areas, respectively, of longitudinal frame member 122. The retainer brackets 138*a*, 138*b* function to limit the upward movement of longitudinal frame member 122 relative to base 102, to ensure that rear and front engagement areas 136*a*, 136*b* remain in engagement with rear and front grooved rollers 114*a*, 114*b*, respectively.

As noted previously, the rear and front engagement areas 136*a*, 136*b* are identically configured. The details of rear engagement area 136*a* will be described with reference to FIG. 14, with the understanding that such description applies equally to the details of front engagement area 136*b*. In the illustrated embodiment, as detailed in FIG. 14, rear engagement area 136*a* includes a downwardly facing track member 140*a* that is secured to longitudinal frame member 122. In the illustrated embodiment, the track member 140*a* has an arcuate configuration, and is engaged within a correspondingly shaped cut-out area of longitudinal frame member 122. Representatively, the longitudinal frame member 122 may be formed of a tubular member having a generally circular cross-section, and the walls of the tubular member may be cut to form a recess within which the arcuate track member 140*a* is received. Both the longitudinal frame member 122 and the track member 140*a* may be formed of a metal material, and the track member 140*a* may be secured within the recess of longitudinal frame member 122 by welding. It is understood, however, that the longitudinal frame member 122 and track member 140*a* may be formed of any material as desired and the track member 140*a* may be secured to the longitudinal frame member 122 in any desired manner.

The track member 140*a* includes a pair of side areas 142, 144 and a central bead area 146 between the side areas 142, 144. Representatively, the side areas 142, 144 may be relatively flat in cross-section, and the central bead area 146 may have a convex or outwardly arcuate configuration. This configuration is illustrated in FIG. 17, which shows that the central bead area 146 may have a configuration that is generally semicircular.

Figure 17:
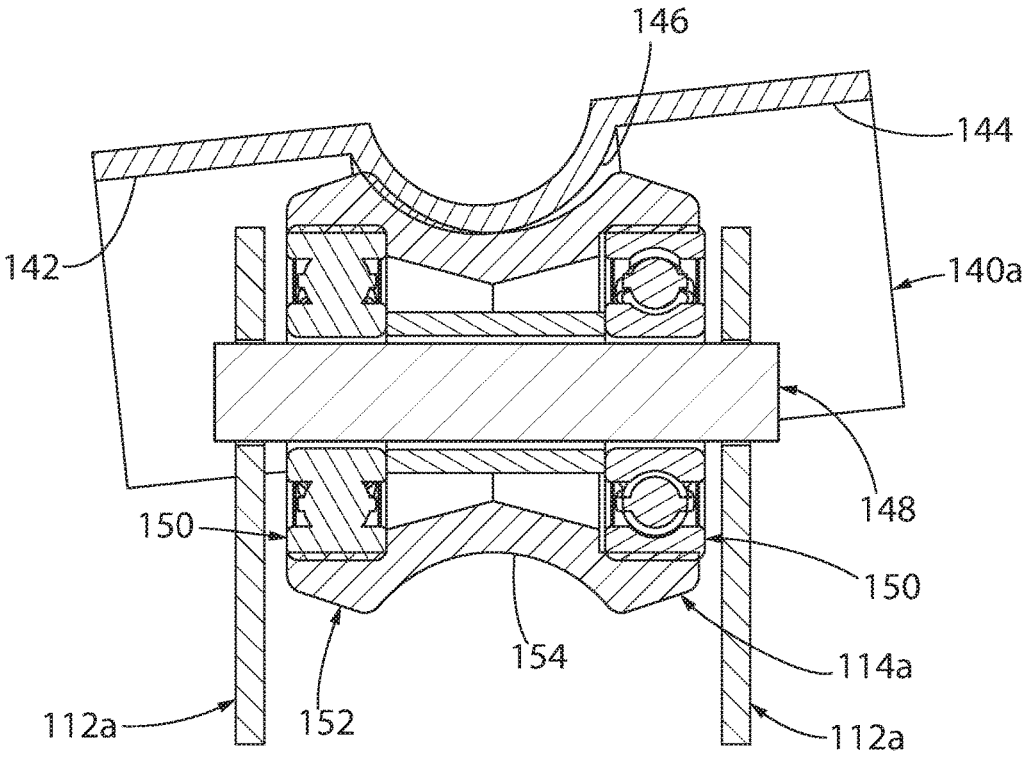
FIG. 17 is a partial section view taken along line 17-17 of FIG. 14.

FIG. 17 also illustrates the grooved roller 114*a* and its engagement with the semicircular central bead area 146 of track member 140*a*. As shown in FIG. 17, the grooved roller 114*a* is located between a pair of upstanding members defined by the bracket 112*a* and is rotatable about an axle or shaft that extends between and is secured to the upstanding members of bracket 112*a*. The grooved roller 114*a* includes a pair of roller bearing assemblies 150 through which the shaft 148 extends, and which are engaged with an outer shell portion 152 of grooved roller 114*a* that defines a groove 154. The groove 154 has a radius that is slightly larger than that of central bead area 146 of track member 140*a*, so that central bead area 146 nests within the groove 154. Engagement of the central bead area 146 within the groove 154 provides the dual function of allowing axial movement of track member 140*a* upon rotation of grooved roller 114*a* to thereby allow longitudinal frame member 122 to move axially relative to base 102, while at the same time allowing longitudinal frame member 122 to pivot relative to grooved roller 114*a*. As can be appreciated, the axial movement of track member 140*a* on grooved roller 114*a* provides axial or fore-aft movement of platform 104 relative to base 102, and pivoting movement of central bead area 146 of track member 140*a* within groove 154 of grooved roller 114*a* provides tilting movement of frame member 122 and thereby platform 104 relative to base 102. Engagement of central bead area 146 within groove 154 further functions to limit transverse or lateral movement of track 140*a* relative to roller 114*a*, which secures the transverse or lateral position of longitudinal frame member 122, and thereby frame 106 and platform 104, relative to base 102.

Figure 18:
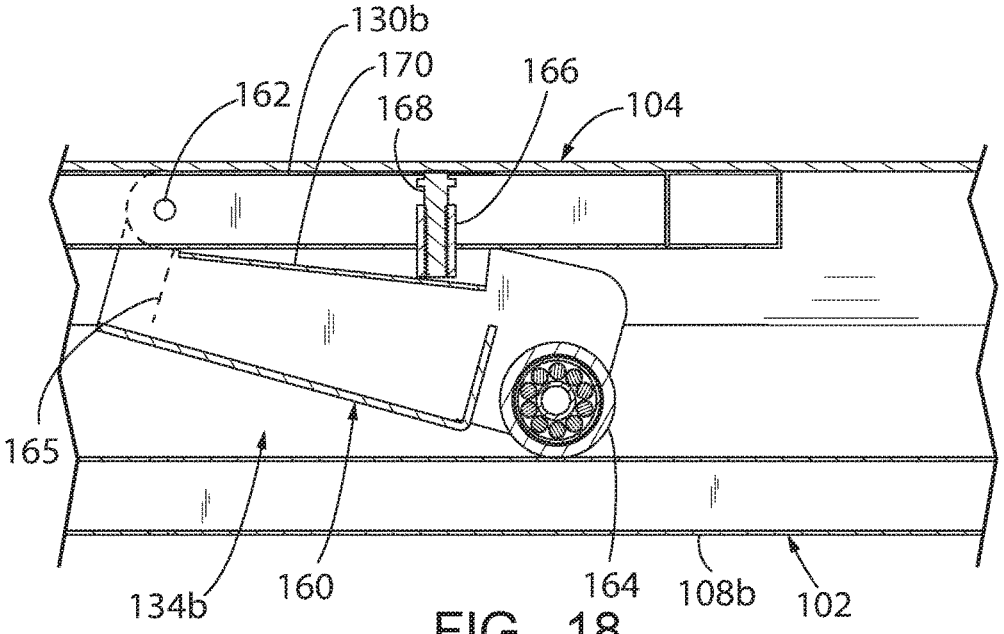
FIG. 18 is a side elevation view, partially in section, showing an embodiment of a biasing arrangement incorporated into the movable exercise equipment support of FIGS. 1-8, with reference to line 18-18 of FIG. 8.
Figure 19:
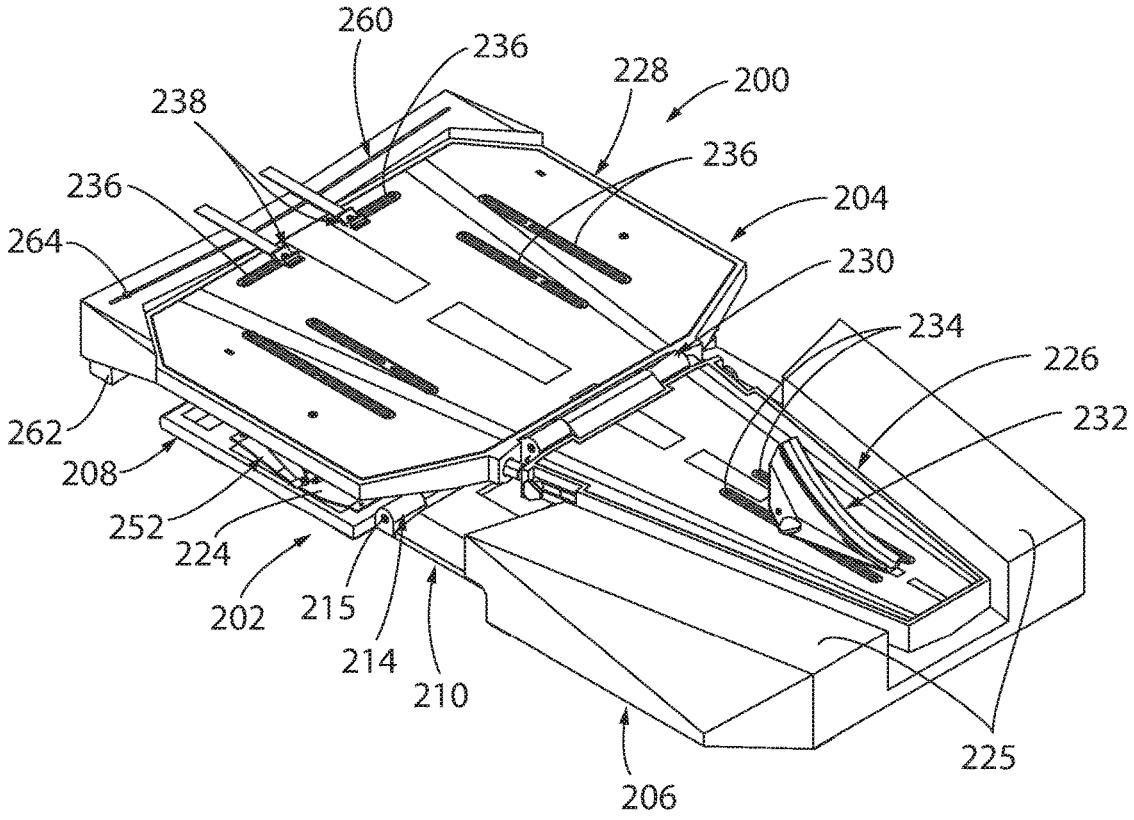
FIG. 19 is an isometric view of another embodiment of a movable exercise equipment support in accordance with the present invention, showing the movable exercise equipment support in an operative, use configuration.
Figure 20:
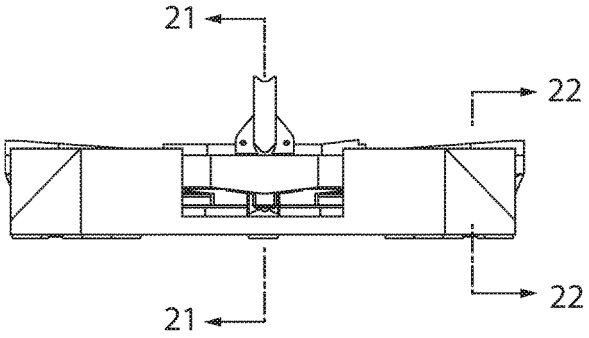
FIG. 20 is an end elevation view of the movable exercise equipment support of FIG. 19.
Figure 21:
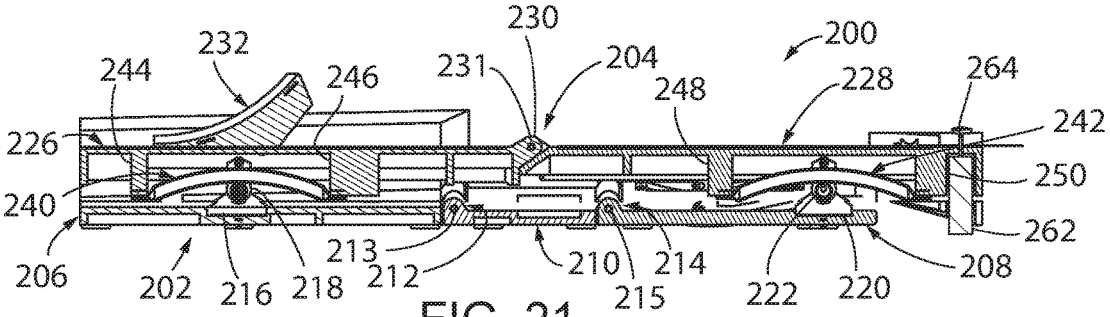
FIG. 21 is a longitudinal section view taken along line 21-21 of FIG. 20.

FIG. 18 illustrates tilt biasing bracket assembly 134*b*, which along with tilt biasing bracket assembly 134*a* functions to bias frame 106, and thereby platform 104, to a neutral tilt position. The following description of tilt biasing bracket assembly 134*b* applies equally to tilt biasing bracket assembly 134*a*.

As shown in FIG. 18, tilt biasing bracket assembly 134*b* includes a bracket member 160, which is pivotably secured at its upper end to side subframe member 130*b* via a pin 162. A wheel or roller 164 is rotatably mounted to the lower end of bracket member 160, and rests on the upwardly facing surface of frame side member 108*b*. A biasing component engages bracket member 160 to bias bracket member 160 downwardly toward frame side member 108*b*. The biasing component may be in the form of a torsion spring, a compression spring, or any other satisfactory mechanism or device for exerting a downward biasing force on bracket member 108*b*. In the illustrated embodiment, the spring is in the form of a foam block 165, which is illustrated in a compressed condition applying an upward biasing force on side frame member 130*b* and a downward biasing force that urges roller 164 against base side member 108*b*. In this manner, roller 164 is biased against the upwardly facing surface of frame side member 108*b*.

A threaded sleeve 166 is secured to side subframe member 130*b*, and an adjustment screw 168 is threadedly engaged with sleeve 166. The adjustment screw 168 has a head at its upper end that can be accessed through an opening in platform 104, and the lower end of adjustment screw 168 bears against a preload bracket shown at 170. Rotation of adjustment screw 168 functions to adjust the rotational position of frame 106 and platform 104 relative to base 102. In this manner, the adjustment screws 168 of tilt biasing bracket assemblies 134*a*, 134*b* can be selectively rotated to place platform 104 in a level orientation.

In use, movable exercise platform 104 and frame 106 of equipment support 100 move in an axial, fore-aft direction and tilt side-to-side during use of the bicycle B by a user, to provide an experience for the user that more closely resembles real-world conditions. In this regard, when the application of forces to the pedals of bicycle B are unbalanced, i.e. when there is a net downward force on one side of bicycle B at any point in time that is experienced by platform 104, the platform 104 will tilt in the direction of the downward force by pivoting movement of the central bead areas, such as 146, of the track members, such as 140, within the grooves, such as 154, of the rollers 114*a*, 114*b*. Simultaneously, when the application of forces to the pedals of bicycle B results in horizontal, axial forces being transferred to platform 104, the platform 104 will move forwardly or rearwardly in an axial or fore-aft direction by axial movement of the track members, such as 140*a*, on the grooved rollers, such as 114*a*. The arcuate configuration of the track members, such as 140*a*, of the engagement areas 136*a*, 136*b* provides a gravity bias of platform 104 toward an axially neutral position in which the rollers 114*a*, 114*b* are positioned in the uppermost central portion of the engagement areas 136*a*, 136*b*, respectively. During such axial or fore-aft movement of the platform 104 and frame 106, the rollers such as 164 of the tilt biasing bracket assemblies 134*a*, 134*b* are moved in an axial or fore-aft direction along the upwardly facing surfaces of the base side members 108*a*, 108*b*. The spring biasing component(s) of the tilt biasing bracket assemblies 134*a*, 134*b* function to maintain the rollers such as 164 of the tilt biasing bracket assemblies 134*a*, 134*b* in contact with the upwardly facing surfaces of the base side members 108*a*, 108*b*, respectively. In this manner, the tilt biasing bracket assemblies 134*a*, 134*b* function to exert upward biasing forces on the underside of platform 104 on either side of longitudinal frame member 122 to bias platform 104 to the neutral tilt position as frame member 122 moves axially relative to base 102, while at the same time the arcuate engagement areas 136*a*, 136*b* bias platform 104 to an axially neutral position during side-to-side tilting movement of platform 104.

FIGS. 19-24 illustrate another embodiment of a movable exercise equipment support in accordance with the present invention, shown at 200. In this embodiment, the movable exercise equipment support 200 includes a foldable base section 202 and a foldable platform section 204.

The foldable base section 202 includes a front base portion 206, a rear base portion 208, and an intermediate base portion 210 located between the front base portion 206 and the rear base portion 208. A front hinge 212 pivotably connects the front base portion 206 to the front of the intermediate base portion 210 via a front hinge pin 213, and a rear hinge 214 pivotably connects the rear base portion 208 to the rear of the intermediate base portion 210 via a rear hinge pin 215. The front and rear hinges 212, 214, respectively, may have any conventional hinge configuration as desired, and enable the front base portion 206 and the intermediate base portion 210 to pivot relative to each other about front hinge pin 213 and the rear base portion 208 and the intermediate base portion 210 to pivot relative to each other about rear hinge pin 215.

The front base portion 206 of base section 202 includes a centrally located front bracket 216 to which a front grooved roller 218 is rotatably mounted. Similarly, the rear base portion 208 of base section 202 includes a centrally located rear bracket 220 to which a rear grooved roller 222 is rotatably mounted. In addition, the rear base portion 208 includes a pair of upwardly facing tracks 224 located one adjacent each side edge of the rear base portion 208. The front base portion 206 also includes a pair of steps 225, which are configured to support the weight of the user when mounting or dismounting the item of exercise equipment, such as bicycle B.

The platform section 204 includes a front platform portion 226 and a rear platform portion 228. The front platform portion 226 is configured to fit between the steps 225 of the front base portion 206. A hinge 230 including a hinge pin 231 pivotably connects the rear of the front platform portion 226 and the front of the rear platform portion 228, to enable the front platform portion 226 and the rear platform portion 228 to pivot relative to each other. The front platform portion 226 may include an optional wheel support 232, which is configured to underlie the front wheel of a bicycle, such as bicycle B, when positioned on movable exercise equipment support 200. The wheel support 232 may be movable within guide tracks or slots 234 formed in front platform portion 226 to accommodate different types and sizes of bicycles and to allow adjustment in the position of the bicycle on the platform section 204. A series of guide tracks or slots 236 may be formed in rear platform portion 228. Retainer straps, such as shown at 238, may be movably mounted in the slots 236. The retainer straps 238 may be employed for securing a bicycle trainer, such as trainer T, in position on the upwardly facing surface of rear platform portion 228.

On its underside, platform section 204 includes front and rear centrally located arcuate tracks 240, 242 secured to front and rear platform portions 226, 228, respectively. The tracks 240, 242 have a construction like that of track member 140 described previously, with a central bead area the extends in a front-rear direction along the length of the track. As also described previously, the central bead areas of the tracks 240, 242 are engaged within the grooves of rollers 218, 222, respectively.

In this embodiment, the front platform portion 226 is formed with a pair of track mounting bosses 244, 246, and the front track 240 extends between and is mounted to the front track mounting bosses 244, 246. Similarly, the rear platform portion 228 is formed with a pair of track mounting bosses 248, 250, and the rear track 242 extends between and is mounted to the rear track mounting bosses 248, 250. Representatively, the bosses 244 and 246 may be formed integrally with the material of front platform portion 226, such as in molding operation. Similarly, the bosses 248 and 250 may be formed integrally with the material of rear platform portion 228, such as in molding operation. It is understood, however, that the bosses may be formed separately and may be secured in any satisfactory manner to the platform section 204.

Figure 22:
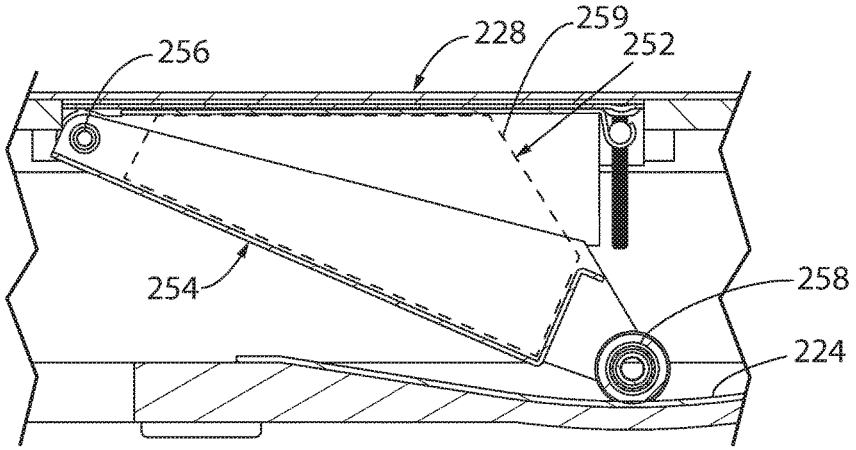
FIG. 22 is a partial section view similar to FIG. 18, showing a tilt biasing arrangement incorporated into the movable exercise equipment support of FIG. 19.

In addition, a pair of tilt biasing bracket assemblies, such as shown at 252, are mounted one to each side of the rear platform portion 228. As shown in FIG. 22, each tilt biasing bracket assembly 252 includes a bracket member 254 that is pivotably mounted to the underside of rear platform portion 228 via a pin 256. A roller 258 is rotatably mounted to the end of bracket member 254 and is engaged with track 224 on rear base section 208. As described previously with respect to tilt biasing bracket assembly 134*a*, a biasing component engages bracket member 254 to bias bracket member 254 downwardly toward frame side member rear base portion 208. The biasing component may be in the form of a torsion spring, a compression spring, or any other satisfactory mechanism or device for exerting a downward biasing force on bracket member 254. In the illustrated embodiment, the spring is in the form of a foam block 259, which is illustrated in a compressed condition applying an upward biasing force on the underside of rear platform portion 228 and a downward biasing force that urges roller 258 against track 224. In this manner, roller 258 is biased against the upwardly facing surface of track 224.

At its rearward end, rear platform portion 228 includes a laterally movable counterweight arrangement. The counterweight arrangement includes a guide track 260 that extends across the rearward end of rear platform portion 228, in combination with a counterweight member 262 located below the guide track 260. The counterweight member 262 is movable within a laterally extending channel formed in the rear end of rear platform portion 228 below guide track 260. A counterweight positioning member, which may be in the form of a button 264, is secured to counterweight member 262. The button 264 has a connector portion that extends through the guide track 260. With this arrangement, the button 264 can be moved along the guide track 260 to place counterweight member 262 in any desired lateral position relative to platform section 204. The position of counterweight member 262 can thus be varied to accommodate any unevenness in the distribution of weight by the item of exercise equipment supported on platform section 204 relative to the longitudinal or fore-aft axis of the platform section 204. Such unevenness may be caused, for example, by engagement of the bicycle B with a trainer T that has a relatively heavy flywheel that is off-center relative to the longitudinal axis of the platform section 204.

Operation of movable exercise equipment support 200 is generally the same as described previously with respect to the movable exercise equipment support 100 of FIGS. 1-18. That is, exercise equipment support 200 moves in an axial, fore-aft direction and tilts side-to-side during use of the bicycle B by a user, to provide an experience for the user that more closely resembles real-world conditions. The platform section 204 will tilt in the direction of the downward force by pivoting movement of the central bead areas of the track members, 240, 242, within the grooves of the rollers 218, 222, respectively. Simultaneously, when axial horizontal forces are transferred to platform section 204, the platform section 204 will move forwardly or rearwardly in an axial or fore-aft direction by axial movement of the track members 240, 242 on the grooved rollers 218, 222, respectively. The arcuate configuration of the track members 240, 242 provides a gravity bias of platform section 204 toward an axially neutral position in which the rollers 218, 222 are positioned in the uppermost central portion of the track members 240, 242, respectively. During such axial or fore-aft movement of the platform section 204, the rollers such as 258 of the tilt biasing bracket assemblies 252 are moved in an axial or fore-aft direction along the upwardly facing surfaces of the tracks such as 224. The spring biasing component(s) of the tilt biasing bracket assemblies 252 function to maintain the rollers such as 258 of the tilt biasing bracket assemblies 252 in contact with the upwardly facing surfaces of the tracks 224. In this manner, the tilt biasing bracket assemblies 252 function to exert upward biasing forces on the underside of platform section 204 on either side of longitudinal axis of platform section 204 to bias platform section 204 to the neutral tilt position while platform section 204 moves axially relative to base section 202, while at the same time the arcuate configuration of tracks 240, 242 biases platform section 204 to an axially neutral position during side-to-side tilting movement of platform section 204. The arcuate shape of track 224 isolates the tilt bias from the effects of fore-aft movement of the platform section 204, to provides a consistent tilt biasing force throughout the range of movement of platform section 204.

Figure 23:
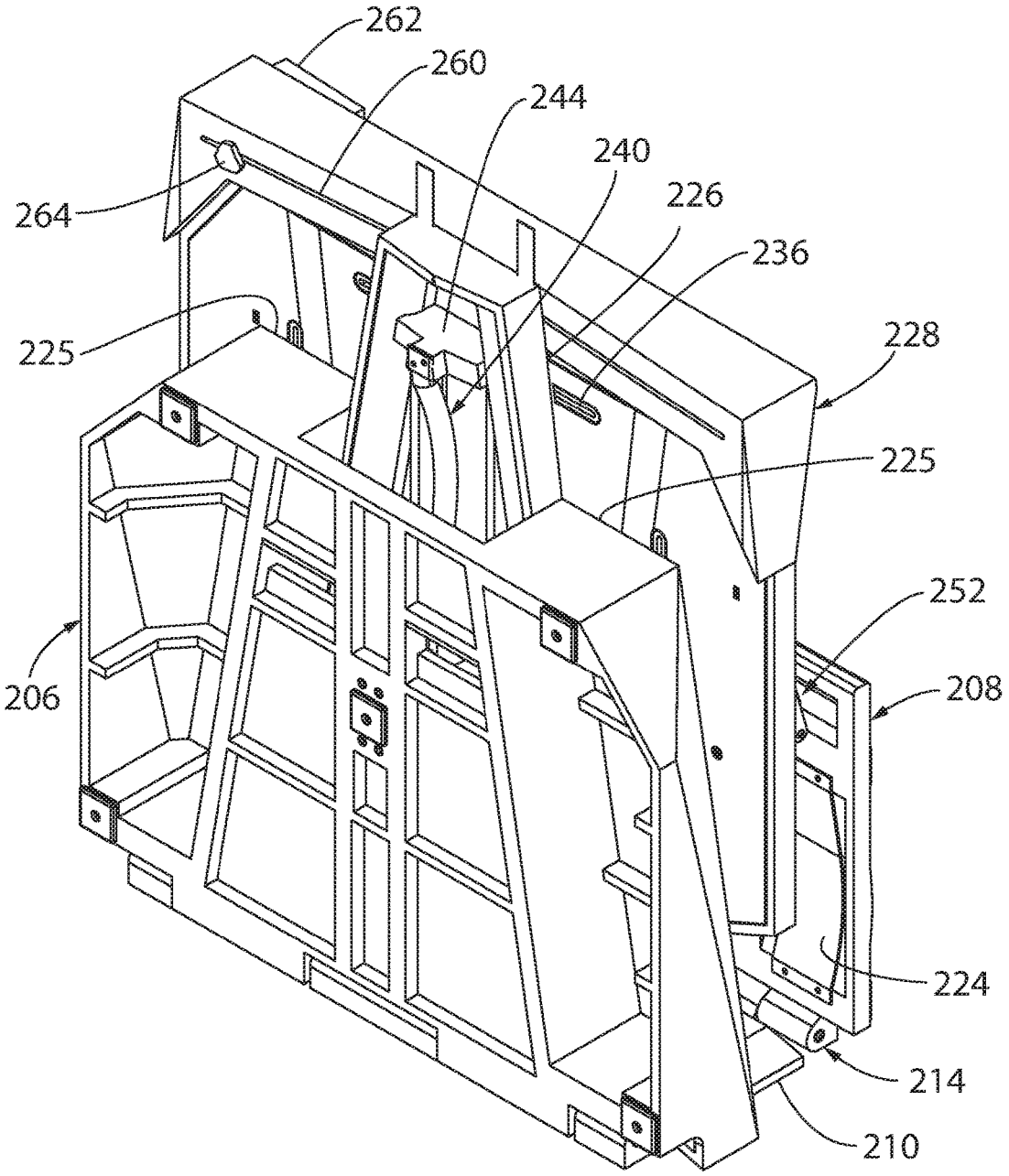
FIG. 23 is an isometric view of the movable exercise equipment support of FIGS. 19-22, showing the movable exercise equipment support in an inoperative, folded configuration.
Figure 24:
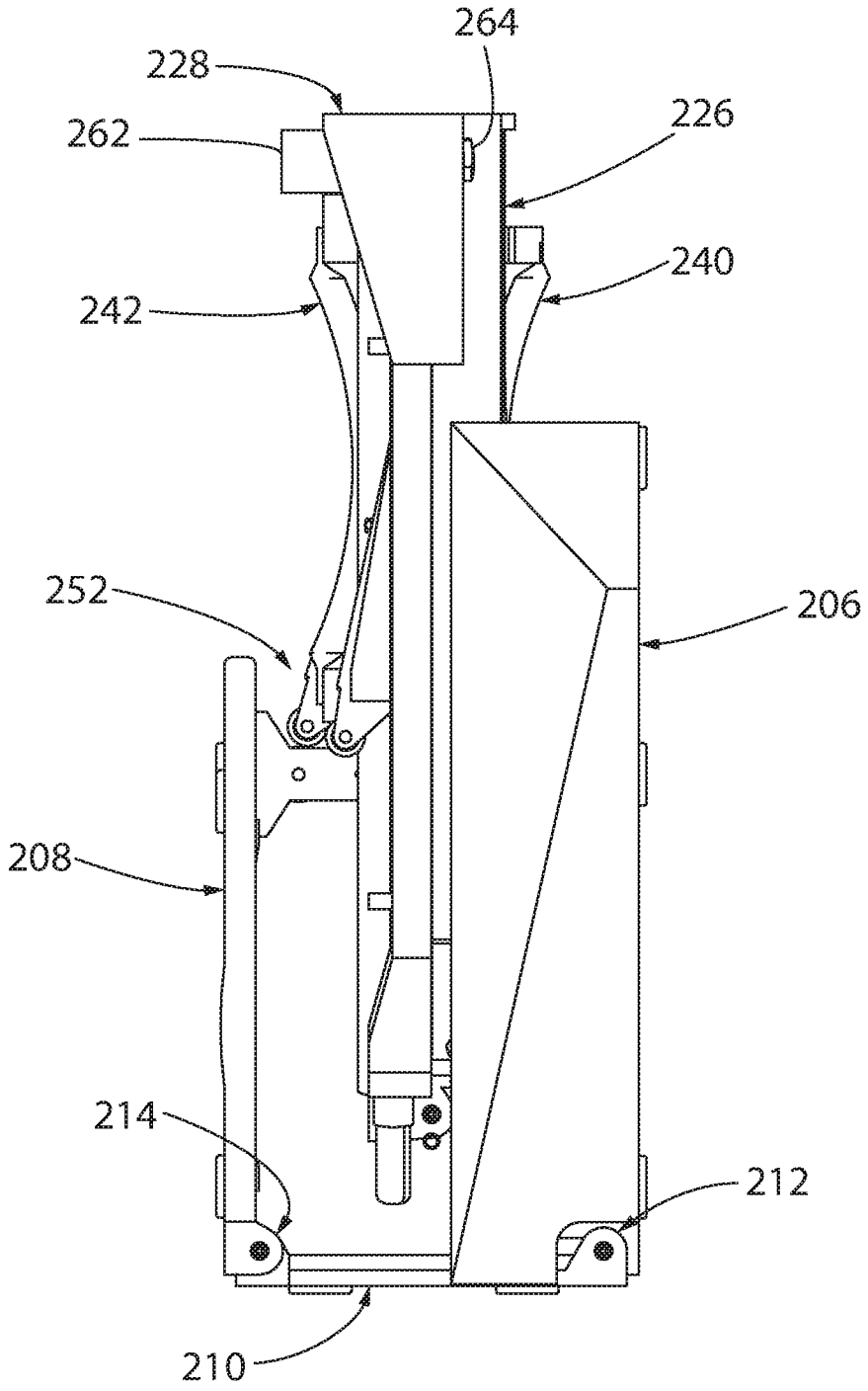
FIG. 24 is a side elevation view of the folded movable exercise equipment support of FIGS. 19-23.

The construction and configuration of movable exercise equipment support 200 provides an added feature as shown in FIGS. 23 and 24. In this regard, when movable exercise equipment support 200 is not in use, such as during shipment or storage, it can be folded to a relatively compact inoperative configuration. To accomplish this, front and rear platform portions 226, 228, respectively, are pivoted together at hinge 230. Intermediate base portion 210 has a width slightly greater than the folded-together width of front and rear platform portions 226, 228, respectively, so that front base portion 206 can be folded upwardly to a position adjacent front platform portion 226 and rear base portion 208 can be folded upwardly to a position adjacent rear platform portion 228. Suitable latch mechanisms may be employed for selectively maintaining the movable exercise equipment support 200 in the folded position.

The embodiments illustrated in FIGS. 1-24 show the front wheel of the bicycle B being engaged with and supported on a trough or riser structure secured to the front area of the platform. It is understood, however, that the front of the bicycle B may be supported in any other manner as desired such as, but not limited to, a fork mount in a manner as is known.

Figure 24A:
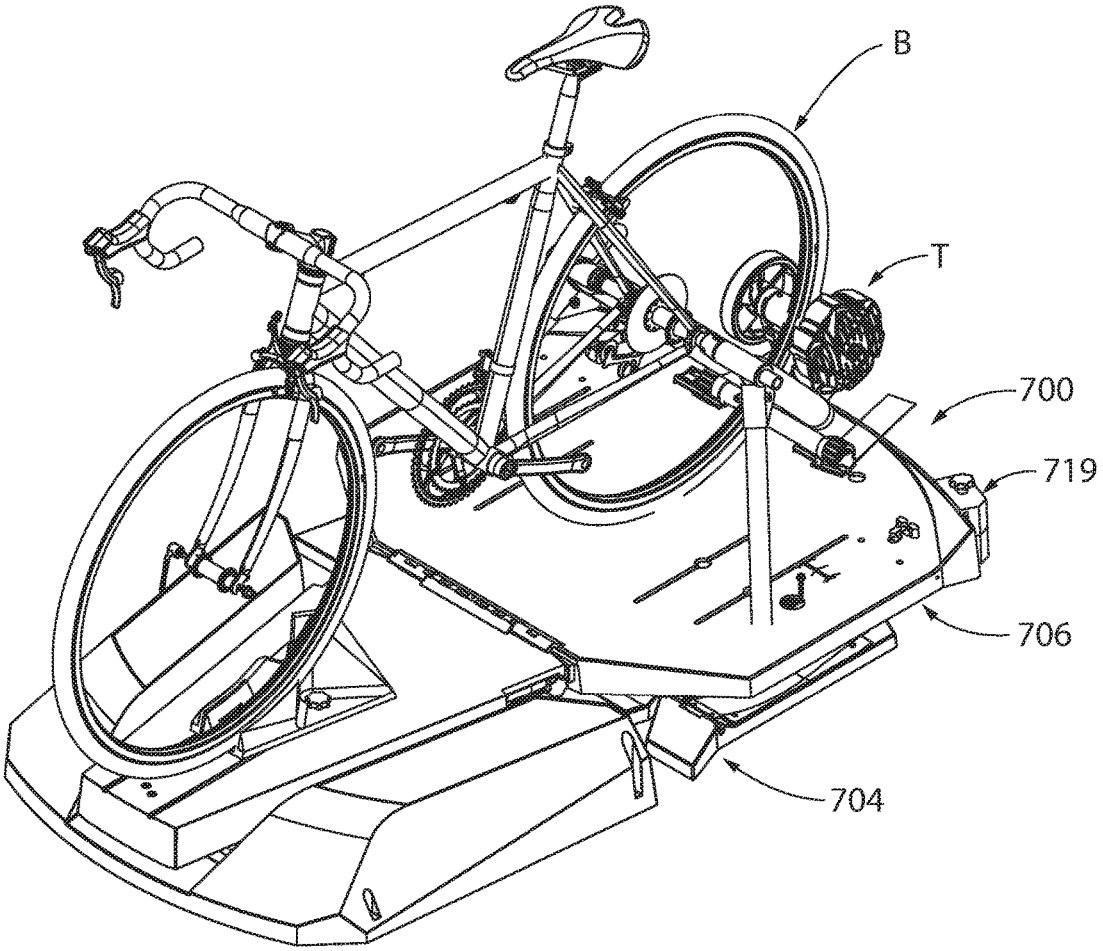
FIG. 24*a* is an isometric view of an embodiment of a movable exercise equipment support similar to that shown in FIGS. 19-25, showing a bicycle and trainer positioned on the exercise equipment support.
Figure 24B:
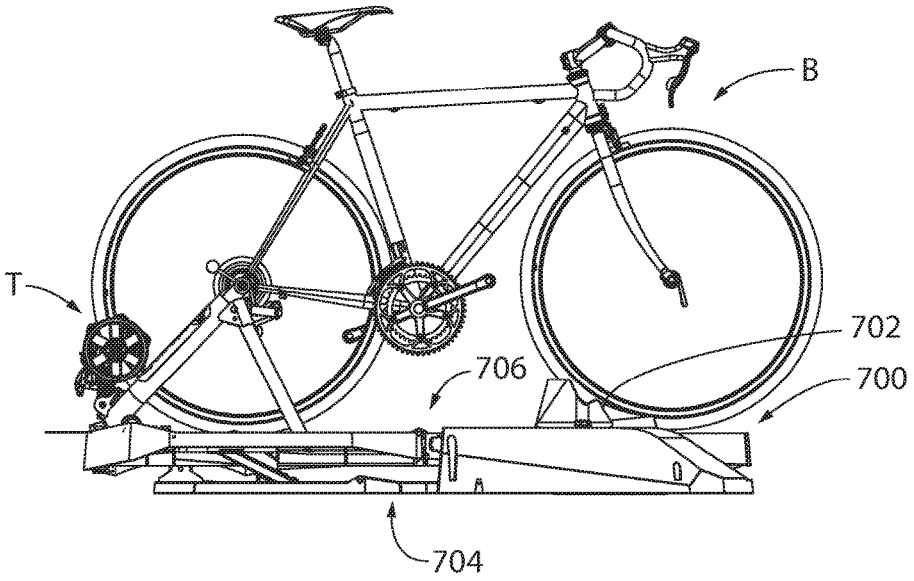
FIG. 24*b* is a side elevation view of the movable exercise equipment support of FIG. 24*a;*
Figure 24C:
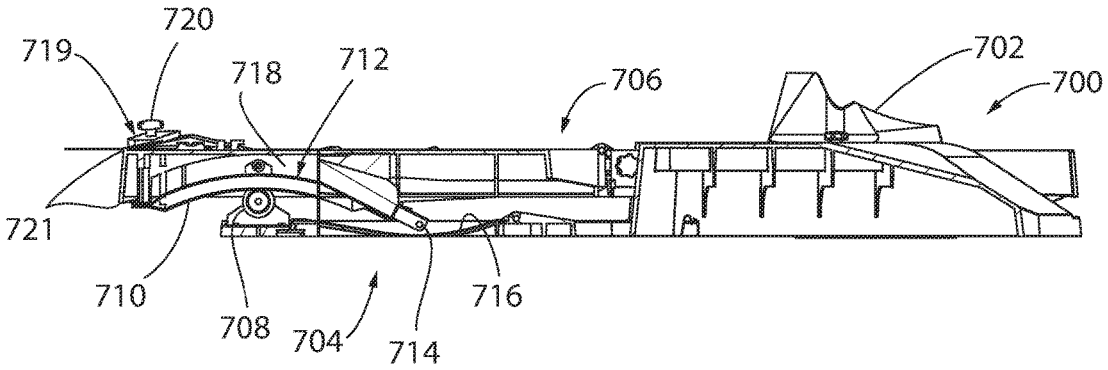
FIG. 24*c* is a longitudinal section view of the movable exercise equipment support of FIG. 24*a;*
Figure 24D:
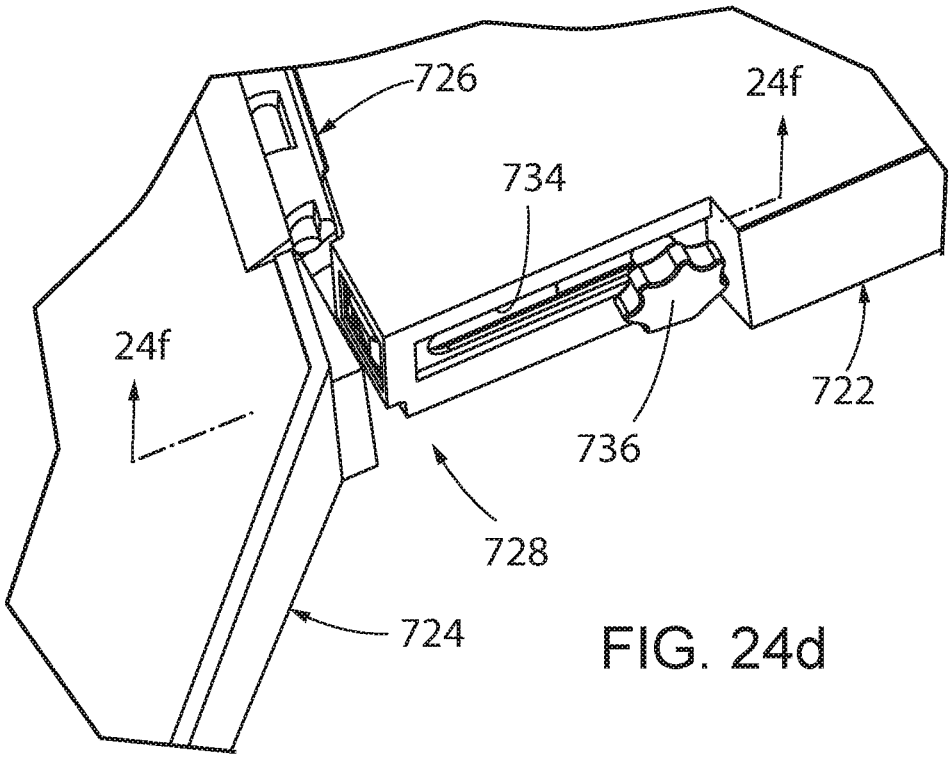
FIG. 24*d* is a partial isometric view showing a portion of the movable exercise equipment support of FIG. 24*a* and a coupling mechanism incorporated therein, in which the coupling mechanism is shown in a retracted or inoperative position.
Figure 24E:
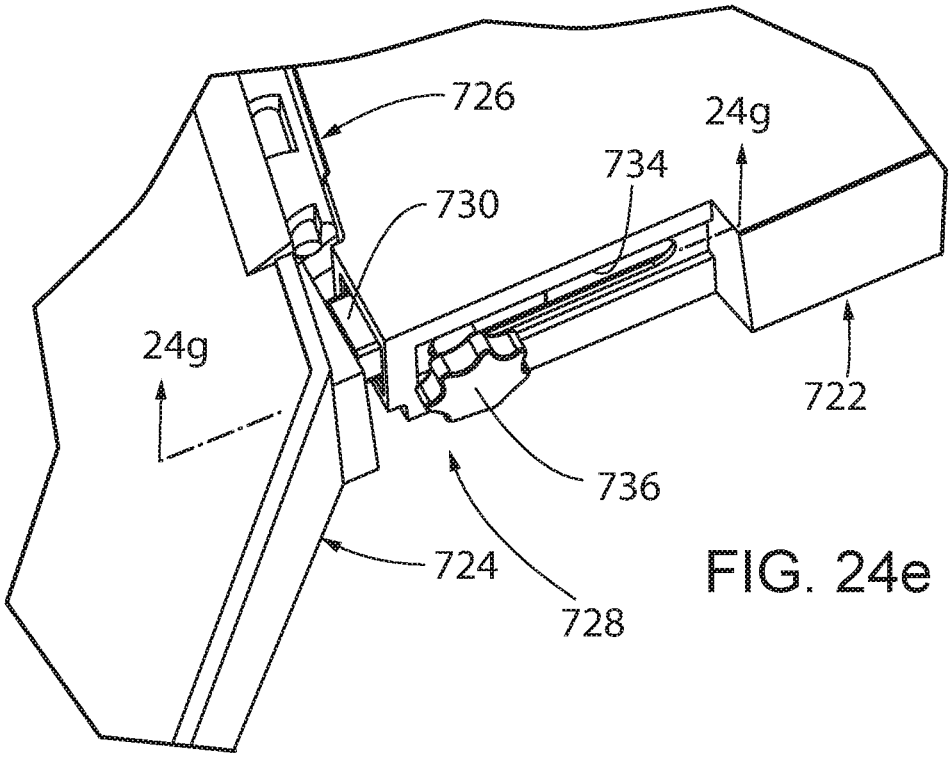
FIG. 24*e* is a view similar to FIG. 24*d*, showing the coupling mechanism in an extended or operative position.

FIG. 24*a*-24*c* illustrates an embodiment of a movable exercise equipment support in accordance with the present invention, shown generally at 700, which is generally similar to the embodiment of FIGS. 19-24. The bicycle B and trainer T are shown as being supported on the movable exercise equipment support 700. While the drawings illustrate the trainer T in the form of a wheel-on trainer, it is understood that any other type of trainer, such as a direct drive trainer, may be employed. A front wheel support 702 is positioned on the front platform portion of movable exercise equipment support 700 for supporting the front wheel of bicycle B.

The base section and platform section of movable exercise equipment support 700 are similar in construction and operation to the base and platform sections 202, 204 of movable exercise equipment support 200 as shown and described with respect to FIGS. 19-24. The illustrations of movable exercise equipment support 700 illustrate additional features that may be incorporated into the movable exercise equipment supports 200, 700.

As shown in FIG. 24*c*, the movable exercise equipment support 700 has a base section 704 and a platform section 706. Grooved rollers, such as 708, are rotatably mounted to the base section 704, and arcuate beaded tracks, such as shown at 710, are secured to the platform section 706 and engaged with the grooved rollers 708 for providing axial fore-aft movement of the platform section 706 relative to the base section 704. Tilt biasing bracket assemblies, such as 712, which have rollers such as 714, are provided on platform section 706 for biasing the platform section 706 toward a neutral tilt position. The tilt bracket rollers 714 are engaged with and movable along tracks, such as 716, on the base section 704.

The tracks 716 of base section 704 have a curvature and configuration that matches that of tracks 710 of platform section 706, but face upwardly rather than downwardly. That is to say, the engagement surface of each track 710 faces downwardly whereas the engagement surface of each track 716 faces upwardly. In addition, each track 716 is axially offset relative its associated track 710 by a distance corresponding to the center-to-center spacing between roller 708 and roller 714. With this arrangement, the tilt biasing force exerted on the tilt biasing bracket assembly 712 by the spring, shown at 718, is not affected by the axial position of the platform section 706 relative to the base section 704. As can be appreciated, if the roller 714 of the tilt bracket assembly 712 were to move along differently configured surface on the base section 704, such as a flat surface, the biasing force exerted by the spring 718 would change constantly during axial movement of the platform section 706 relative to the base section 704. The configuration of the track 710 and the track 716 as shown in FIG. 24*c* avoids this problem.

This embodiment illustrates an alternative version of a counterweight arrangement for offsetting any axial imbalance of the exercise equipment relative to the platform. In this version, a counterweight 719 is made up of upper and lower counterweight sections that are secured together via an extendible and retractable screw, which can be operated using a knob 720. Each counter weight section is provided with a transverse channel, within which upper and lower lips 721 defined at the rear surface of rear platform section 706 are received. The lips 721 extend across the width of the platform section 706. By loosening the counterweight screw using the knob 720, the counterweight 719 can be moved to any desired position along the width of the platform section 706. When the counterweight 719 is in the desired position, the screw is tightened using the knob 720 to move the counterweight sections together, which clamps the counterweight sections onto the lips 721 and maintain it in the desired position.

FIGS. 24*d*-24*g* illustrate another feature, in the form of a latch or coupling arrangement, that may be incorporated into the movable exercise equipment supports such as 200, 700. As described previously, the movable exercise equipment support may include a front platform portion 722 and a rear platform portion 724, which are foldably connected via a hinge 726. A coupling mechanism, shown generally at 728, is provided for selectively securing the front and rear platform portions 722, 724, respectively, together to maintain the platform portions in an unfolded, operative configuration. A coupling mechanism such as 728 may be provided on either or both sides of the movable exercise equipment support.

The coupling mechanism 728 includes a coupler shaft 730 that is slidably disposed within a passage 732 that extends inwardly from the end surface of front platform portion 722. A slot 734 is formed in a portion of the length of the wall of front platform portion 722 that forms passage 732. A handle or knob 736 is located exteriorly relative to the wall of front platform portion 722, and a threaded shank extends inwardly from the knob 736 and into engagement with a transverse threaded passage 738 formed in a side area of coupler shaft 730. The knob 736 may be employed to axially move the coupler shaft 730 within slot 734, with the range of movement of coupler shaft 730 being governed by engagement of the shank with the ends of slot 734.

A receiver passage 740 extends inwardly from the end surface of rear platform portion 724, and is generally in alignment with passage 732 when the front platform portion 722 and the rear platform portion 724 are unfolded. The receiver passage 740 has a cross-section similar to, but slightly larger than, that of coupler shaft 730.

Figure 24F:
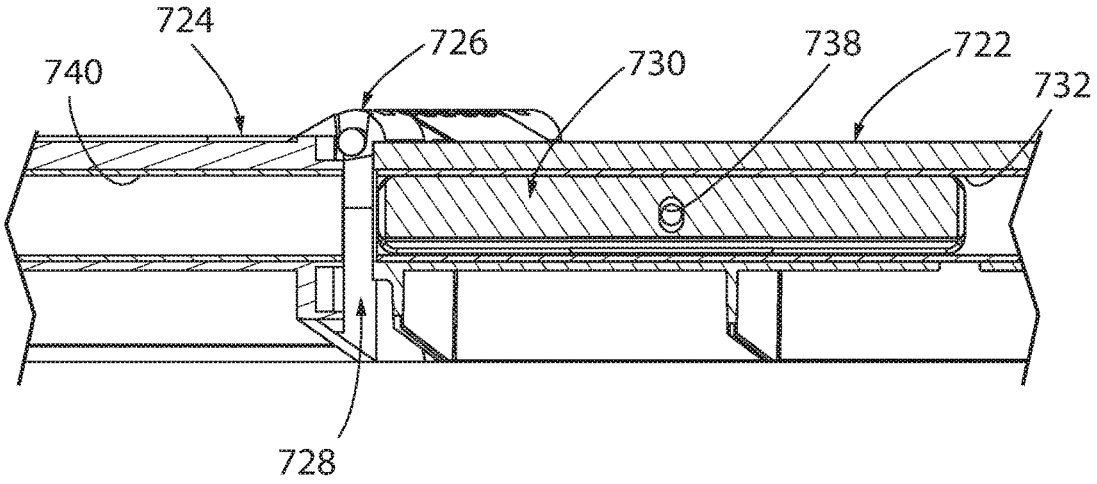
FIG. 24*f* is a partial section view taken along line 24*f*-24*f* of FIG. 24*d;*
Figure 24G:
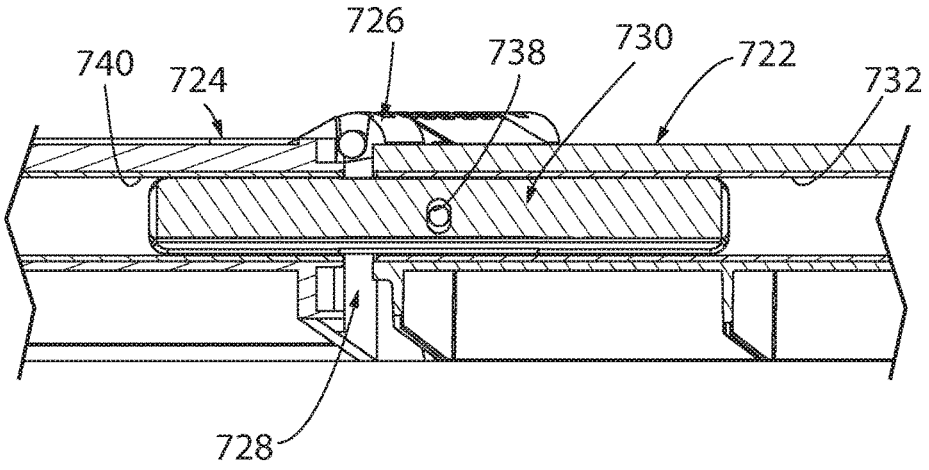
FIG. 24*g* is a partial section view taken along line 24*g*-24*g* of FIG. 24*e;*

With this arrangement, when the platform portions 722, 724 are initially unfolded, the coupler shaft passage 732 and the receiver passage 740 are generally aligned with each other, as shown in FIG. 24*f*. The user then grasps knob 736 and advances coupler shaft 730 rearwardly so as to move coupler shaft 730 into receiver passage 740. Coupler shaft 730 thus functions to prevent front platform portion 722 and rear platform portion 724 from being moved away from the unfolded operative position. Simultaneously, movement of coupler shaft 730 into receiver passage 740 provides an automatic leveling of front and rear platform portions 722, 724, respectively, on the base of the movable exercise equipment support due to the gravity bias of the connected platform portions 722, 724 toward a horizontal position.

Figure 24H:
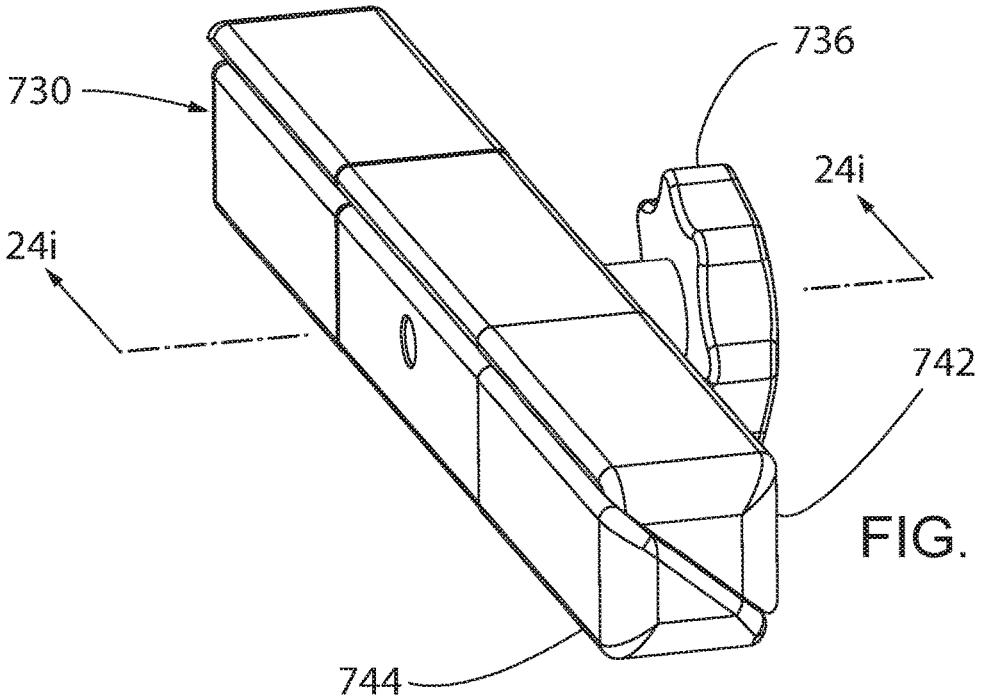
FIG. 24*h* is an isometric view of a movable coupling member incorporated into the coupling mechanism of FIGS. 24*d*-24*g;*
Figure 24I:
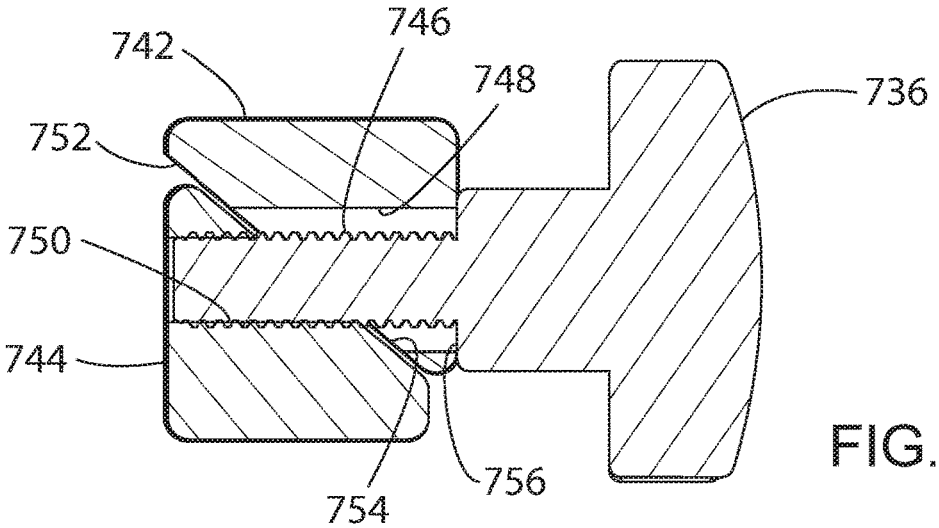
FIG. 24*i* is a section view taken along line 24*i*-24*i* of FIG. 24*h;*
Figure 24J:
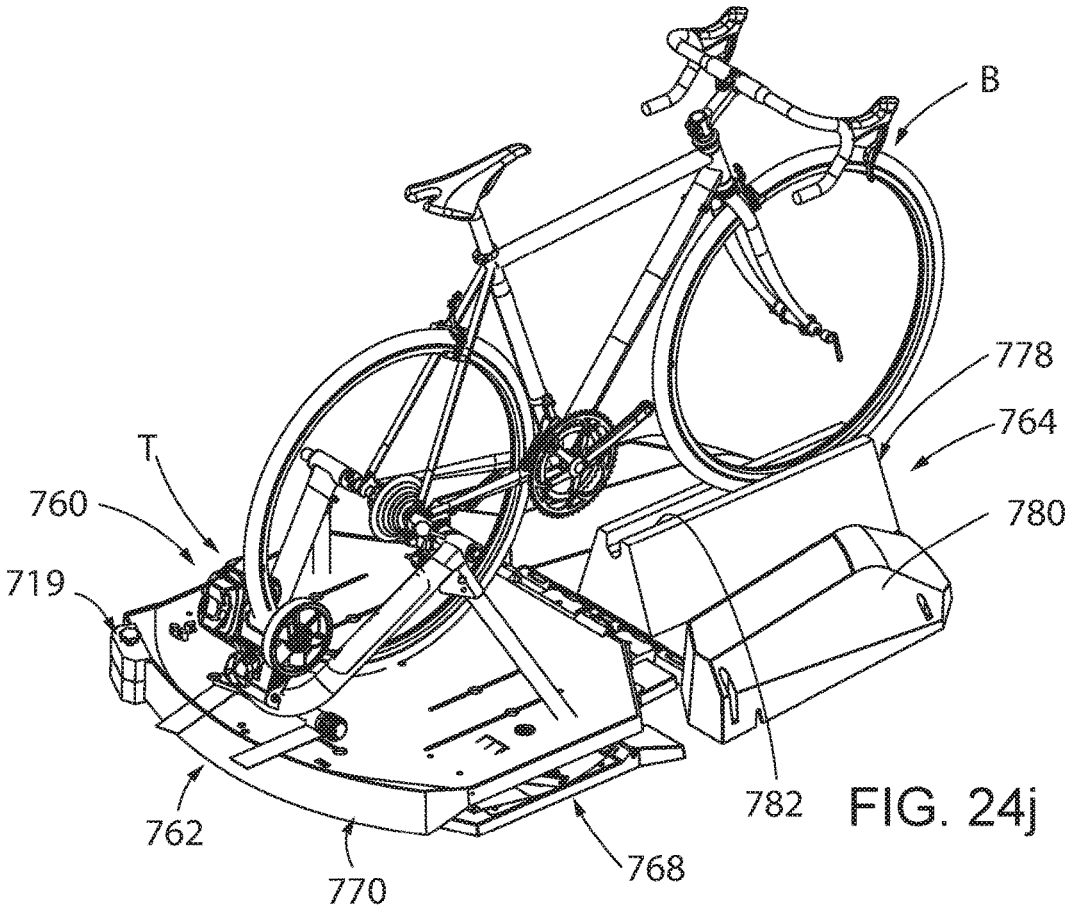
FIG. 24*j* is an isometric view of another embodiment of a movable exercise equipment support in accordance with the present invention.
Figure 24K:
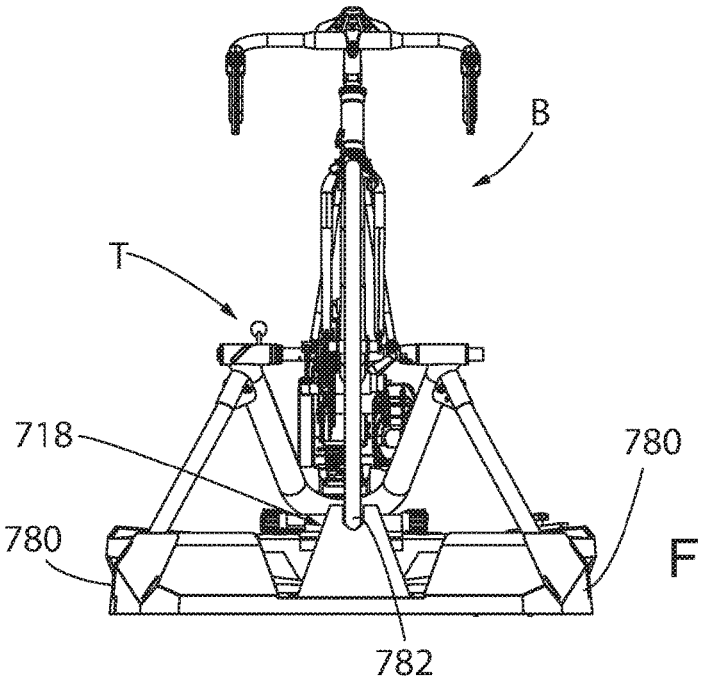
FIG. 24*k* is a front elevation view of the movable exercise equipment support of FIG. 24*j;*
Figure 24L:
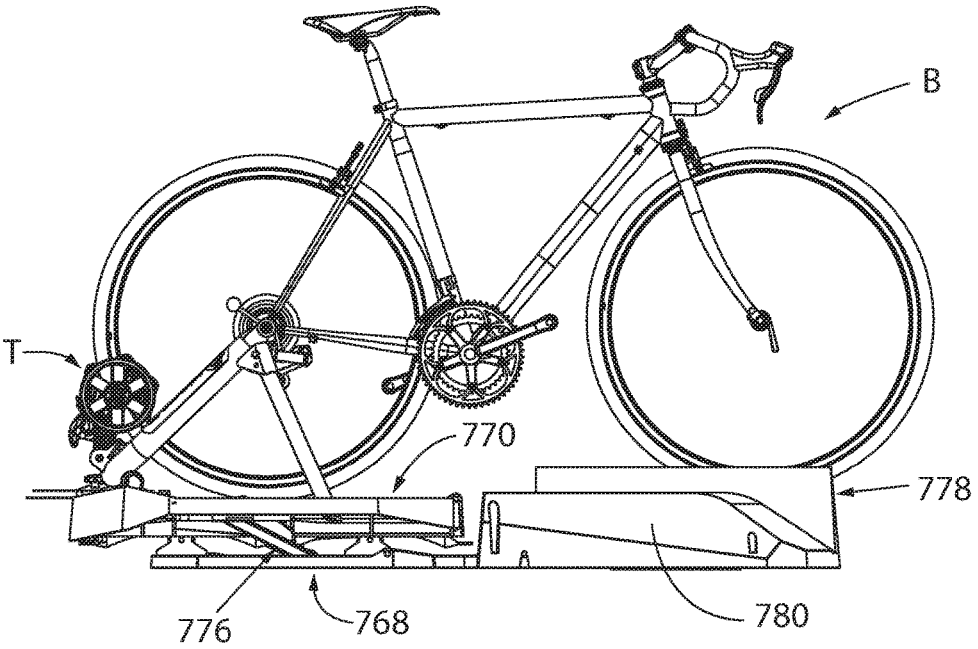
FIG. 24*l* is a side elevation view of the movable exercise equipment support of FIG. 24*j;*
Figure 24M:
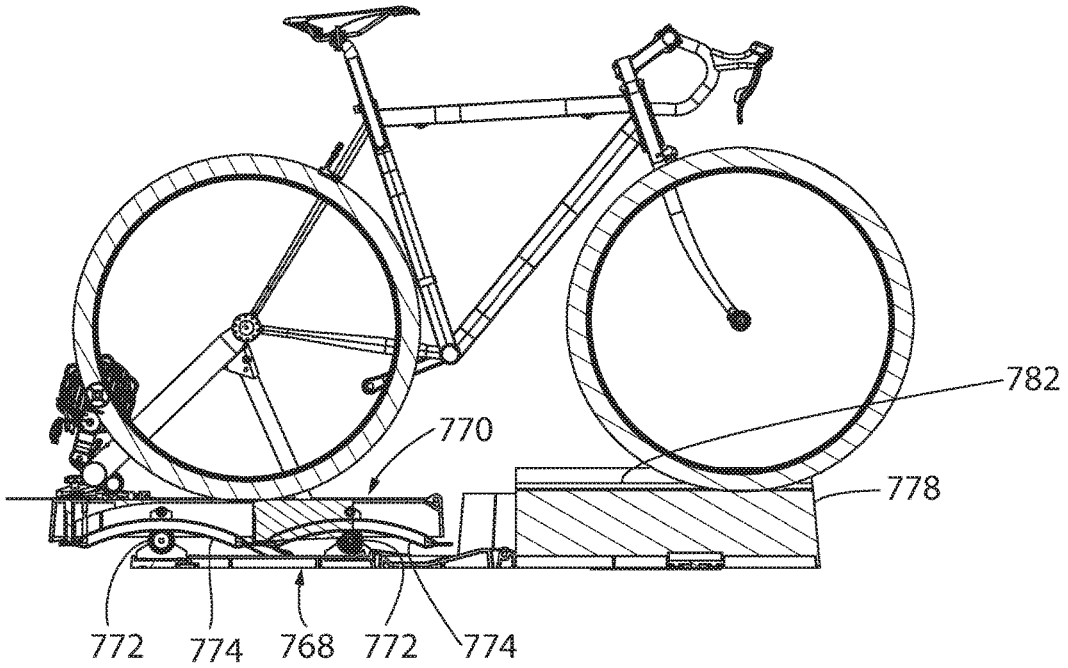
FIG. 24*m* is a longitudinal section view of the movable exercise equipment support of FIG. 24*j;*
Figure 25:
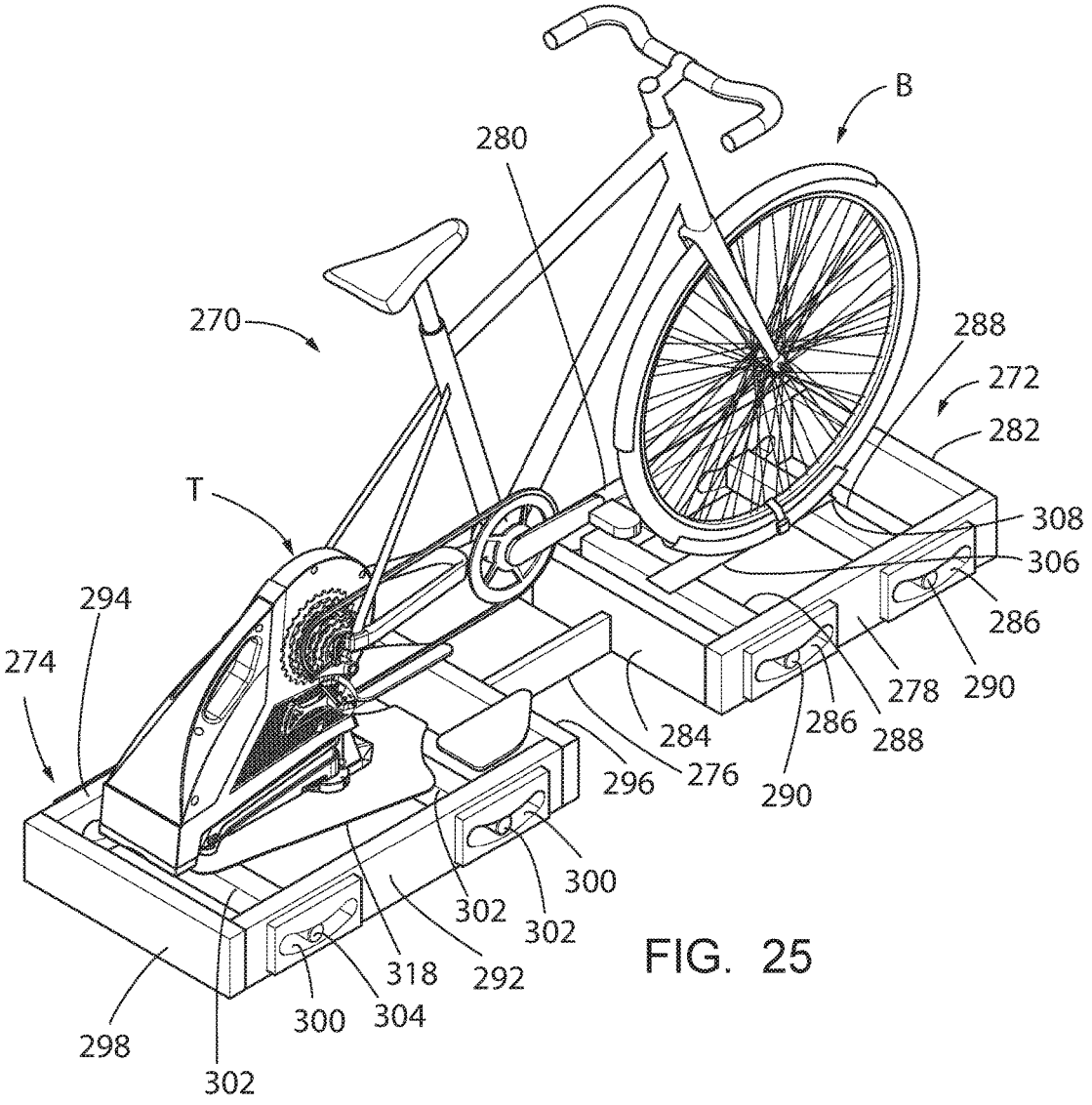
FIG. 25 is an isometric view of another embodiment of a movable exercise equipment support in accordance with the present invention.
Figure 26:
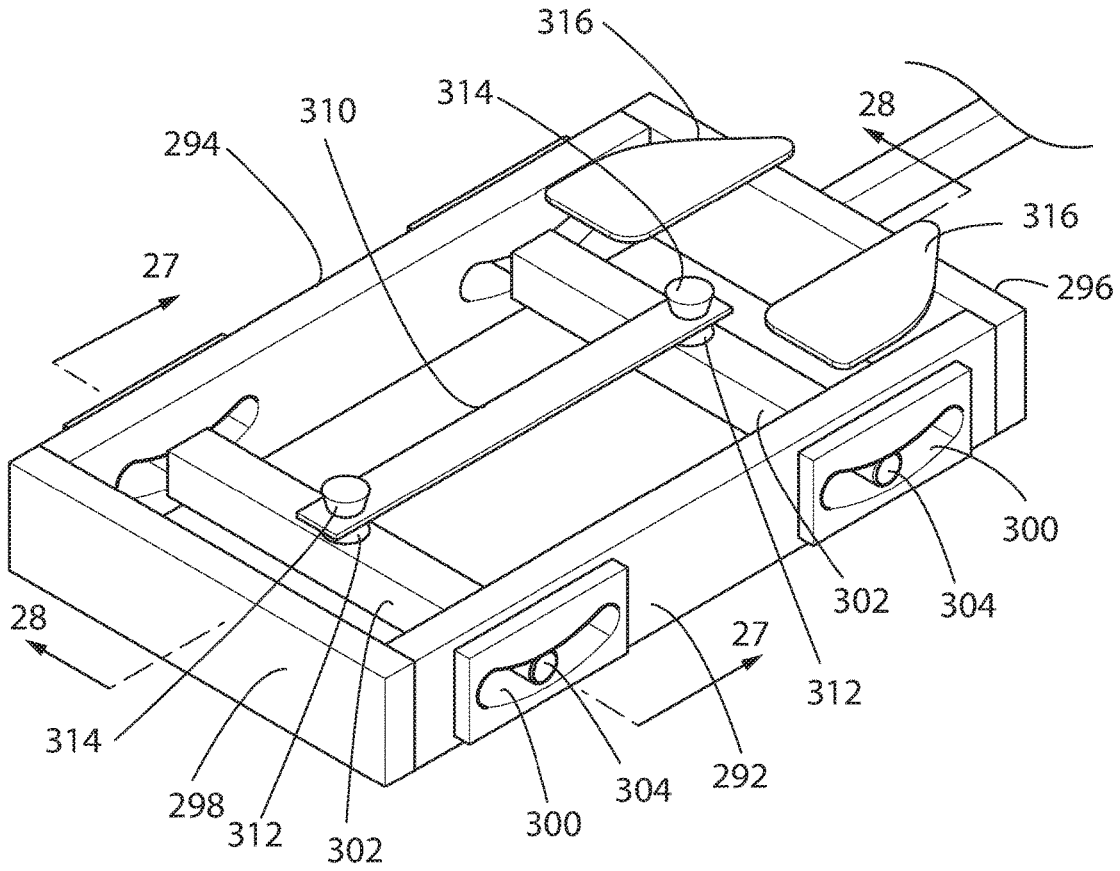
FIG. 26 is a partial isometric view showing a rear portion of the movable exercise equipment support of FIG. 25.
Figure 27:
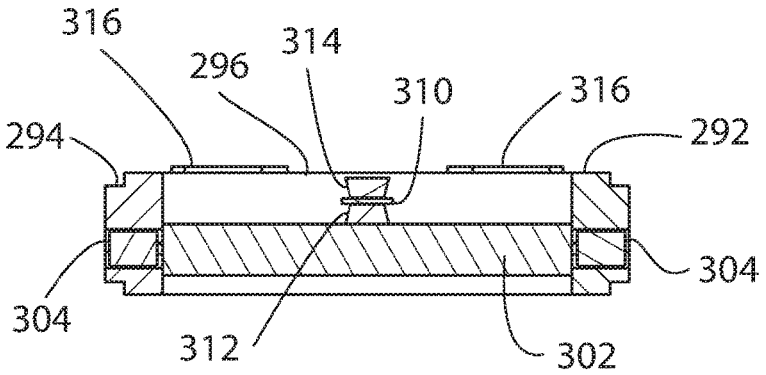
FIG. 27 is a section view taken along line 27-27 of FIG. 26.
Figure 28:
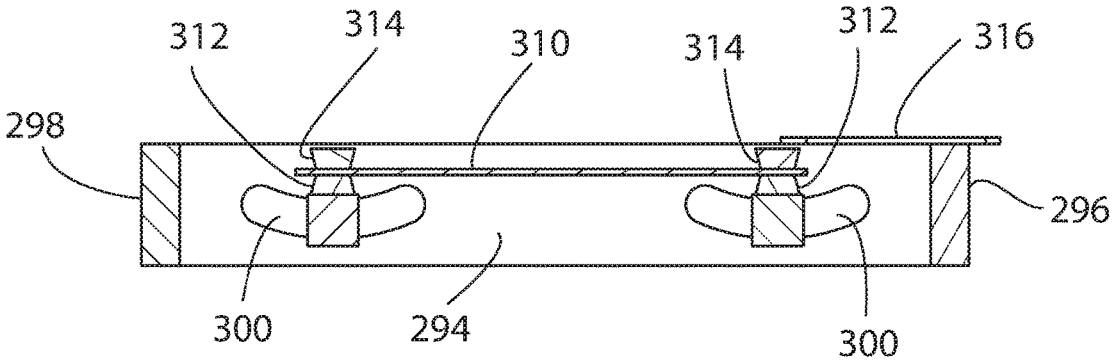
FIG. 28 is a partial section view taken along line 28-28 of FIG. 26.

FIGS. 24*h* and 24*i* illustrate a representative construction of coupler shaft 730. In this embodiment, coupler shaft 730 includes a pair of coupler shaft sections 742, 744 that are engaged with each other via the threaded shaft, shown at 746, that is connected to and extends from knob 736. The shaft 746 extends through a slotted passage 748 in coupler shaft section 742, and the threaded end portion of shaft 746 is secured within a threaded passage 750 in coupler shaft section 744. The coupler shaft sections 742, 744 are provided with complementary angled engagement surfaces 752, 754, respectively. Knob 736 defines a shoulder 756 so that, when knob 736 is turned to advance threaded shaft 746, engagement of shoulder 756 with the surface of coupler shaft section 742 at the entrance of slotted passage 748 causes engagement surface 752 of coupler shaft section 742 to slide laterally and upwardly on engagement surface 754 of coupler shaft section 744. Since the passages 732, 740 are only slightly larger than the cross-section of coupler shaft 730, such movement of coupler shaft section functions to securely engage the surfaces of coupler shaft sections 742, 744 with the walls of the passages 732, 740, to securely engage the coupler shaft 730 with the front and rear platform portions 722, 724, respectively, and to prevent movement of coupler shaft 730 due to vibration or relative movement of the platform portions 722, 724.

FIGS. 24*j*-24*m* illustrate another embodiment of a movable exercise equipment support, shown at 760, in accordance with the present invention. The bicycle B and trainer T are shown as being supported on the movable exercise equipment support 760. While the drawings illustrate the trainer T in the form of a wheel-on trainer, it is understood that any other type of trainer, such as a direct drive trainer, may be employed.

In this embodiment, the movable exercise equipment support 760 includes a rear portion 762 and a front portion 764. The rear portion 762 includes a base 768 and a platform 770. The base 768 includes a pair of axially aligned rollers 772, and the platform 770 includes a pair of downwardly facing beaded tracks 774 that are engaged with the rollers 772. The rollers 772 and the tracks 774 have generally the same construction and function as described previously, providing both axial fore-aft movement and tilting movement of platform 770 relative to base 768. Tilt biasing bracket assemblies, such as shown at 776, are provided on platform 770 and engage base 768 to bias platform 770 toward a neutral tilt position, as described previously.

In this embodiment, the front portion 764 of movable exercise equipment support 760 is stationary. A front wheel support 778 underlies the front wheel of the bicycle B, and a pair of steps 780 are provided one on either side of wheel support 778. The front wheel support 778 includes an upwardly facing slot or channel 782. The channel 782 is configured to receive the front wheel of bicycle B, so that the front wheel of bicycle can move axially in a fore-aft direction in response to axial forces applied to the bicycle B during operation. When transverse or lateral forces are experienced by the bicycle B during operation, the bottom of the front wheel of bicycle B rotates within the channel 782 to enable the bicycle B to tip or tilt. With this arrangement, the movable exercise equipment support 760 has somewhat of a hybrid movement system due to axial and tilting movement of the platform 770 at the rear of bicycle B and conventional, although tracked, rolling and tilting of the front wheel of the bicycle B within the channel 782 of the wheel support 778.

FIGS. 25-28 illustrate another embodiment of a movable exercise equipment support in accordance with the present invention, shown at 270. In this embodiment, movable exercise equipment support 270 is illustrated as supporting a bicycle B and trainer T (in this case a direct drive trainer), although it is understood that any other type of exercise equipment may be employed.

The movable exercise equipment support 270 generally includes a front section 272 and a rear section 274, which are joined together by a connector member 276. The front section 272 has a generally rectangular configuration, including a pair of sidewalls 278, 280 and a pair of end walls 282, 284. The sidewalls 278, 280 are provided with arcuate slots 286. Front cross-members 288 extend between the sidewalls 278, 280. Each front cross-member 288 includes a roller 290 at each end, which is positioned within one of the slots 286. In a similar manner, rear section 274 has a generally rectangular configuration, including a pair of sidewalls 292, 294 and a pair of end walls 296, 298. The sidewalls 292, 294 are provided with arcuate slots 300. Rear cross-members 302 extend between the sidewalls 292, 294. Each rear cross-member 302 includes a roller 304 at each end, which is positioned within one of the 300.

A front wheel support 306 extends between and is secured to front cross-members 288. The front wheel support 306 may have a wheel-engaging trough 308 secured thereto, which is adapted to receive the front wheel of bicycle B to retain it in position relative to front section 272. Similarly, with reference to FIG. 26, a rear support member 310 extends between and is secured to rear cross-members 302. A lower resilient pad or cushion member 312 is secured between rear support member 310 and the facing surface of rear cross-member 302. An upper resilient pad or cushion member 314 is secured to the upper surface of rear support member 310. A pair of steps 316 may be provided on rear section 274 to assist a user and mounting and dismounting the bicycle B.

The trainer T may be provided with or secured to a mounting plate 318, and the mounting plate 318 in turn is secured to the upper surface of rear support member 310. The rear support member 310 and the front and rear sets of cushion members 312, 314 extend along a longitudinal axis defined by movable exercise equipment support 270, and cushion members 312, 314 enable the trainer T and bicycle B to tilt or tip about an axis parallel to the longitudinal axis of movable exercise equipment support 270. The cushion members 312, 314 are formed of a stiff yet resilient material, which tends to bias mounting plate 318 toward a horizontal position. In this manner, trainer T and bicycle B are biased toward an upright, vertical position. As described previously, the tipping or tilting of trainer T and bicycle B can occur when, during use of bicycle B, one side of the movable exercise equipment support 270 experiences a net downward or upward force relative to the other. Simultaneously, when horizontal forces are applied to bicycle B and trainer T, such forces are transferred via front and rear support members 306, 310, respectively, to front and rear sections 272, 274, respectively, of movable exercise equipment support 270. Such forces cause movement of front rollers 290 within slots 286 and rollers 304 within slots 300, to allow bicycle B and trainer T to move in a fore-aft direction. The arcuate and upwardly facing convex configuration of slots 286, 300 provide a gravity bias of rollers 290, 304, respectively, toward their lowermost positions within slots 286, 300, to bias bicycle B and trainer T toward an axially neutral position.

Figure 29:
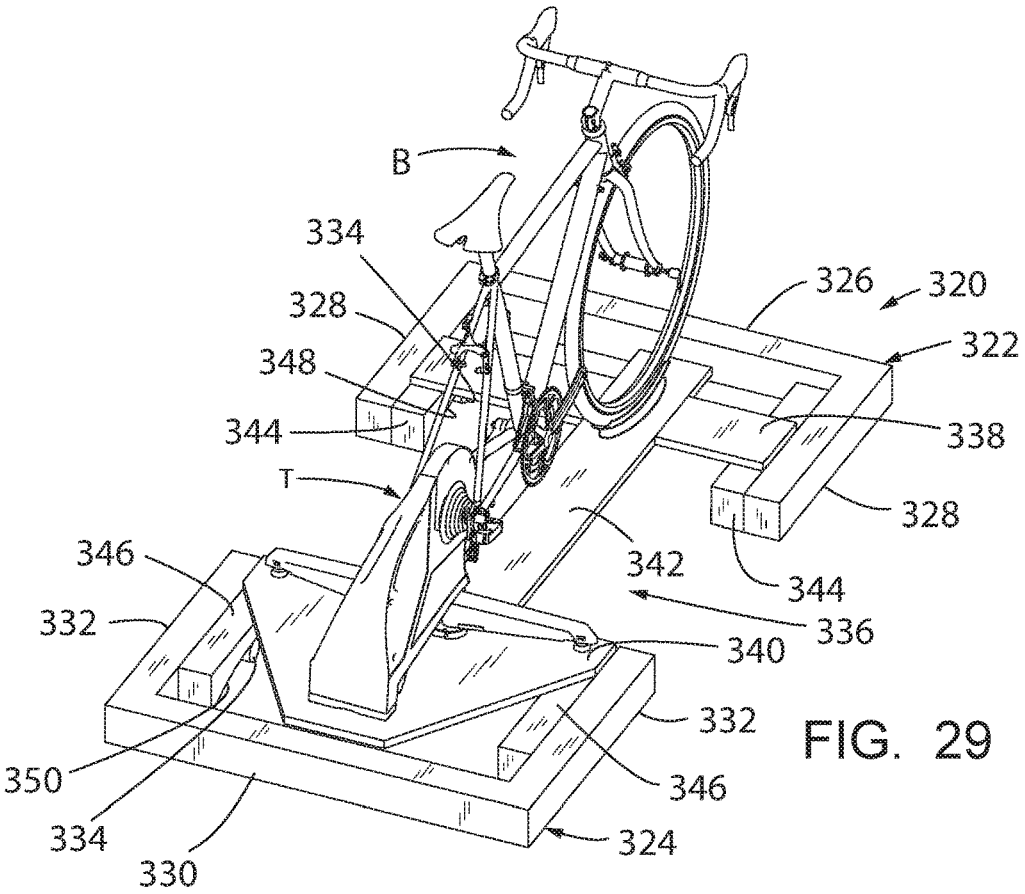
FIG. 29 is an isometric view of another embodiment of a movable exercise equipment support in accordance with the present invention.
Figure 30:
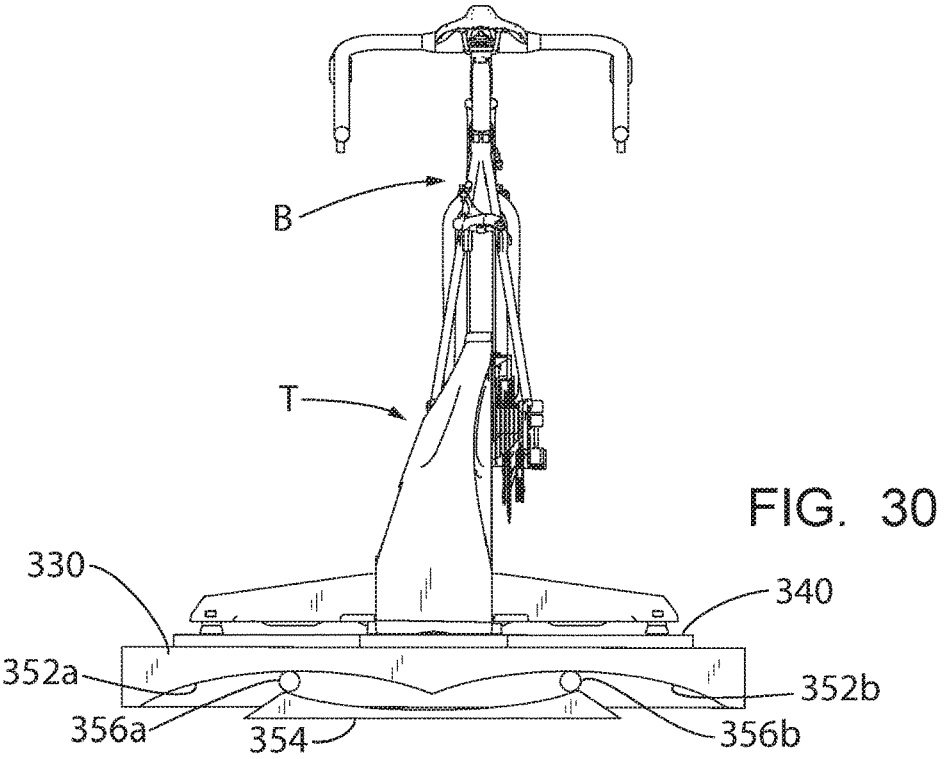
FIG. 30 is a rear elevation view of the movable exercise equipment support of FIG. 29.

Another embodiment of a movable exercise equipment support in accordance with the present invention is shown at 320 in FIGS. 29 and 30. In this embodiment, the movable exercise equipment support 320 has a two-part base consisting of a front base section 322 and a rear base section 324. The base sections 322, 324 are generally C-shaped and face each other. It can be appreciated, however, that the base section 322, 324 may be joined together to form a single-piece base. Front base section 322 includes a front cross-member 326 and a pair of rearwardly extending side members 328 that extend one from each end of front cross-member 326. Similarly, rear base section 324 includes a rear cross-member 330 and a pair of forwardly extending side members 332 that extend one from each end of rear cross-member 330. An inwardly extending roller, such as shown at 334, is provided on each of side members 328, 332.

In this embodiment, bicycle B and trainer T are secured to a frame assembly, shown generally at 336, which includes a front frame member 338, a rear frame member 340, and a central axial member 342. The front wheel of bicycle B is secured to central axial member 342 at front frame member 338, and trainer T is supported on rear frame member 340, which is in the form of a platform that underlies trainer T and to which trainer T is secured. The front frame member 338 is secured at its ends to a pair of front side support members 344, and the rear frame member 340 is secured at its ends to a pair of rear side support members 346. A downwardly facing arcuate engagement surface, shown at 348, is formed in the underside of each front side support member 344, and a similarly configured downwardly facing arcuate engagement surface 350 is formed in the underside of each rear side support member 346. The arcuate engagement surfaces 348, 350 rest on the rollers, such as 334, that are secured to base side members 328, 333. By gravity, the rollers 334 tend to remain in the uppermost central areas of the arcuate engagement surfaces 348, 350, to position the frame assembly 336 and thereby bicycle B and trainer T in a lowered, axially neutral position.

As shown in FIG. 30, the underside of rear cross-member 330 is provided with a pair of downwardly facing, transversely extending arcuate engagement surfaces 352*a*, 352*b*. A roller support 354 is positioned on a supporting surface such as a floor, and a pair of laterally spaced rollers 356*a*, 356*b* are rotatably mounted to roller support 354 in any suitable manner. The arcuate engagement surfaces 352*a*, 352*b* are positioned on the rollers 356*a*, 356*b*, respectively. By gravity, the rollers 356*a*, 356*b* tend to remain in the uppermost central areas of the arcuate engagement surfaces 352*a*, 352*b*, respectively, to position the frame assembly 336 and thereby bicycle B and trainer T in a centered, laterally neutral and upright position. A similar pair of downwardly facing, transversely extending arcuate engagement surfaces are provided on the underside of front cross-member 326, and a roller support similar to roller support 354, carrying laterally spaced rollers, is positioned on a supporting surface such as a floor, below the front pair of arcuate engagement surfaces.

In this version, exercise equipment support 320 moves in an axial, fore-aft direction and side-to-side during use of the bicycle B by a user, to provide an experience for the user that more closely resembles real-world conditions. The frame assembly 336 and the front and rear base section 322, 324 will move laterally on the rollers such as 356*a*, 356*b* when horizontal lateral or transverse forces are applied to frame assembly 336 during use of bicycle B and trainer T. Simultaneously, when horizontal axial forces are transferred to frame assembly 336, the frame assembly 336 will move forwardly or rearwardly in an axial or fore-aft direction by axial movement of the engagement surfaces 348, 350 on the rollers 334. The arcuate configuration of the engagement surfaces provides a gravity bias of frame assembly 336 toward both an axially neutral position and a laterally neutral position.

Figure 31:
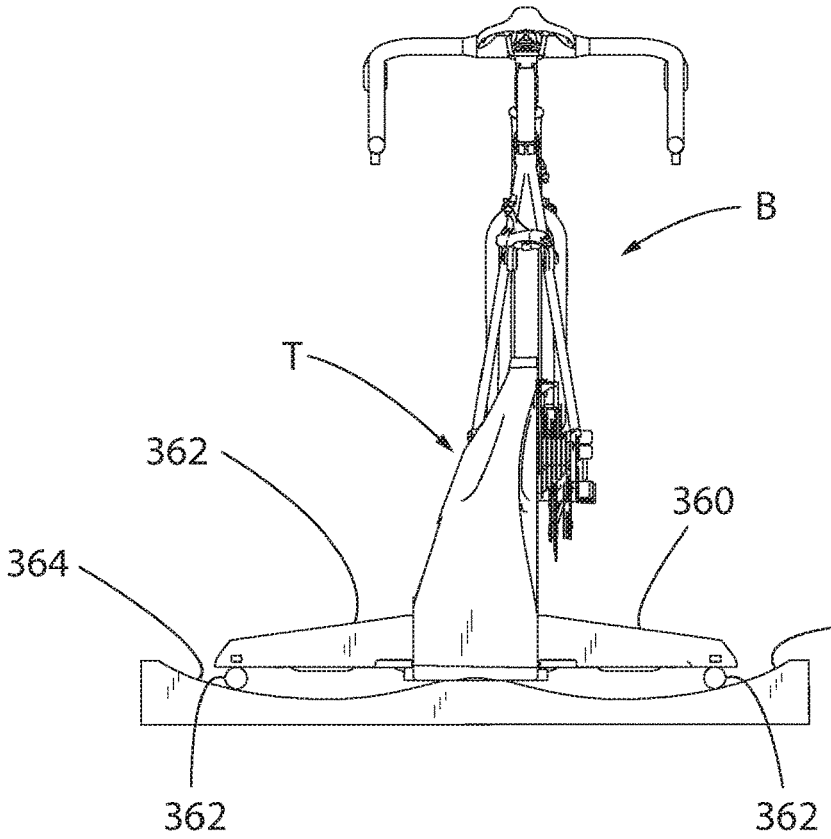
FIG. 31 is a view similar to FIG. 30, showing in alternative embodiment for providing movement of the exercise equipment about the tilt axis.
Figure 32:
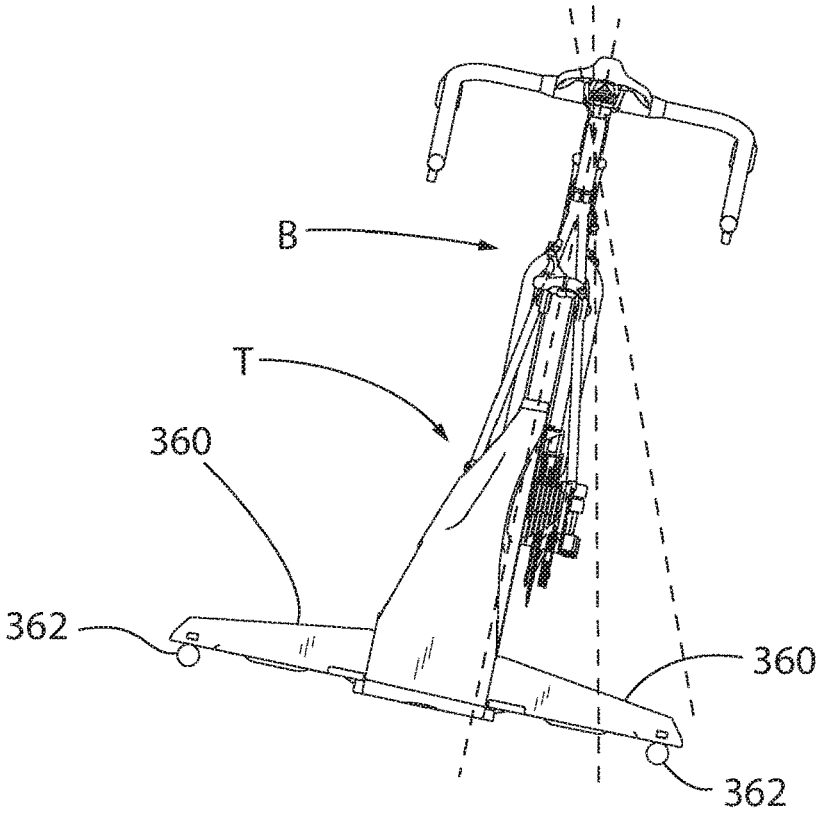
FIG. 32 is view similar to FIGS. 30 and 31, illustrating tilting movement of the exercise equipment in the embodiments of FIGS. 29-31.

FIGS. 31 and 32 illustrate a tip or tilt function that can be incorporated into a movable exercise equipment support in accordance with the present invention. Representatively, the tip or tilt function illustrated in FIGS. 31 and 32 can be utilized in combination with a base and frame that incorporates an axial or fore-aft movement function such as shown and described previously, e.g. in connection with the embodiment illustrated in FIGS. 29 and 30. As shown in FIGS. 31 and 32, the bicycle B may be engaged with a trainer T having laterally extending brace members or outriggers 360, with rollers 362 being secured toward the outer ends of brace members 360. A base or frame includes a pair of upwardly facing arcuate engagement surfaces 364, and the rollers 362 are supported by the engagement surfaces 364. In this version, the rollers 364 at an at-rest position as shown in FIG. 31 are positioned outwardly of the center area of the engagement surfaces 364. In this manner, while engagement surfaces provide a gravity bias of trainer T and bicycle B toward a lowered position, it is not the lowermost position that would be attained if the rollers 362 were normally to rest in the lowermost center areas of the engagement surfaces 364. A tip or tilt function is thus attained when a net downward force is applied to the bicycle B and trainer T on one side of the other of the axial centerline of the bicycle B and trainer T, as shown in FIG. 32. Here, it can be seen that the radii of engagement surfaces 364 can be such that the center of the axis of tipping or tilting movement of the bicycle B and trainer T can be placed at a relatively elevated position relative to the position of the user on bicycle B, e.g. above the user's center of gravity. In contrast to other trainers with side-to-side or tilting movement, this provides the user with a relatively stable and safe feel during side-to-side movement.

Figure 33:
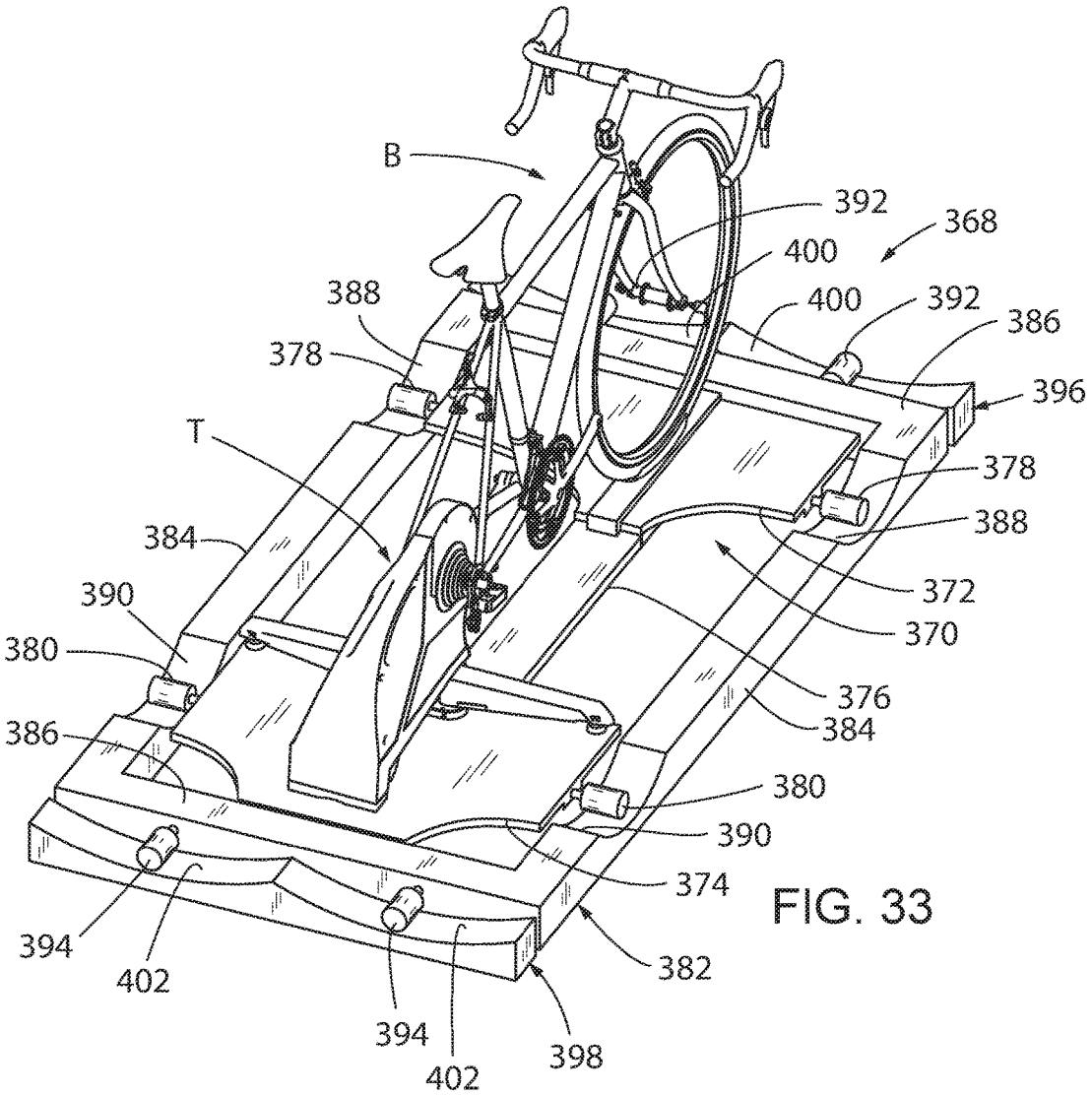
FIG. 33 is an isometric view of another embodiment of a movable exercise equipment support in accordance with the present invention.

FIG. 33 illustrates another embodiment of a movable exercise equipment support in accordance with the present invention, shown at 368. In this embodiment, the bicycle B and trainer T are secured to a platform assembly 370 that includes a front platform section 372, a rear platform section 374, and a central axial member 376 that extends between and is secured to the front platform section 372 and the rear platform section 374. A pair of front rollers 378 are mounted one to each side of front platform section 372, and a pair of rear rollers 380 are mounted one to each side of rear platform section 374.

The platform assembly 370 is supported on a generally rectangular frame 382 that includes a pair of side frame members 384 and a pair of end frame members 386. The side frame members 384 are each provided with a front, upwardly facing arcuate engagement surface 388 and a rear, upwardly facing arcuate engagement surface 390. The front rollers 378 of platform assembly 370 are positioned within and rest on the front, upwardly facing arcuate engagement surfaces 388, and the rear rollers 380 of platform assembly 370 are positioned within and rest on the rear, upwardly facing arcuate engagement surfaces 390.

The front end frame member 386 includes a pair of forwardly extending rollers 392, and the rear end frame member 386 includes a pair of rearwardly extending rollers 394. A front support member 396 is positioned adjacent to and forwardly of front end frame member 386, and similarly a rear support member 398 is positioned adjacent to and rearwardly of rear frame member 386. Front support member 396 includes a pair of arcuate, upwardly facing engagement surfaces 400, and rear support member 398 includes a pair of arcuate, upwardly facing engagement surfaces 402. The front rollers 392 are positioned within and rest on the front, upwardly facing arcuate engagement surfaces 400, and the rear rollers 394 are positioned within and rest on the rear, upwardly facing engagement surfaces 402.

As can be appreciated, the front engagement surfaces 388 and rear engagement surfaces 390 of side frame members 384 extend in an axial or front-rear direction, and front and rear rollers 392, 394, respectively, are rotatable about an axis of rotation primarily, but not necessarily, parallel thereto. The front engagement surfaces 400, 402 of front and rear support members 396, 398, respectively, extend in a transverse direction that may be perpendicular to the axial or front-rear direction, or alternatively may be radiused, and front and rear rollers 378, 380, respectively, are rotatable about an axis of rotation primarily, but not necessarily, parallel thereto. With this arrangement, movement of front and rear rollers 378, 380, respectively, within and along front and rear engagement surfaces 388, 390, respectively, allows bicycle B and trainer T to move in a fore-aft axial or longitudinal direction in response to axial forces experienced by platform assembly 370 during use of bicycle B. Simultaneously movement of front and rear rollers 392, 394, respectively, within and along front and rear engagement surfaces 400, 402, respectively, provides lateral or transverse movement of bicycle B and trainer T in response to transverse forces experienced by platform assembly 370 during use of bicycle B. The curvature of engagement surfaces 388 and 390 provides a gravity bias toward an axially neutral position, while likewise the curvature of engagement surfaces 400, 402 provides a gravity bias toward a laterally neutral position.

Figure 34:
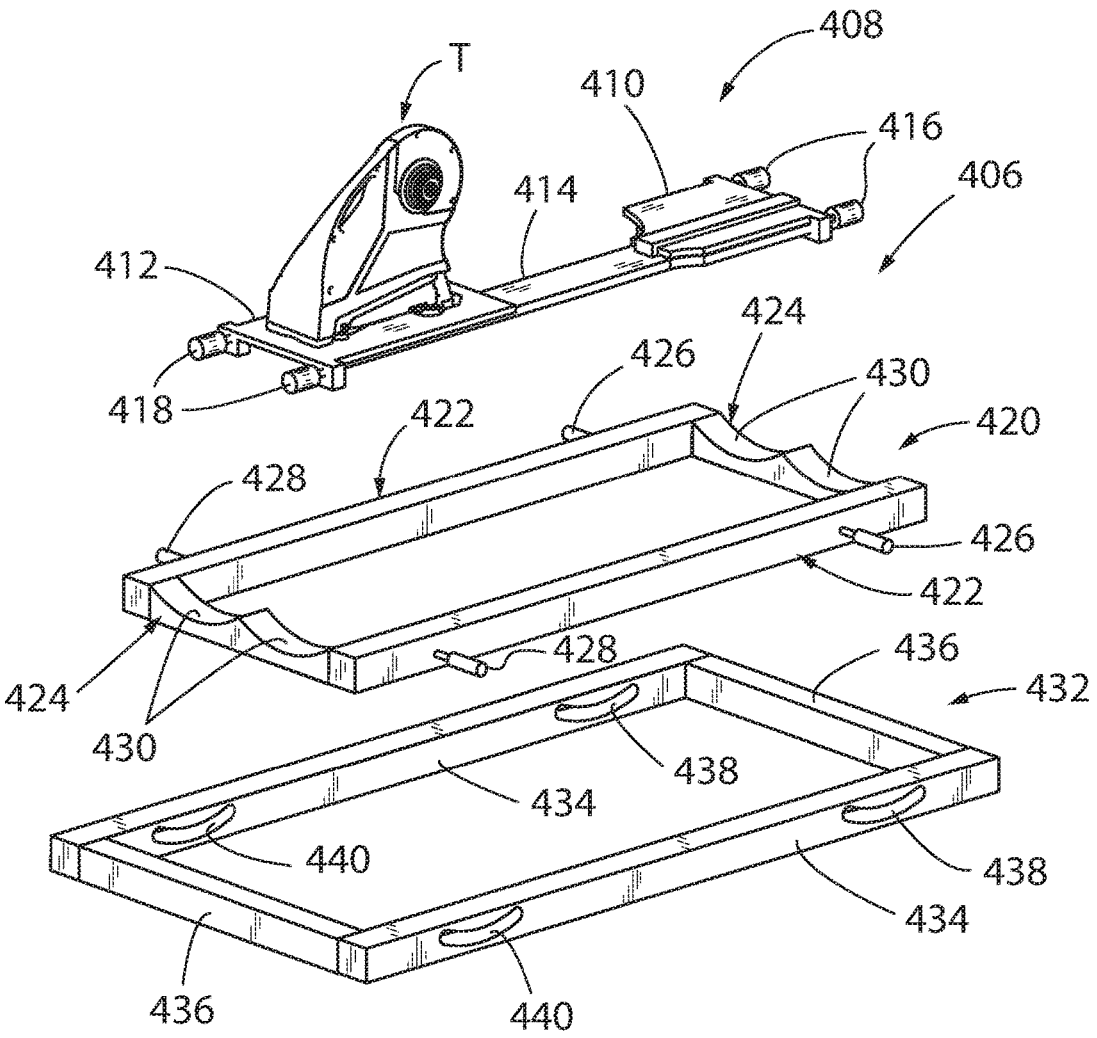
FIG. 34 is an exploded isometric view illustrating components of another embodiment of a movable exercise equipment support in accordance with the present invention.

FIG. 34 illustrates another embodiment of a movable exercise equipment support in accordance with the present invention, shown at 406. In this embodiment, the bicycle B (not shown) and trainer T are carried by a platform assembly 408 that includes a front platform section 410, a rear platform section 412 and an axial connector member 414 that extends between and is secured to front and rear platform sections 410, 412, respectively. A pair of front rollers 416 extend forwardly from front platform section 410, and a pair of rear rollers 418 extend rearwardly from rear platform section 412. The front and rear rollers 416, 418, respectively, are rotatable about axes of rotation that are parallel to a longitudinal axis of platform assembly 408.

Platform assembly 408 is positioned on a frame assembly 420, which includes a pair of side members 422 and a pair of end members 424. The frame side members 422 are provided with a pair of front rollers 426 and a pair of rear rollers 428. Each end frame member 424 includes a pair of upwardly facing arcuate engagement surfaces 430. The engagement surfaces 430 extend in a transverse direction relative to the axial or longitudinal axis of platform assembly 408. The rollers 426, 428 are rotatable about respective axes of rotation that also extend in a transverse direction relative to the axial or longitudinal axis of platform assembly 408.

The frame assembly 420 is engaged with and supported by a base assembly 432, which includes a pair of side members 434 and a pair of end members 436. The base side members 434 have arcuate front engagement slots 438 and arcuate rear engagement slots 440. The front and rear engagement slots 438, 440 extend in a direction that is parallel to the longitudinal axis of platform assembly 408.

The frame assembly 420 and base assembly 432 are generally rectangular in configuration, with frame assembly 420 having a footprint smaller than that of base assembly 432. In this manner, frame assembly 420 can be nested within the open interior of base assembly 432. When so positioned, the front rollers 426 of frame assembly 420 are positioned within and movable along the front slots 438 of base assembly 432, and likewise the rear rollers 428 of frame assembly 420 are positioned within and movable along the rear slots 440.

With this configuration, movement of front and rear rollers 416, 418, respectively, within and along front and rear engagement surfaces 430, respectively, allows bicycle B and trainer T to move in a transverse or lateral direction in response to transverse or lateral forces experienced by platform assembly 408 during use of bicycle B. Simultaneously, movement of front and rear rollers 426, 428, respectively, within and along front and rear slots 438, 440, respectively, provides fore-aft axial or longitudinal movement of bicycle B and trainer T in response to axial forces experienced by platform assembly 408 during use of bicycle B. The curvature of the engagement surfaces of slots 438, 440 provides a gravity bias toward an axially neutral position, while likewise the curvature of engagement surfaces 430 provides a gravity bias toward a laterally neutral position.

Figure 35:
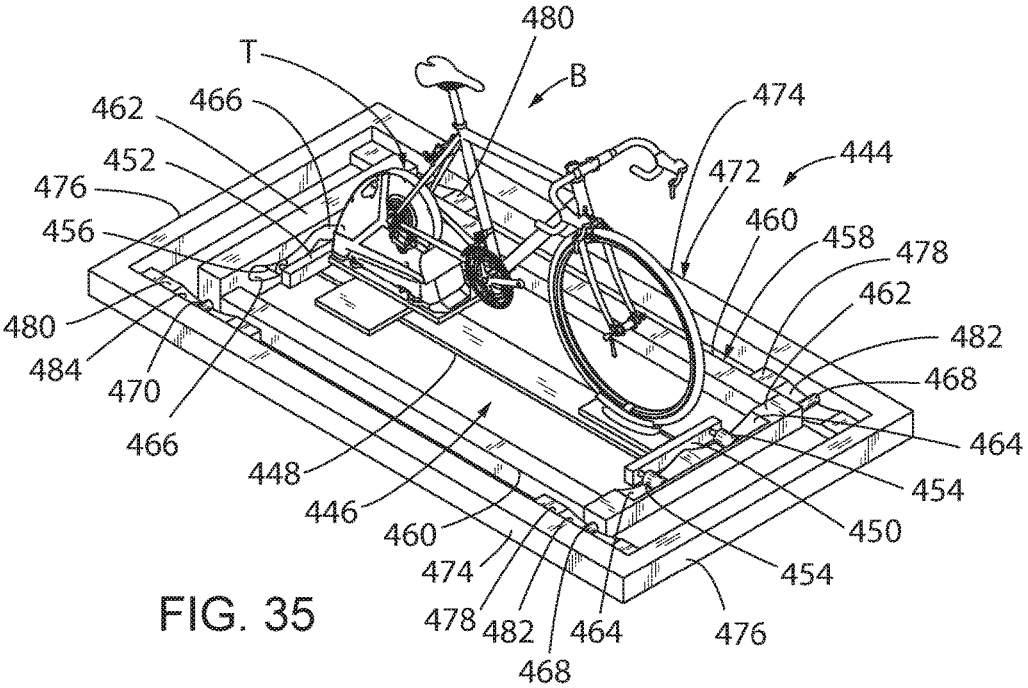
FIG. 35 is an isometric view of another embodiment of a movable exercise equipment support in accordance with the present invention.
Figure 36:
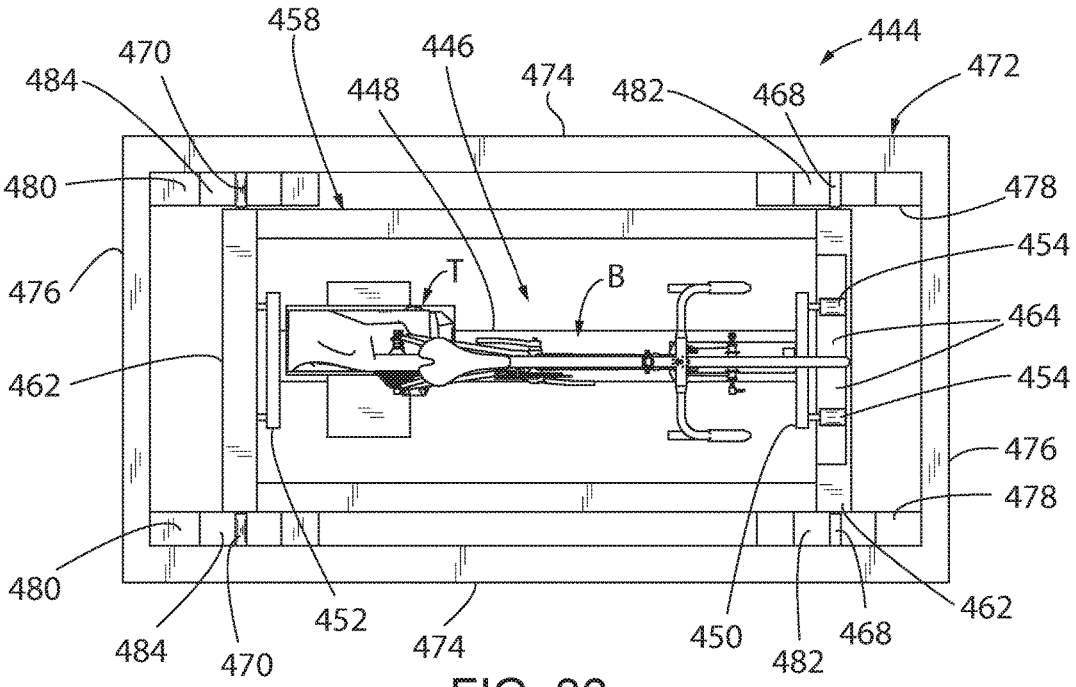
FIG. 36 is top plan view of the movable exercise equipment support of FIG. 35.

FIGS. 35 and 36 illustrate another embodiment of a movable exercise equipment support in accordance with the present invention, shown at 444. In this embodiment, the bicycle B and trainer T are secured to and supported on a platform assembly 446, which includes an axially extending central support or platform member 448. The front end of platform member 448 is secured to a front platform member 450, and the rear end of platform member 448 is secured to a rear platform member 452. A pair of front rollers 454 are secured to and extend forwardly from front platform member 450, and a pair of rear rollers 456 are secured to and extend rearwardly from rear platform member 452.

Platform assembly 446 is positioned on a frame assembly 458, which includes a pair of side members 460 and a pair of end members 462. The frame end members 462 are provided with laterally or transversely extending arcuate engagement surfaces, which in the case of the front end member 462 are in the form of arcuate upwardly facing engagement surfaces 464 and in the case of the rear end member 462 are in the form of arcuate slots 466. The front and rear rollers 454, 456 of platform assembly 446 are positioned in and supported by the front engagement surfaces 464, and the rear rollers 456 of platform assembly 446 are positioned in and supported by the slots 466. As in previously described embodiments, the engagement surfaces 464 and the slots 466 extend in a lateral or transverse direction relative to the longitudinal axis of bicycle B, and the rollers 454, 456 are rotatable about axes of rotation that are perpendicular thereto, i.e. parallel to the axial or longitudinal axis of bicycle B. The frame assembly 458 also includes a pair of outwardly extending front rollers 468, which may be secured one to each end of frame front end member 462, and a pair of outwardly extending rear rollers 470 which may be secured one to each end of frame rear end member 462.

The frame assembly 458 is positioned on and supported by a base assembly 472. Both the frame assembly 458 and the base assembly 472 have a generally rectangular configuration, with frame assembly 458 having a footprint slightly smaller than that of base assembly 472 so that it can be received within the interior of base assembly 472. Base assembly 468 includes a pair of side members 474 and a pair of end members 476, as well as a pair of front support members 478 and a pair of rear support members 480. Each front support member 478 includes an upwardly facing arcuate engagement surface 482, and each rear support member 480 includes an upwardly facing arcuate engagement surface 484. When frame assembly 458 is positioned within the interior of base assembly 472, the front rollers 468 are positioned within and supported by the upwardly facing arcuate front engagement surfaces 482, and likewise the rear rollers 470 are positioned within and supported by the upwardly facing arcuate rear engagement surfaces 484. As in the previously described embodiments, the engagement surfaces 482, 484 extend in an axial or longitudinal direction that is parallel to the longitudinal axis of bicycle B, and likewise the rollers 468, 470 are rotatable about axes of rotation perpendicular thereto, i.e. transverse to the longitudinal axis of bicycle B.

With this configuration, movement of front and rear rollers 454 within and along the front engagement surfaces 464 and movement of the rear rollers 456 within and along the rear slots 466 allows bicycle B and trainer T to move in a transverse or lateral direction in response to transverse or lateral forces experienced by platform assembly 446 during use of bicycle B. Simultaneously movement of front and rear rollers 468, 470 respectively, within and along front and rear engagement surfaces 482, 484 respectively, provides fore-aft axial or longitudinal movement of bicycle B and trainer T in response to axial forces experienced by platform assembly 446 during use of bicycle B. The curvature of engagement surfaces 482, 484 provides a gravity bias toward an axially neutral position, while likewise the curvature of engagement surfaces 464 and slots 466 provides a gravity bias toward a laterally neutral position.

Figure 37:
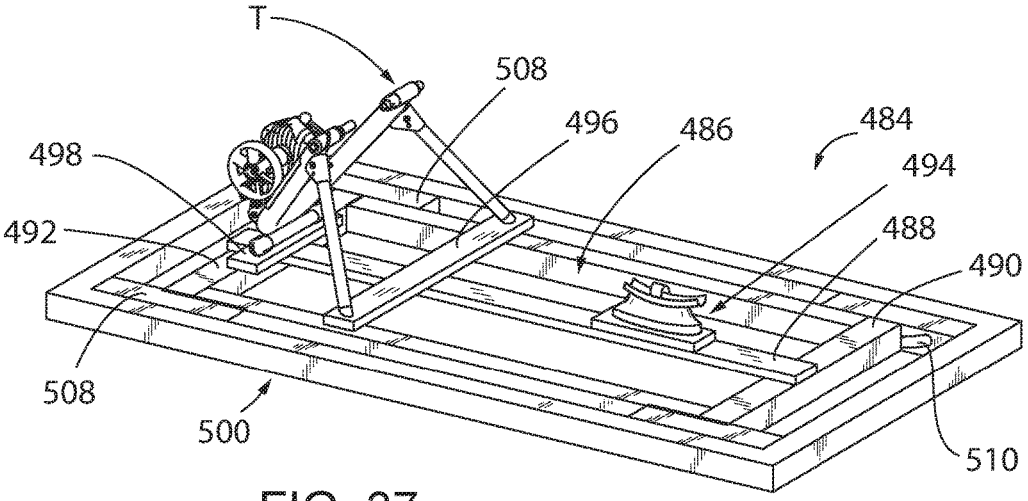
FIG. 37 is an isometric view of another embodiment of a movable exercise equipment support in accordance with the present invention.
Figure 38:
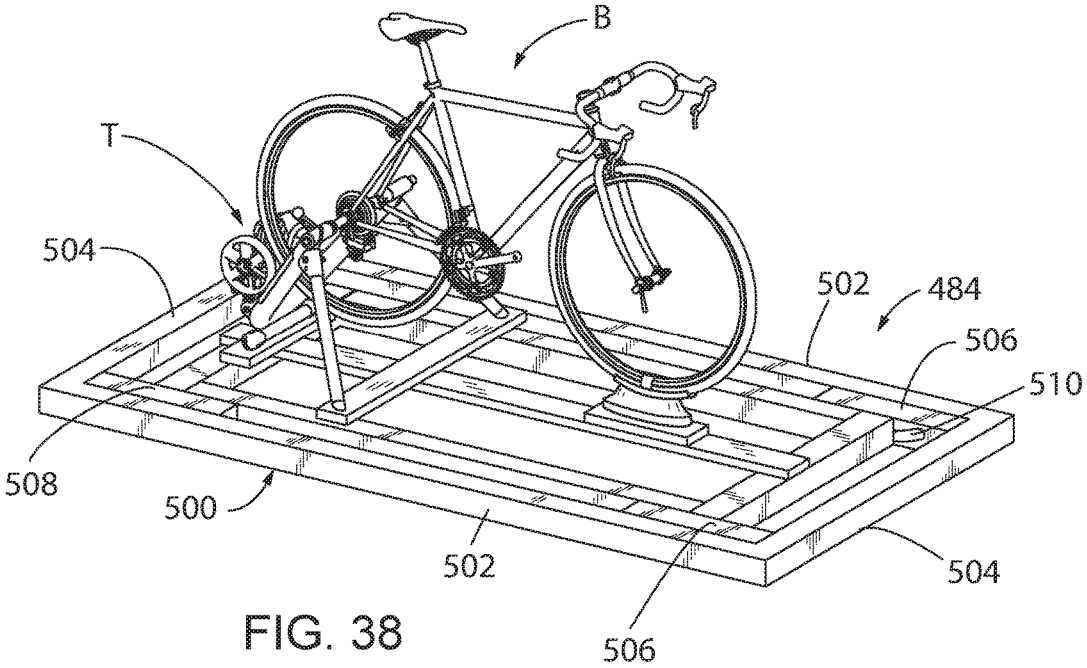
FIG. 38 is a view similar to FIG. 37, showing a bicycle and trainer secured to the movable exercise equipment support.

FIGS. 37 and 38 illustrate another embodiment of a movable exercise equipment support in accordance with the present invention, shown at 484. In this embodiment, the bicycle B and trainer T are secured to and supported on a carrier assembly 486, which includes an axially extending central support or carrier member 488. The front end of carrier member 488 is secured to a front cross member 490, and the rear end of carrier member 488 is secured to a rear cross member 492. The front wheel of the bicycle B may be secured to central carrier member 488 via a wheel support 494. Trainer T may be secured to the rear area of central carrier member 488 via a pair of transversely extending trainer mounting members 496, 498. Each end of front cross member 490 and rear cross member 492 has a roller (similar to rollers 468, 470 in the previously-described embodiment), extending outwardly therefrom.

The carrier assembly 486 is mounted to a base assembly 500, which may include a pair of side members 502 and a pair of end members 504. Base assembly 500 further includes a pair of front support members 506 and a pair of rear support members 508. Each of the front and rear support members is provided with an arcuate engagement slot, such as shown at 510, within which the outwardly extending rollers that are secured to the ends of front cross member 490 and rear cross member 492 are received. The slots 510 extend in a direction parallel to the longitudinal axis of the bicycle B, and the rollers at the ends of front and rear cross members 490, 492 are rotatable about axes of rotation that are perpendicular thereto.

With this configuration, movement of the rollers within and along the slots 510 provides fore-aft axial or longitudinal movement of bicycle B and trainer T in response to axial forces experienced by carrier assembly 486 during use of bicycle B. The curvature of the slots 510 provides a gravity bias toward an axially neutral position. In this embodiment, a tilting or tipping arrangement is interposed between the ends of central carrier member 488 and the front and rear cross members 490, 492, respectively. Representatively, the tilting or tipping arrangement may have a form similar to that described previously with respect to FIGS. 25-28, although it is understood that any other satisfactory arrangement may be employed.

Figure 39:
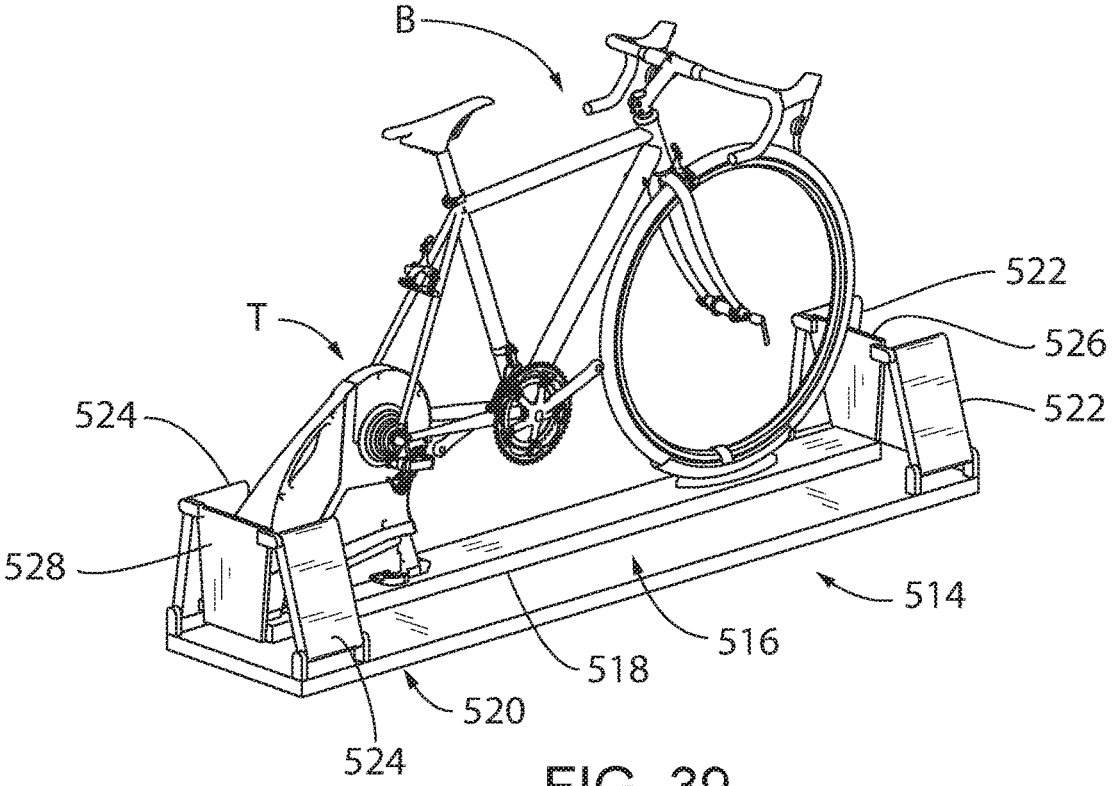
FIG. 39 is an isometric view of another embodiment of a movable exercise equipment support in accordance with the present invention.

FIG. 39 illustrates another embodiment of a movable exercise equipment support in accordance with the present invention, shown at 514. In this embodiment, the bicycle B and trainer T are secured to and supported on a carrier assembly 516, which includes an axially extending central support or carrier member 518. A compound linkage system is employed to movably mount carrier assembly 516 to a base, shown at 520. The linkage system includes a pair of front link members 522 and a pair of rear link members 524. The front and rear link members 522, 524, respectively, extend upwardly from the upper surface of base 520, and are pivotably mounted to base 520. The pivot connection between the lower ends of link members 522, 524 to base 520 enables link members 522, 524 to move in a transverse or lateral direction about pivot axes that are parallel to the longitudinal axis of the bicycle B. A front suspension link member 526 is secured to and extends upwardly from the front end of central carrier member 518, and similarly a rear suspension link member 528 is secured to and extends upwardly from the rear end of central carrier member 518. The upper end of front suspension link member 526 is pivotably mounted to and extends between front link members 522. Likewise, the upper end of rear suspension link member 528 is pivotably mounted to and extends between rear link members 524. The pivot connections of the upper ends of suspension link members 526, 528 provide pivoting movement of front and rear suspension link members 526, 528 in a front-rear or axial direction, about pivot axes that are perpendicular to the longitudinal axis of bicycle B. With this configuration, axial forces experienced by carrier assembly 516 during use of bicycle B and trainer T cause carrier assembly 516 to swing forwardly and rearwardly in a fore-aft direction. Simultaneously, transverse or lateral forces experienced by carrier assembly 516 during use of bicycle B and trainer T cause carrier assembly 516 to move laterally or transversely due to lateral or transverse pivoting movement of link members 522, 524 relative to base 520.

Figure 40:
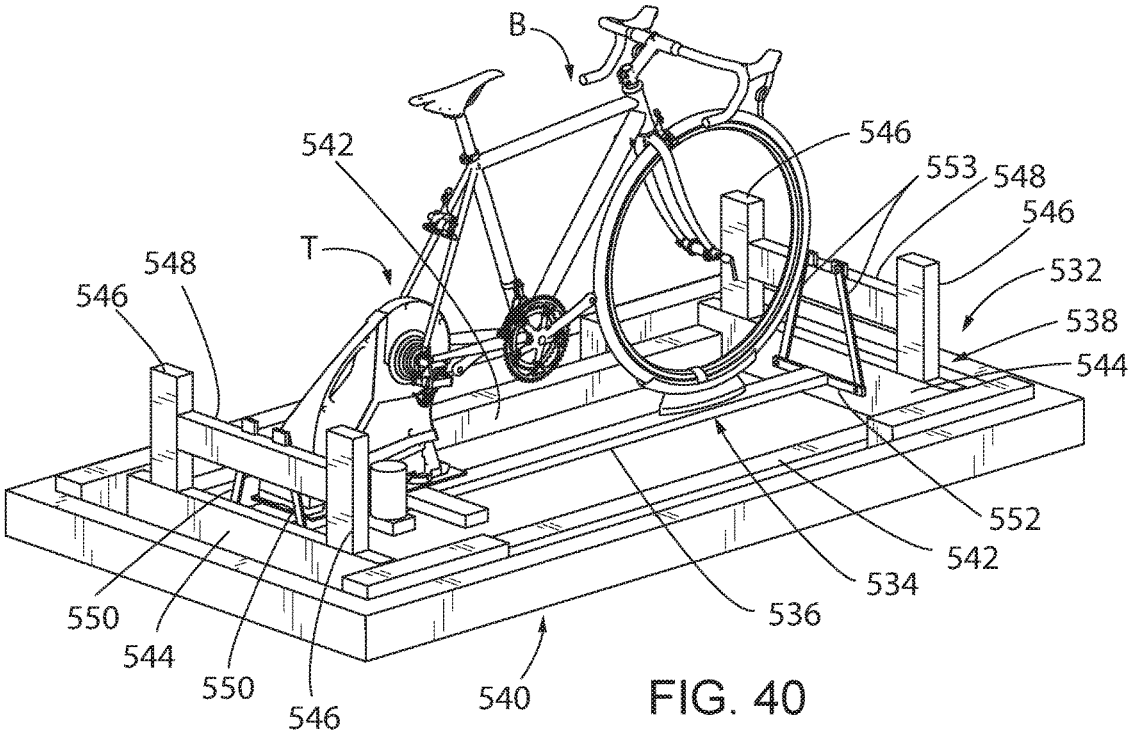
FIG. 40 is an isometric view of another embodiment of a movable exercise equipment support in accordance with the present invention.

FIG. 40 illustrates another embodiment of a movable exercise equipment support in accordance with the present invention, shown at 532. In this embodiment, the bicycle B and trainer T are secured to and supported on a carrier assembly 534, which includes an axially extending central support or carrier member 536. The carrier assembly 534 is supported by a frame assembly 538, which in turn is engaged with a base assembly 540.

The frame assembly 538 may have a generally rectangular configuration, including a pair of side frame members 542 and a pair of end frame members 544. A pair of spaced apart upright members 546 are secured to and extend upwardly from each end frame member 544. A cross member 548 extends between and is secured to each pair of upright members 546.

A pair of suspension links 550 are pivotably mounted at their upper ends to each cross member 548. At their lower ends, each suspension link 550 is pivotably connected to a transverse link mounting bar, such as 552, secured to each end of central carrier member 536. The pivot connections of suspension links 550 allow links 552 move laterally or transversely about pivot axes that are parallel to the longitudinal axis of bicycle B.

A movable mounting arrangement is interposed between the frame assembly 538 and the base assembly 540. The movable mounting arrangement between frame assembly 538 and base assembly 548 may have any configuration as desired, such as those described previously with respect to FIGS. 34-39, to allow frame assembly 538 to move in a fore-aft or axial direction parallel to the longitudinal axis of bicycle B.

With this configuration, the lateral or transverse forces experienced by carrier assembly 534 during use of bicycle B cause carrier assembly 534 to swing transversely or laterally via the pivot connections of suspension links 550. Simultaneously, the axially movable mounting arrangement between frame assembly 538 and base assembly 540 allows carrier assembly 534 and thereby bicycle B and trainer T to move in a fore-aft or axial direction when carrier assembly 534 experiences axial or longitudinal forces during operation of bicycle B.

Figure 41:
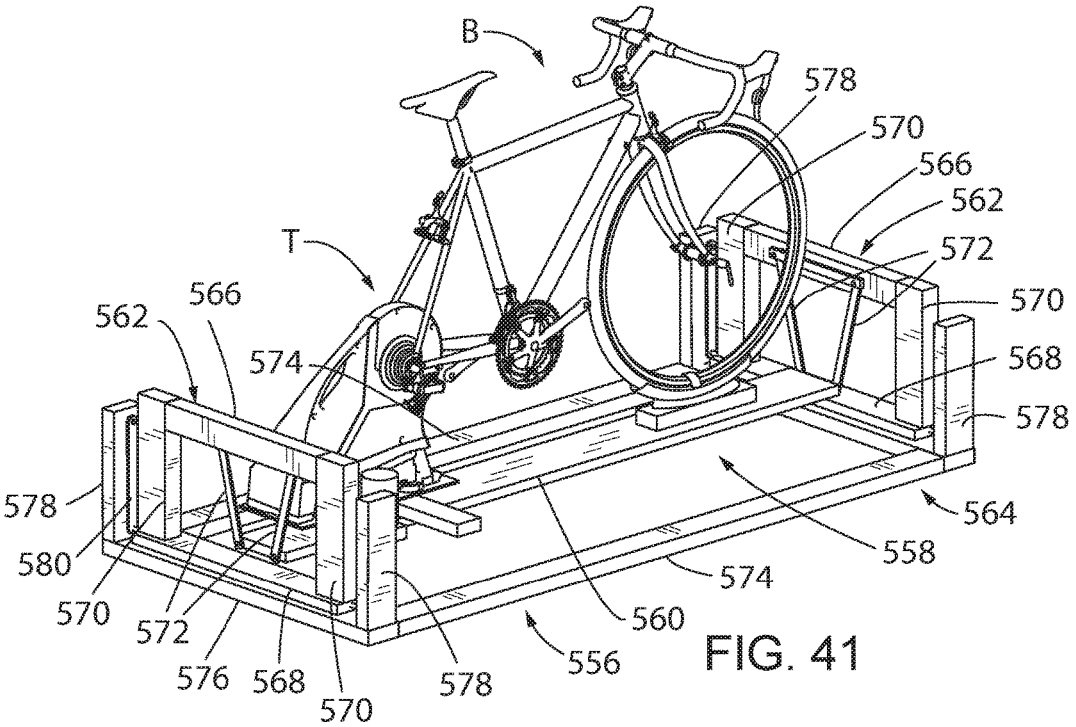
FIG. 41 is an isometric view of another embodiment of a movable exercise equipment support in accordance with the present invention.
Figure 42:
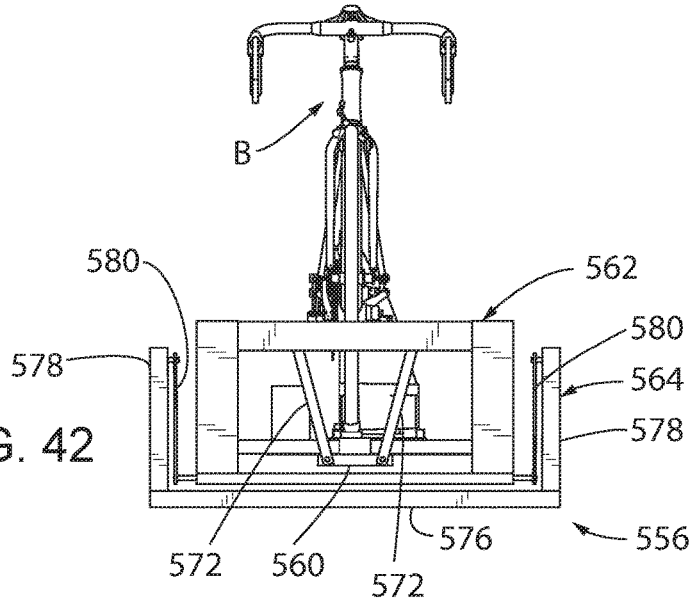
FIG. 42 is a front elevation view of the movable exercise equipment support of FIG. 41.
Figure 43:
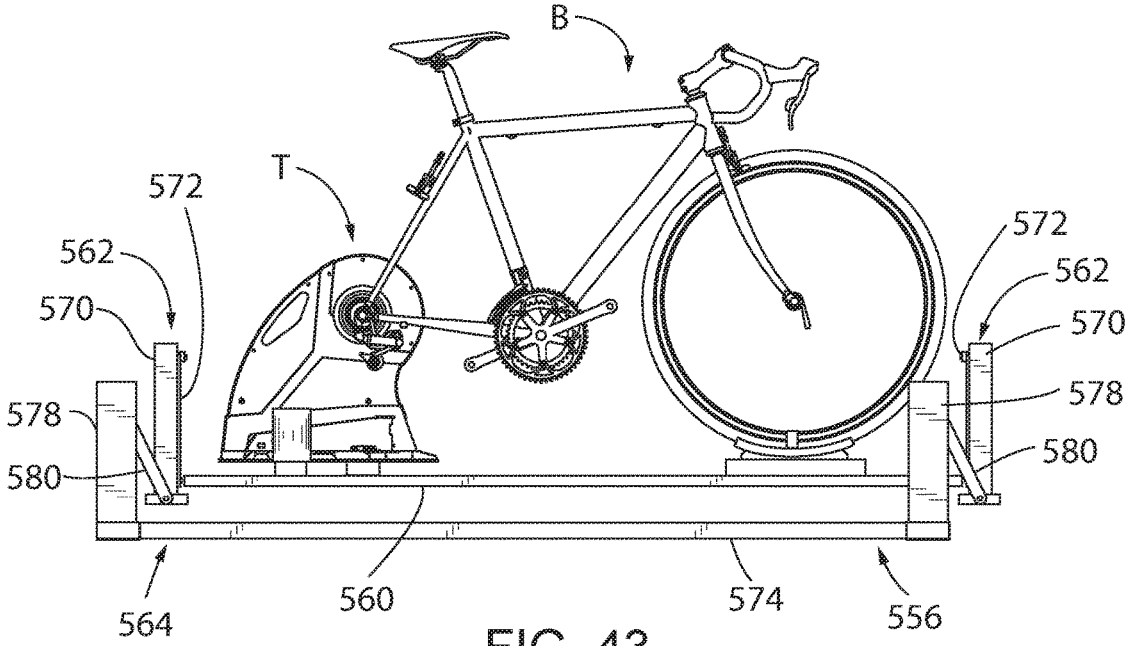
FIG. 43 is a side elevation view of the movable exercise equipment support of FIGS. 41 and 42.

FIGS. 41-43 illustrate another embodiment of a movable exercise equipment support in accordance with the present invention, shown at 556. In this embodiment, the bicycle B and trainer T are secured to and supported on a carrier assembly 558, which includes an axially extending central support or carrier member 560. The carrier assembly 558 is supported by a pair of end frame assemblies 562, which in turn are engaged with a base assembly 564.

Each frame assembly 562 has a generally rectangular configuration, including a top member 566, a bottom number 568, and a pair of side members 570. A pair of suspension links 572 are pivotably mounted at their upper ends to each top frame member 566. At their lower ends, each suspension link 572 is pivotably connected to one of the ends of central carrier member 560. The pivot connections of suspension links 572 allow links 572 to move laterally or transversely about pivot axes that are parallel to the longitudinal axis of bicycle B.

The base 564 also has a generally rectangular configuration, including a pair of base side members 574 and a pair of base end members 576. An upright member 578 extends from each corner of base 564. A series of suspension links 580 are pivotably mounted between frame assemblies 562 and upright members 578. Each suspension link 580 is pivotably mounted at its upper and to one of upright members 578 and is pivotably mounted at its lower end it to one of the ends of frame assembly bottom member 568. The pivot connections of suspension links 580 allow links 580 to move about pivot axes that are transverse to the longitudinal axis of bicycle B.

With this configuration, the lateral or transverse forces experienced by carrier assembly 558 during use of bicycle B cause carrier assembly 558 to swing transversely or laterally via the pivot connections of suspension links 572. Simultaneously, the axial or longitudinal forces experienced by carrier assembly 558 during use of bicycle B cause carrier assembly 558 to swing in a fore-aft or axial direction via the pivot connections of suspension links 580.

Figure 44:
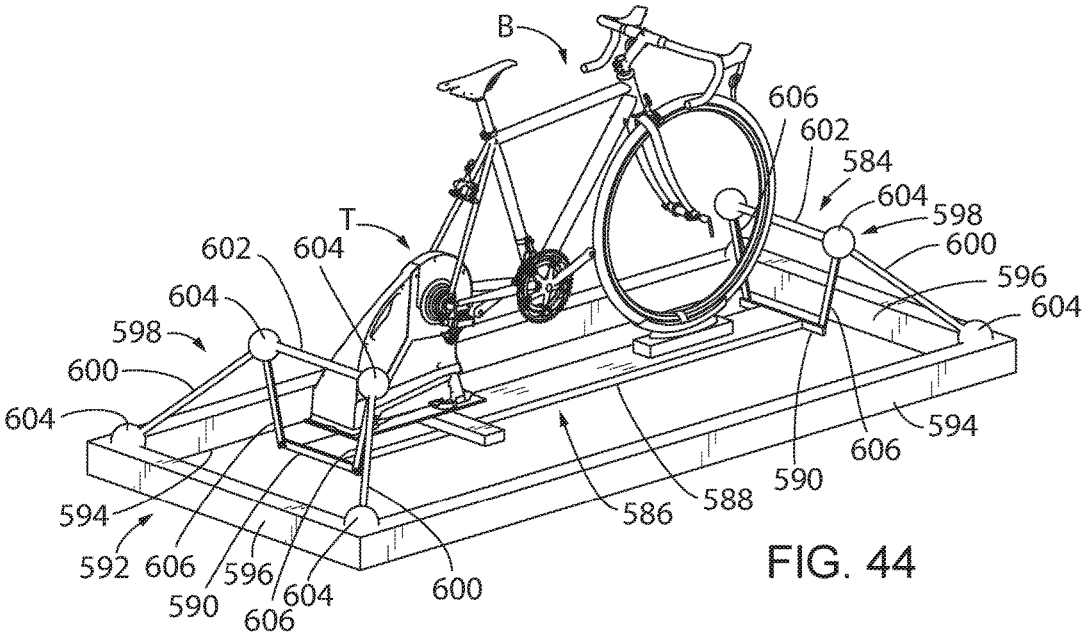
FIG. 44 is an isometric view of another embodiment of a movable exercise equipment support in accordance with the present invention
Figure 45:
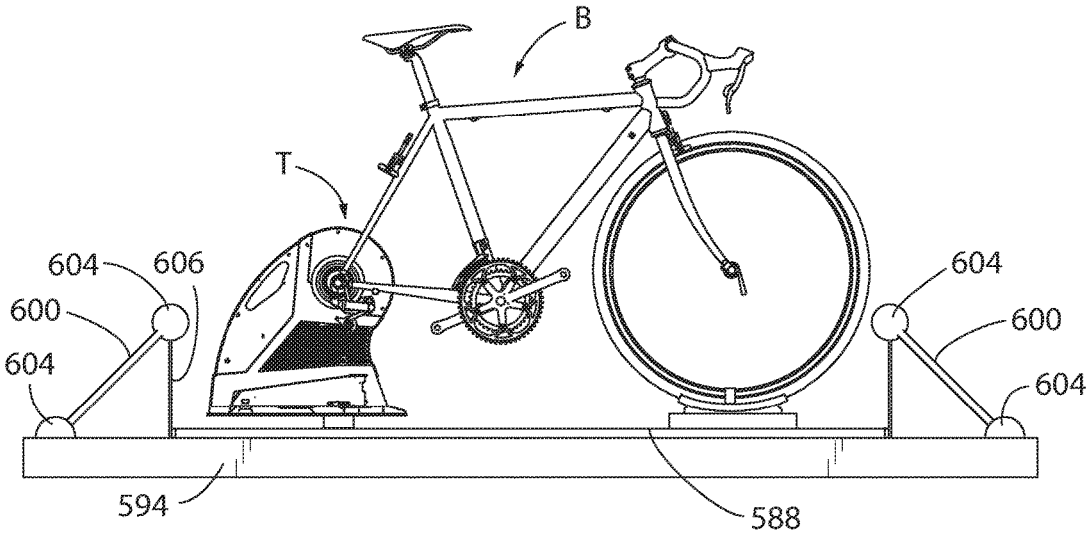
FIG. 45 is side elevation view of the movable exercise equipment support of FIG. 44.
Figure 46:
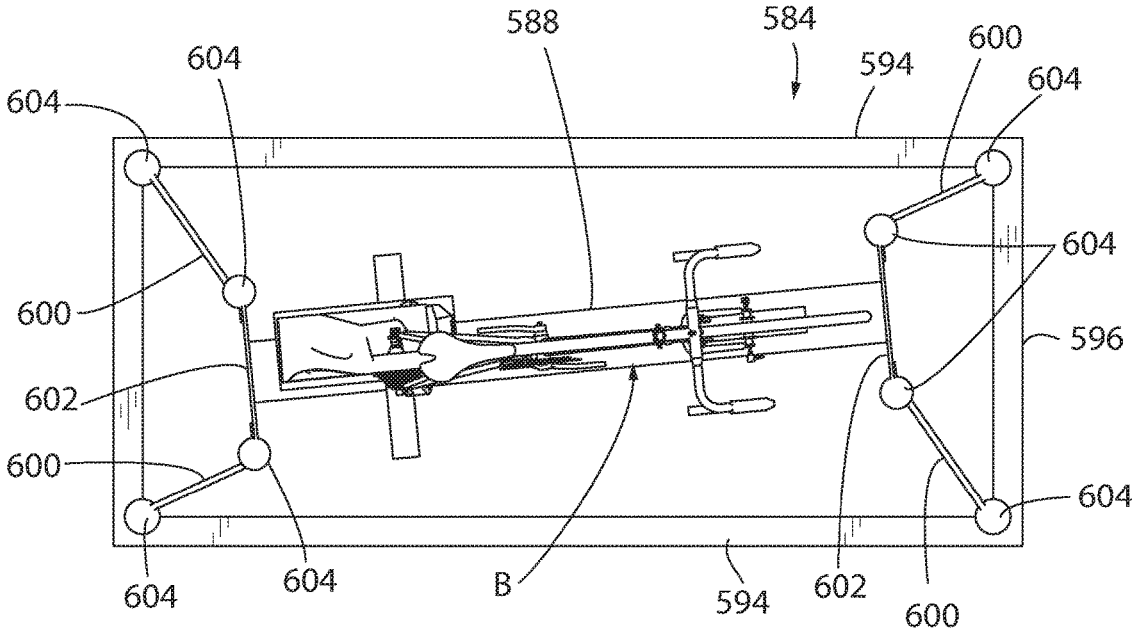
FIG. 46 is a top plan view of the movable exercise equipment support of FIGS. 44 and 45.

FIGS. 44-46 illustrate another embodiment of a movable exercise equipment support in accordance with the present invention, shown at 584. In this embodiment, the bicycle B and trainer T are secured to and supported on a carrier assembly 586, which includes an axially extending central support or carrier member 588. Transverse link mounting members 590 are secured one to each end of central carrier member 588.

Movable exercise equipment support 584 also includes a base assembly 592, which in the illustrated embodiment is generally rectangular in configuration and includes a pair of base side members 594 and a pair of base and members 596. In this embodiment, the carrier assembly 586 is positioned above base assembly 592 and is suspended therefrom via a linkage arrangement, which includes front and rear linkages, shown at 598. Each linkage 598 includes a pair of side link members 600 and a transverse central link member 602. The side link members 600 are pivotably mounted by universal pivot joints 604 to base assembly 592, e.g. at the corners of base assembly 592 defined by base side members 594 and base end members 596. Similarly, a universal pivot joint 604 is connected between the upper end of each side link member 600 and the adjacent end of each central link member 602. The carrier assembly 586 is suspended below the central link members 602 via suspension links 606, each of which is connected at its upper end to one of universal pivot joints 604 and at its lower and to one of transverse link mounting members 590.

With this configuration, the lateral or transverse forces experienced by carrier assembly 586 during use of bicycle B cause carrier assembly 586 to swing transversely or laterally via the pivot connections of suspension links 606 to universal pivot joints 604. Simultaneously, the axial or longitudinal forces experienced by carrier assembly 586 during use of bicycle B cause carrier assembly 586 to swing in a fore-aft or axial direction by the pivot connections of universal pivot joints 604 to base assembly 592. In addition, as shown in FIG. 46, any differential in the lateral forces experienced by the carrier assembly 586 can enable carrier member 588 to twist about an upright or vertical axis.

Figure 47:
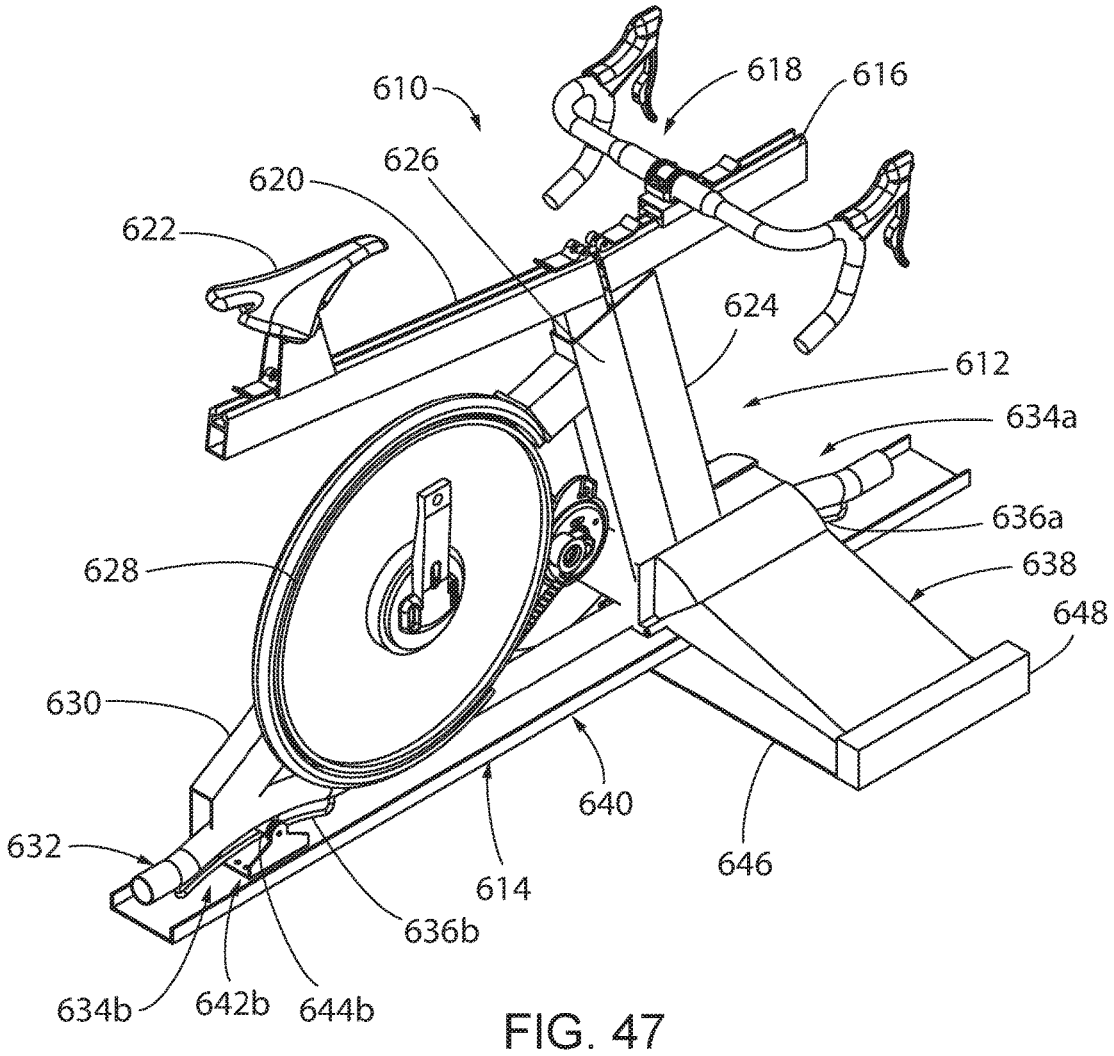
FIG. 47 is an isometric view of an item of exercise equipment, in the form of a stationary cycle, which incorporates a movable support in accordance with the present invention.
Figure 48:
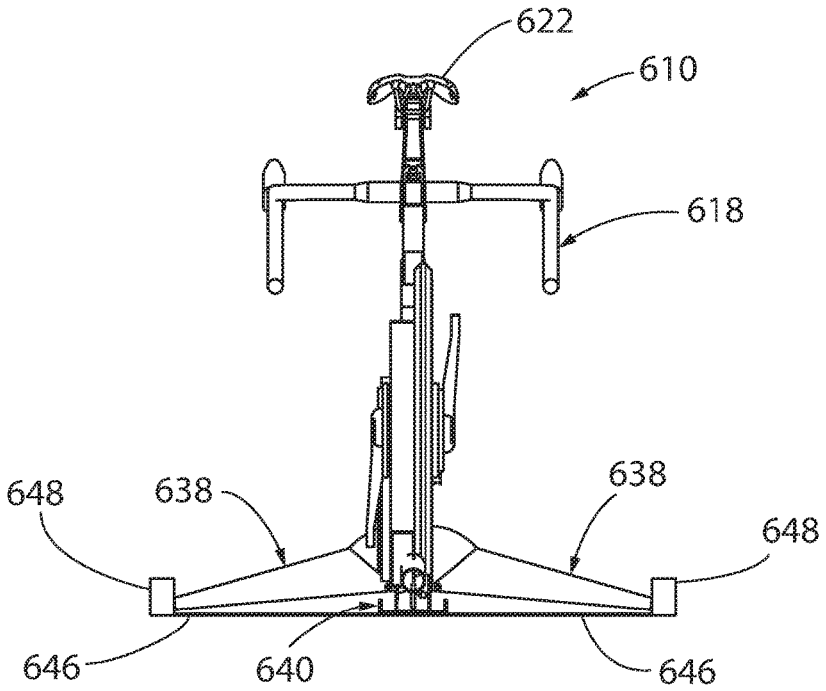
FIG. 48 is a rear elevation view of the item of exercise equipment of FIG. 47.
Figure 49:
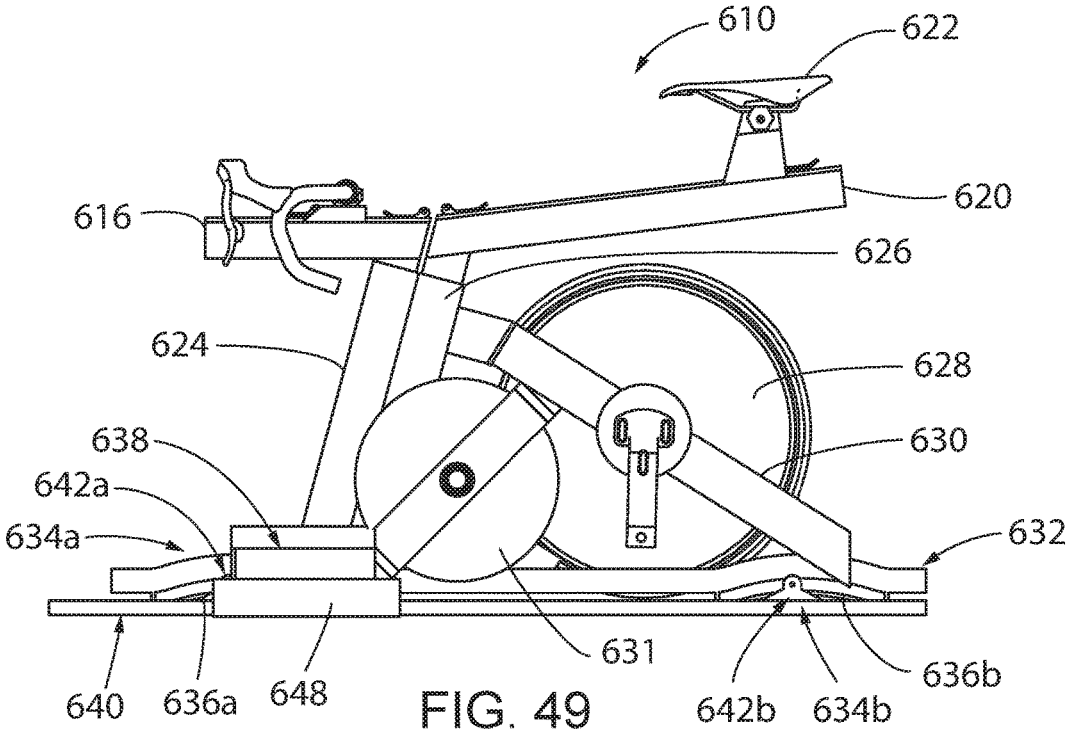
FIG. 49 is side elevation view of the item of exercise equipment of FIGS. 47 and 48.

FIGS. 47-49 illustrate an embodiment of the present invention in which a movable support can be incorporated directly into the frame or support structure of an item of exercise equipment. In this embodiment, the item of exercise equipment is in the form of an exercise cycle, shown generally at 610, although it is understood that the item of exercise equipment may be any other type of exercise equipment as desired. The exercise cycle 610 generally includes a frame assembly 612 and a base assembly 614. The frame assembly 612 may include a front upper frame member 616 to which a handlebar assembly 618 is adjustably mounted, and a rear upper frame member 622 which a saddle or seat 622 is adjustably mounted. The front upper frame member 616 may be vertically movable via a post that is telescopingly positioned within a front support tube 624, and likewise the rear upper frame member 620 may be vertically movable via a post that is telescopingly positioned within a rear support tube 626. The exercise cycle may also include a drive gear 628, which is rotatably supported on a rear support member 630. The drive gear 628 is rotatable in response to user input forces applied to a set of pedals, in a manner as is known. The exercise cycle 610 may also include a rotatable flywheel 631 that is driven by the drive gear 628, in a manner as is known.

The lower ends of front support tube 624, rear support tube 626 and rear support member 630 are mounted to and extend upwardly from an axially extending bottom frame member 632, which forms a part of frame assembly 612. The bottom frame member 632 extends along the longitudinal axis of exercise cycle 610 and supports the frame assembly 612 above base assembly 614. In the illustrated embodiment, the bottom frame member 632 is in the form of an axially extending tubular member, although it is understood that any other satisfactory structural member may be employed. The bottom frame member 632 has a length that exceeds the components of frame assembly 612 thereabove, and includes front and rear engagement areas, shown at 634*a*, 634*b*, respectively, at which bottom frame member 632 is engaged with and supported above base assembly 614. In the illustrated embodiment, the front engagement area 634*a* is located forwardly of the forwardmost position at which the handlebar assembly 618 can be positioned, and the rear engagement area 634*b* is located rearwardly of the rearwardmost location at which the saddle 622 can be positioned.

An arcuate beaded track member 636*a* is secured to the underside of bottom frame member 632 at front engagement area 634*a*. Similarly, an arcuate beaded track member 636*b* is secured to the underside of bottom frame member 632 at the rear engagement area 634*b*. The arcuate beaded track members 636*a*, 636*b* are constructed and configured similarly to the tracks 240, 242 described previously with respect to the embodiment of the present invention illustrated in FIGS. 19-24. Representatively, the portions of bottom frame member 632 to which the arcuate beaded track members 636*a*, 636*b* are mounted may be provided with an arcuate curvature having a radius that matches that of tracks 636*a*, 636*b*, although bottom frame member 632 may be formed without such curved portions or other such structure.

A pair of outriggers or stabilizers 638 are secured to frame assembly 612. The stabilizers 638 extend outwardly in opposite directions from frame assembly 612 and may be secured to frame assembly 612 in any satisfactory manner.

Base assembly 614 includes an axially extending central base member 640, which is adapted to be placed on a supporting surface such as a floor. The central base member 640 underlies bottom frame member 632 of frame assembly 612. A front bracket 642*a* is mounted to the forward end of central base member 640 and a rear bracket 642*b* is mounted to the rearward end of central base member 640. A grooved roller is rotatably mounted to each of front and rear brackets 642*a*, 642*b*, respectively. The grooved roller mounted to rear bracket 642*b* is shown in FIG. 47 at 644*b*, and a similarly configured grooved roller is rotatably mounted to front bracket 642*a*. The grooved rollers such as 644*b* are configured similarly to the grooved rollers shown and described previously with respect to the embodiments of the present invention as shown in FIGS. 1-24 and are configured to receive the central bead areas of the track members 636*a*, 636*b* that are secured to the underside of bottom frame member 632.

With this configuration, as described previously, the track members 636*a*, 636*b* and the grooved rollers such as 644*b* allow both axial or fore-aft movement of bottom frame member 632 relative to base member 640 and pivoting movement of bottom frame member 632 on the central beaded areas of the track members 634*a*, 634*b* within the grooves of the rollers such as 644*b*. In this manner, longitudinal or axial forces experienced by bottom frame member 632 during use of the exercise cycle 610 cause forward or rearward translation of bottom frame member 632 relative to base assembly 614 by movement of track members 634*a*, 634*b* within the grooved rollers, such as 644*b* and thereby axial or fore-aft movement of frame assembly 612. The arcuate configuration of track members 634*a*, 634*b* provides a gravity bias of frame assembly 612 toward an axially neutral position, as also described previously.

Each stabilizer 638 overlies a plate 646, and plates 646 are secured to and extend outwardly from central base member 640 in opposite directions. The outer end of each stabilizer 638 is positioned within a channel defined by a stabilizer guide 648, and each stabilizer guide 648 is secured to the outer end of one of plates 646. The channel defined by the stabilizer guide 648 has a length greater than that of stabilizer 638, so that stabilizer 638 can move back and forth within the channel of stabilizer guide 648 during fore-aft movement of stabilizers 638. A tilt biasing arrangement is interposed between each stabilizer 638 and its underlying plate 646. Representatively, the tilt biasing arrangement may have a configuration as described previously with respect to tilt biasing bracket assemblies 134*a*, 134*b* as shown and described with respect to FIGS. 1-18 or tilt biasing bracket assemblies 252 as shown and described with respect to FIGS. 19-24. As also described previously, the tilt biasing arrangement acts on the stabilizers 638 to bias the frame assembly 612 of exercise cycle 610 toward a neutral, upright tilt position. While a pair of outriggers or stabilizers 638 are illustrated, it is understood that a single outrigger or stabilizer may be employed, or alternatively that the tilt biasing mechanism may be incorporated into any other structure of the exercise cycle 610 to bias exercise cycle 610 toward an upright position.

Figure 50:
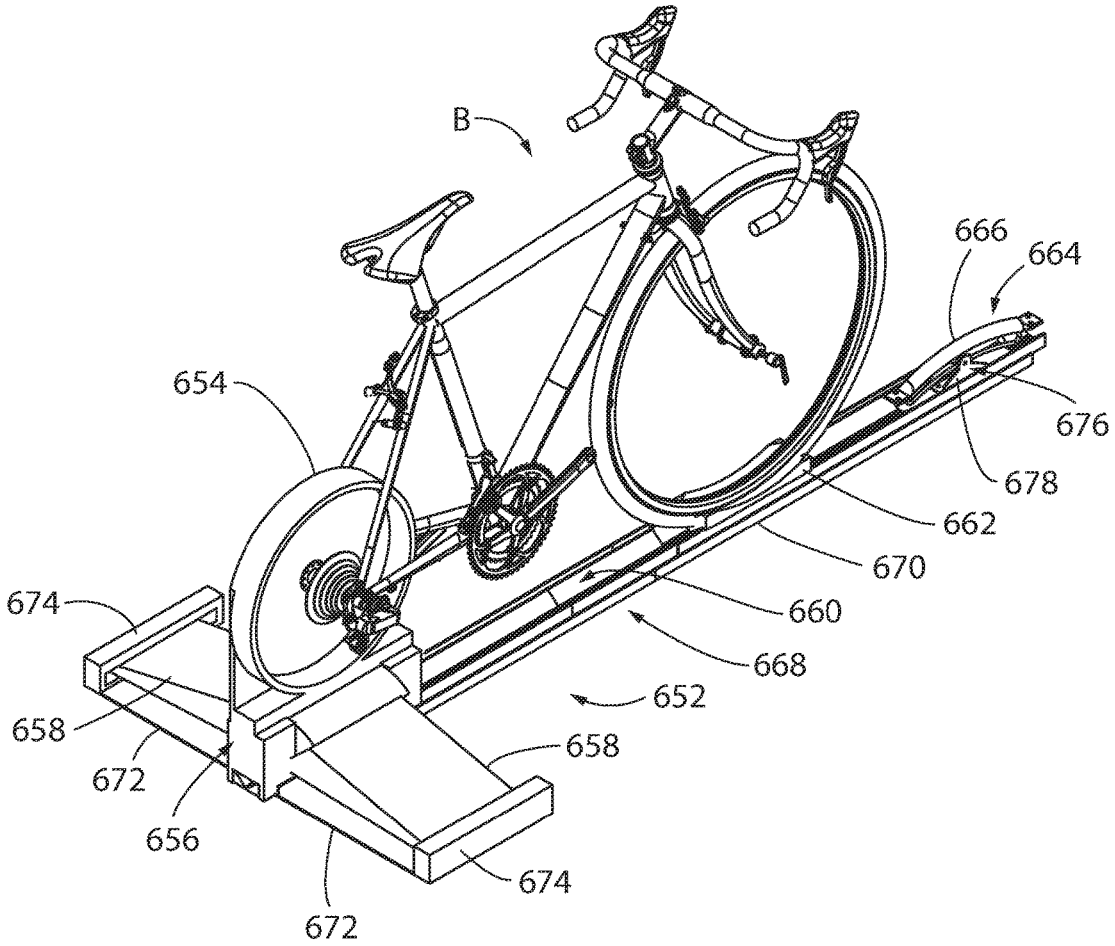
FIG. 50 is an isometric view of a bicycle trainer incorporating a movable support in accordance with the present invention.
Figure 51:
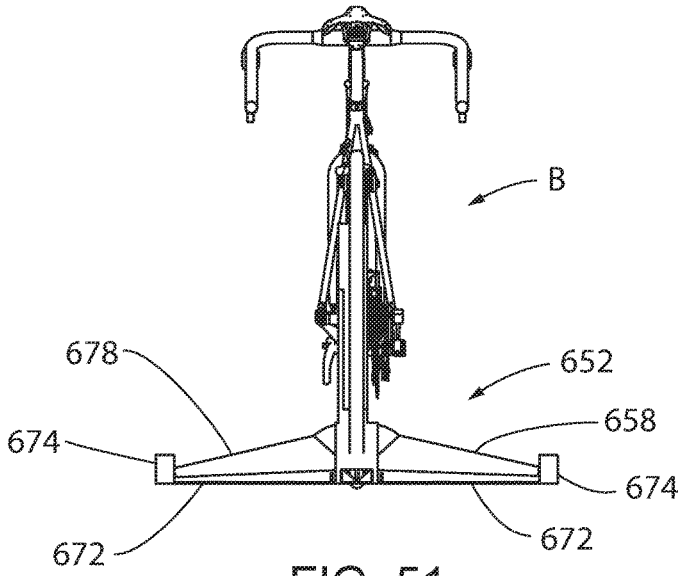
FIG. 51 is a rear elevation view of the bicycle trainer of FIG. 50.
Figure 52:
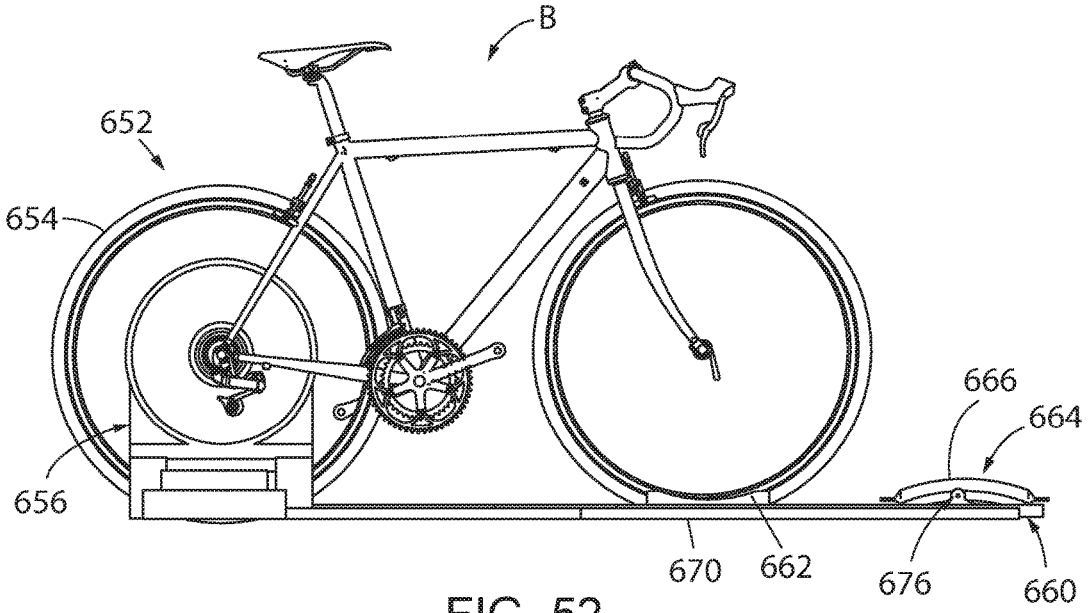
FIG. 52 is a side elevation view of the bicycle trainer of FIGS. 50 and 51.
Figure 53:
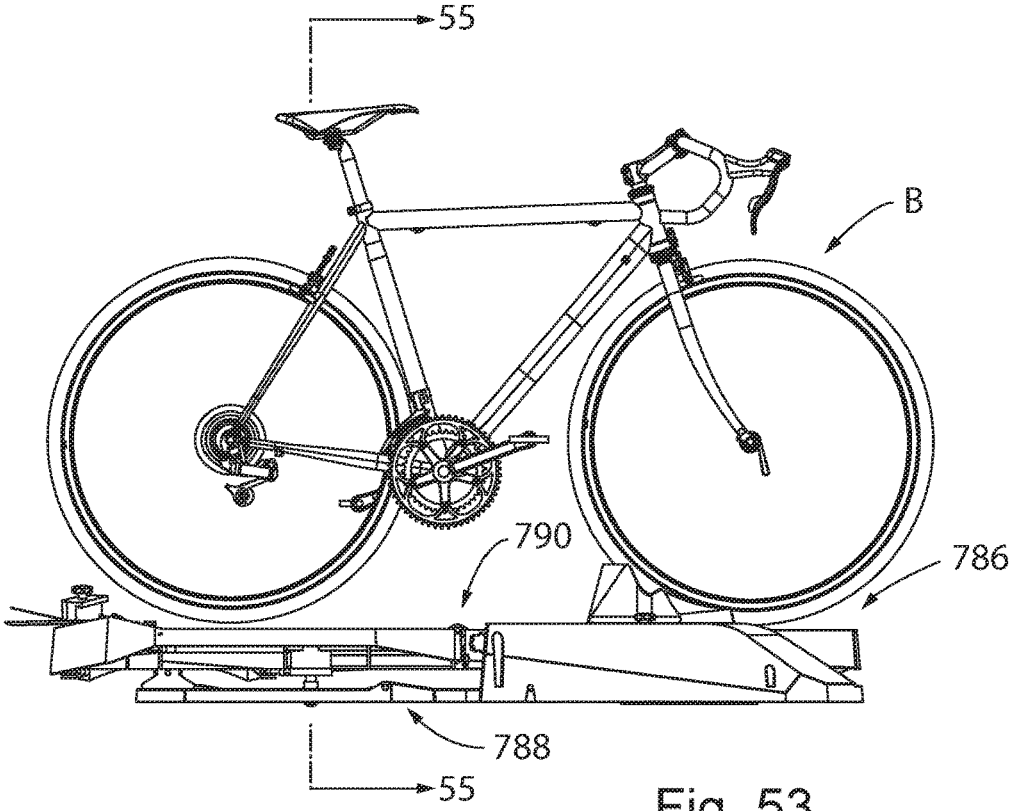
FIG. 53 is a side elevation view of another embodiment of a movable exercise equipment support in accordance with the present invention.
Figure 54:
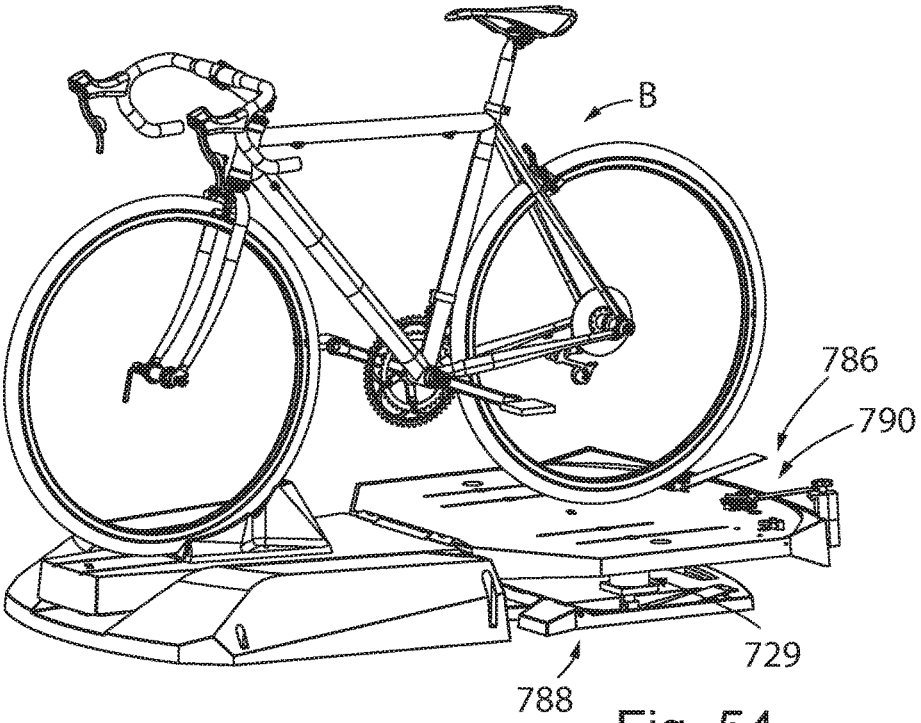
FIG. 54 is an isometric view of the movable exercise equipment support of FIG. 53.
Figure 55:
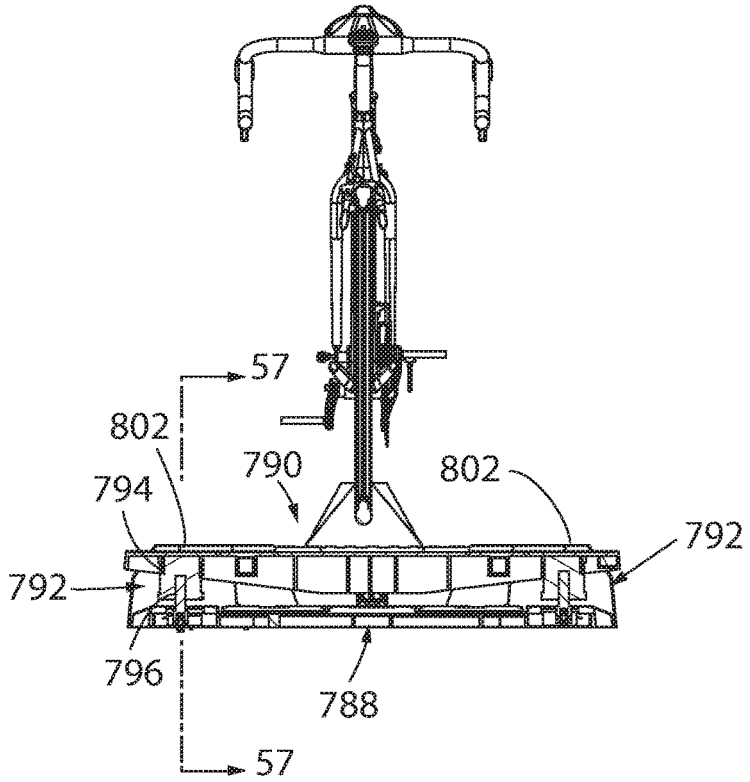
FIG. 55 is a section view taken along line 55-55 of FIG. 53.
Figure 56:
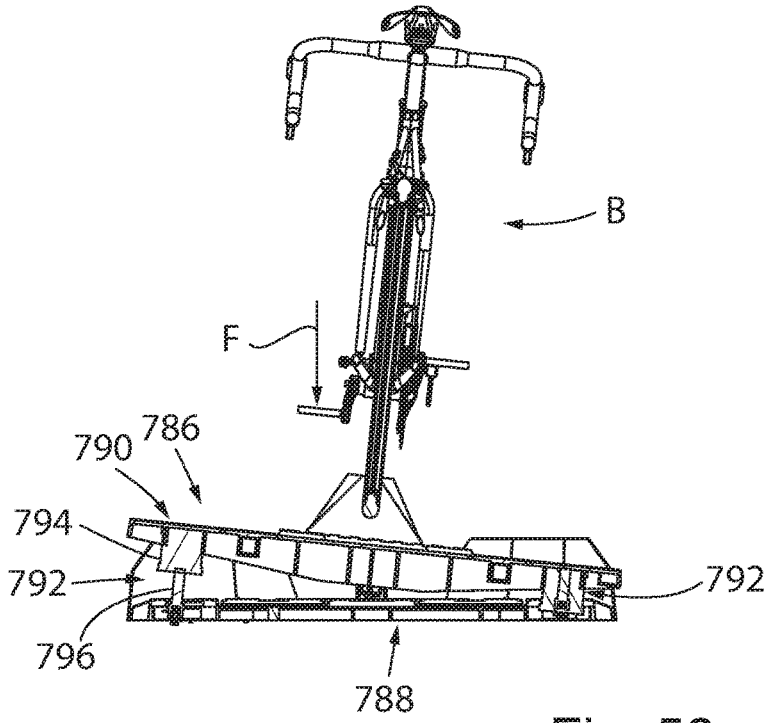
FIG. 56 is a view similar to FIG. 55, showing tilting movement of the movable exercise equipment support.
Figure 57:
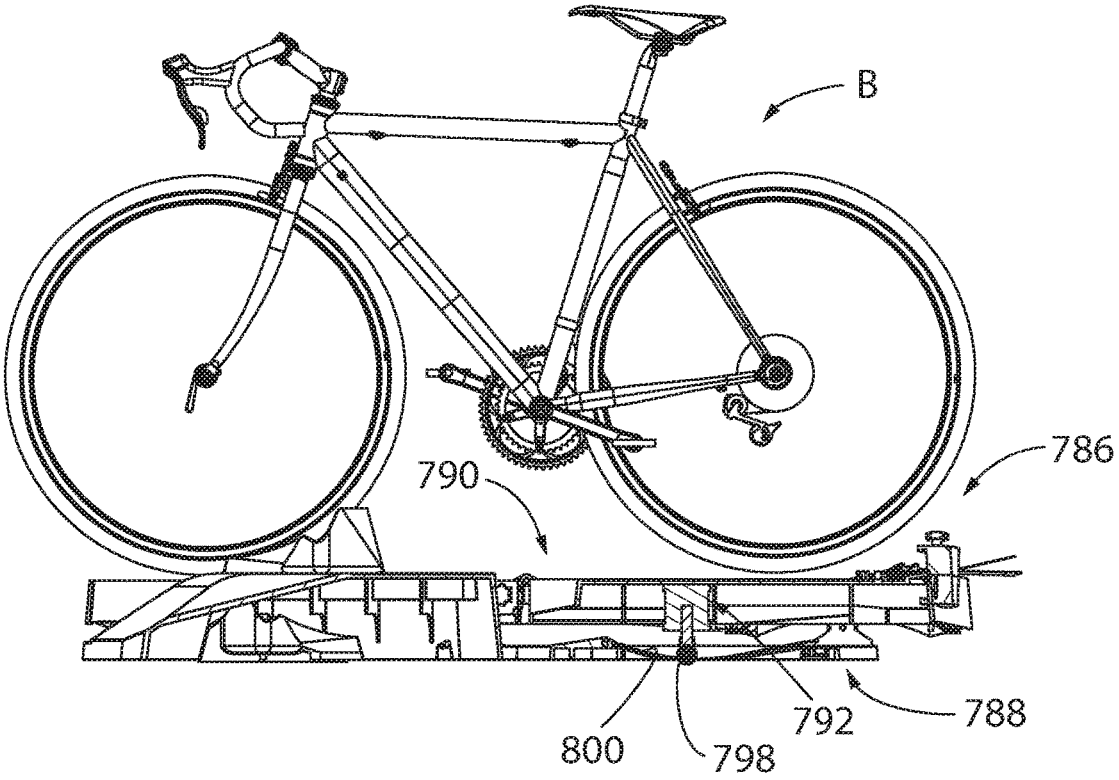
FIG. 57 is a section view taken along line 57-57 of FIG. 55.

FIGS. 50-52 illustrate an embodiment of the present invention in which a bicycle B is engaged with and supported by a trainer 652, which includes movable features in accordance with the present invention. In this embodiment, the movable support is incorporated directly into the structure of the trainer 652. The trainer 652 is illustrated as being in the form of a direct drive trainer, although it is understood that a wheel-on trainer may also be employed. The trainer 652 includes a flywheel 654 which, in a manner as is known, is adapted to rotate in response to power input to the trainer 652 by rotation of the pedals of bicycle B. A resistance-providing arrangement, such as an electromagnetically controlled resistance mechanism, may be employed to selectively resist rotation of flywheel 654. Flywheel 654 may be contained within a suitable housing or other enclosure.

Trainer 654 includes a central mounting section 656 that supports flywheel 654, and a pair of stabilizers 658 extend outwardly in opposite directions from central mounting section 656. A central bottom support member 660 extends forwardly from the front end of central mounting section 656. The central bottom support member 660 may be provided with a wheel mount 662 on which the front wheel of bicycle B is supported. The front end of central bottom support member 660 includes a front engagement area 664, which includes an arcuate beaded track member 666 having a construction and configuration as described previously. A similar arcuate beaded track member is interconnected with and underlies central mounting section 656 at the rear end of bottom support member 660.

Trainer 652 also includes a base assembly 668, on which bottom support member 660 is positioned. The base assembly 668 includes a central axial base member 670, which underlies bottom support member 660. The base assembly 668 also includes a pair of plates 672 that extend outwardly in opposite directions from the rearward end of base member 670. The plates 672 underlie the stabilizers 658, as described previously, and a stabilizer guide 674 is secured to the outer end of each plate 672. As also described previously, the end of each stabilizer 658 is positioned within a guide channel defined by the stabilizer guide 674 and is movable in a fore-aft direction therewithin. The base assembly 668 also includes a pair of brackets at each engagement area of bottom support member 660. A front one of the brackets is shown at 676, and a similarly configured rear bracket is secured to the rearward end of base member 670. A grooved roller, such as shown at 678, is rotatably mounted to each of the brackets, such as 676.

In a manner similar to that described previously, any axial or longitudinal forces applied to bicycle B during use and experienced by mounting section 656 and bottom support member 660 cause axial fore-aft movement of bottom support member 660 relative to base assembly 668 by movement of the track members, such as 666, on the grooved rollers, such as 678. Again, the curved configuration of the track member such as 666 provides a gravity bias of support member 660, and thereby bicycle B, to an axially neutral position. Any transverse or lateral forces applied to bicycle B during use cause bottom support member 662 tip or tilt relative to base assembly 668 by rotation of the central beaded area of each track, such as 666, on the roller, such as 678, on which the track is supported. Such tipping or tilting movement of the bottom support member 660 is transferred to the bicycle B and experienced by the user. As described previously, a tilt biasing arrangement is interposed between each stabilizer 658 and its underlying plate 672, to bias bicycle B toward an upright or neutral tilt position. Again, while a pair of outriggers or stabilizers 658 are illustrated, it is understood that a single outrigger or stabilizer may be employed, or alternatively that the tilt biasing mechanism may be incorporated into any other structure of the trainer 652 to bias trainer 652 toward an upright position.

FIGS. 53-57 illustrate another embodiment of a movable exercise equipment support in accordance with the present invention, shown generally at 786, on which the bicycle B and a trainer (not shown) may be supported. As in previously-described embodiments, the trainer with which bicycle B is engaged may be a wheel-on trainer or a direct drive trainer, in a manner as is known.

The general components and construction of movable exercise equipment support 786 are similar to those previously described with respect to movable exercise equipment support 200 as shown in FIGS. 19-24 and movable exercise equipment support 700 as shown in FIGS. **24*a*-24*i*. In this regard, the movable exercise equipment support 786 generally includes a base section 788 and a platform section 790. As described previously, the platform section 790 is movable in an axial, fore-aft direction relative to base section 788 in response to application of longitudinal forces to movable exercise equipment support 76 in response to operation of bicycle B. Platform section 790 also tilts side-to-side in response to application of forces to bicycle B that are off-center relative to the longitudinal axis of movable exercise equip in support 786. Movable exercise equipment support 786 differs from the previously-described embodiments, however, in that the tilt biasing bracket assemblies incorporate in the movable exercise equipment supports such as 200, 700 are replaced by a pair of cylinder assemblies 792 located one on either side of movable exercise equipment support 76. The cylinder assemblies 792 are positioned between the rear portion of platform section 790 and the underlying rear portion of base section 788, and in the illustrated embodiment are secured to and carried by the rear portion of the platform section 790. Each cylinder assembly 792 includes a cylinder body 794 and an extendable and retractable rod 796. A roller 798 is secured to the end of each rod 796, and is engaged against an engagement surface or track 800 on the rear portion of base section 788, as described previously. The cylinder assemblies 792 may be in the form of hydraulic cylinders, although it is understood that pneumatic cylinders, stepper motors, or any other linear or rotating actuator may also be employed. The cylinder assemblies 792 are hydraulically linked together, so that the cylinder assemblies 792 move up and down opposite one another at the same rate in response to lateral or longitudinally off-center forces being applied to bicycle B or experienced by movable exercise equipment support 786. The cylinder assemblies 792 thus control side-to-side tilting movement of platform section 790 relative to base section 788, and the cylinder rods 796** are biased outwardly, in a manner as is known, to provide a tilt biasing that tends to position the sum of forces vertically closer to or through the tilt axis.

A force sensor 802 is located at the top of each cylinder body 794, and bears against the underside of platform section 790. Each force sensor 802 is interconnected with a hydraulic controller that in turn is interconnected with each cylinder assembly 792. With this arrangement, when a downward force is applied to a first side of the bicycle B that exceeds the upward force on a second side of the bicycle B, represented at F in FIG. 56, the sensors 802 will determine that a greater amount of forces being applied to the first side of the bicycle B. An algorithm within the hydraulic controller then calculates the desired tilt of the platform section 790 according to the magnitude of the force F, and the controller commands the cylinder actuator to operate the cylinder assembly 792 on the first side of the bicycle B to extend the cylinder rod 796 and provide upward movement of the platform section 790 on the first side of the bicycle B by a desired amount according to the magnitude of the force F. By tilting the bicycle B upwards in this manner against the pedal force F, the center of force is moved back toward the pivot axis to stabilize the system, which mimics conditions experienced during real-world operation of a bicycle in outdoor conditions.

The speed of response in the cylinder assemblies 792 or other actuators could be tied to the virtual speed of the rider. In addition, the system could be controlled by an internal or separate computer through a wired or wireless signal.

It can thus be appreciated that the present invention provides a movable support arrangement for exercise equipment that in the first instance provides axial fore-aft movement of the item of exercise equipment, to provide a realistic feel during operation of the item of exercise equipment. The axial exercise equipment movement can be combined with lateral or tilting movement, to further enhance the realistic feel experienced by the user during operation. The movable support can be separate from an item of exercise equipment, such that the item of exercise is separate from and positioned on the movable support. Alternatively, the movable support can be incorporated into the structure of the item of exercise equipment itself.

A direct drive trainer used in combination with the movable exercise equipment supports described above offer several benefits over previous systems. In the past, for example, in order to reduce peak saddle pressure, which has a significant impact on user comfort, previous bicycle trainers would either 1) require a large flywheel-based trainer unit to smooth out the rider's pedal stroke or 2) incorporate movement into the trainer, for instance, allowing for side-to-side or font-to-rear tilting movements. To smooth out the rider's pedal stroke, a direct drive trainer unit as shown can rapidly change the resistance based on the position of the pedal stroke, with greater resistance being generated during the high torque part of the user's pedal stroke and less resistance during the dead spot of the user's pedal cycle. The amount of resistance can be adjusted based on sensor readings, for instance, using accelerometer-based cadence sensors, reed switch sensors, position sensors, and other sensors as would be known to one of ordinary skill in the art. Based on the sensor readings, resistance can be increased and decreased rapidly to allow for a full reversal within each pedal stroke. These changes in resistance can be calculated based on any number of factors, including for instance increase or decrease in torque, increase or decrease in speed, redundantly positive or negative acceleration, increase or decrease in instantaneous power, or derivatives of power. Similarly, the resistance could be calculated based on any combination of these factors. The adjustments in resistance can be achieved, for instance, using electromagnetic coils, although a motor controller including a drive and a brake could similarly be used. However, any number of other methods of generating resistance could similarly be employed. For instance, these could include systems that deposit generated power into resistors, systems that dissipate power through eddy current resistance, and friction-based systems.

Previously, the two options stated above were not compatible with one another primarily because the weight associated with a large flywheel-based trainer unit resulted in significant gyroscopic stability, which made it difficult to simulate realistic movement during use of the trainer system. However, by using the embodiments described above, a movable direct drive-type bicycle trainer system generates both the smooth pedal stroke associated with use of a heavy flywheel-based trainer unit, while also allowing for realistic movement of the system in the form of fore and aft and side-to-side movement.

It is understood that the invention disclosed and defined herein extends to all alternative combinations of two or more of the individual features mentioned or evident from the text and/or drawings. All of these different combinations constitute various alternative aspects of the present invention. The embodiments described herein explained the best modes known for practicing the invention and will enable others skilled in the art to utilize the invention.

Various additions, modifications, and rearrangements are contemplated as being within the scope of the following claims, which particularly point out and distinctly claim the subject matter regarding as the invention, and it is intended that the following claims cover all such additions, modifications, and rearrangements.

We claim:

1. A support for an item of exercise equipment that experiences forces in a fore-aft direction during use, comprising:

a lower member adapted for placement on a support surface that lies in a support surface plane; and an upper member interconnected with the lower member via a movable interconnection, wherein the upper member is configured to support the item of exercise equipment above the support surface, and wherein the movable interconnection of the upper member with the lower member is configured to enable the upper member to move forwardly and rearwardly in the fore-aft direction relative to the lower member in response to fore-aft forces that are transferred to the upper member from the item of exercise equipment in response to use of the item of exercise equipment;

wherein the movable interconnection of the upper member with the lower member is further configured to provide upward and downward movement of the upper member relative to the support surface during movement of the upper member forwardly and rearwardly in the fore-aft direction relative to the lower member, and wherein the upper member is oriented parallel to the support surface plane during movement of the upper member relative to the lower member in the fore-aft direction and during upward and downward movement of the upper member relative to the support surface.

2. The support of claim 1, wherein the lower member comprises a base and the upper member comprises a platform.

3. The support of claim 2, wherein the platform defines an upper surface on which the item of exercise equipment is supported.

4. The support of claim 3, wherein the platform is in a fore-aft neutral position relative to the base when the item of exercise equipment is not in use, and wherein the movable interconnection of the platform with the base biases the platform toward the fore-aft neutral position relative to the base.

5. The support of claim 2, wherein the movable interconnection of the platform with the base is further configured to enable the platform to pivot relative to the base about a longitudinal pivot axis that extends in the fore-aft direction in response to forces applied to the platform from the item of exercise equipment in response to use of the item of exercise equipment.

6. The support of claim 5, wherein the longitudinal pivot axis is oriented parallel to the support surface plane.

7. The support of claim 6, wherein the platform is in a tilting neutral position relative to the base when the item of exercise equipment is not in use, and wherein the movable interconnection of the platform with the base biases the platform toward the tilting neutral position relative to the base.

8. The support of claim 7, wherein the platform is in a fore-aft neutral position relative to the base when the item of exercise equipment is not in use, and wherein the movable interconnection of the platform with the base biases the platform toward the fore-aft neutral position relative to the base.

9. The support of claim 6, wherein the movable connection of the platform with the base maintains the longitudinal pivot axis parallel to the support surface plane during upward and downward movement of the platform relative to the support surface and movement of the platform forwardly and rearwardly in the fore-aft direction relative to the base.

10. The support of claim 1, wherein the movable interconnection of the upper member with the lower member comprises a roller and track arrangement interposed between the upper member and the lower member.

11. A support for an item of exercise equipment that experiences forces in a fore-aft direction during use, comprising:

a base adapted for placement on a support surface that lies in a support surface plane; and a platform interconnected with the base via a movable interconnection, wherein the platform is configured to support the item of exercise equipment above the support surface, and wherein the movable interconnection of the platform with the base is configured to enable the platform to move forwardly and rearwardly in the fore-aft direction relative to the base in response to fore-aft forces that are transferred to the platform from the item of exercise equipment in response to use of the item of exercise equipment, wherein the platform is oriented parallel to the support surface plane during movement of the platform relative to the base in the fore-aft direction;

wherein the platform is in a fore-aft neutral position relative to the base when the item of exercise equipment is not in use, and wherein the movable interconnection of the platform with the base biases the platform toward the fore-aft neutral position relative to the base; and wherein the movable interconnection of the platform with the base comprises a roller and track arrangement interposed between the platform and the base, and wherein the roller and track arrangement is configured to provide a gravity bias of the platform toward the fore-aft neutral position relative to the base.

12. An exercise arrangement, comprising:

a cycle device for enabling a user to apply input forces: and a support for the cycle device adapted to be positioned on a support surface that lies in a support surface plane, wherein the support comprises a lower member adapted for placement on the support surface, and an upper member interconnected with the lower member via a movable interconnection, wherein the upper member is configured to support the cycle device above the support surface, and wherein the movable interconnection of the upper member with the lower member is configured to enable the upper member to move forwardly and rearwardly in the fore-aft direction relative to the lower member in response to fore-aft forces that are transferred to the upper member from the cycle device in response to operation of the cycle device;

wherein the movable interconnection of the upper member with the lower member is further configured to provide upward and downward movement of the upper member relative to the support surface during movement of the upper member forwardly and rearwardly in the fore-aft direction relative to the lower member, and wherein the upper member is oriented parallel to the support surface plane during movement of the upper member relative to the lower member in the fore-aft direction and during upward and downward movement of the upper member relative to the support surface.

13. The exercise arrangement of claim 12, wherein the lower member comprises a base and the upper member comprises a platform.

14. The exercise arrangement of claim 13, wherein the platform defines an upper surface on which the cycle device is supported.

15. The support of claim 14, wherein the platform is in a fore-aft neutral position relative to the base when the cycle device is not in use, and wherein the movable interconnection of the platform with the base biases the platform toward the fore-aft neutral position relative to the base.

16. The support of claim 13, wherein the movable interconnection of the platform with the base is further configured to enable the platform to pivot relative to the base about a longitudinal pivot axis that extends in the fore-aft direction in response to lateral forces applied to the platform from the cycle device in response to use of the cycle device.

17. The support of claim 16, wherein the longitudinal pivot axis is oriented parallel to the support surface plane.

18. The support of claim 17, wherein the platform is in a tilting neutral position relative to the base when the cycle device is not in use, and wherein the movable interconnection of the platform with the base biases the platform toward the tilting neutral position relative to the base.

19. The support of claim 18, wherein the movable connection of the platform with the base maintains the longitudinal pivot axis parallel to the support surface plane during upward and downward movement of the platform relative to the support surface and movement of the platform forwardly and rearwardly in the fore-aft direction relative to the base.

20. The support of claim 18, wherein the platform is in a fore-aft neutral position relative to the base when the cycle device is not in use, and wherein the movable interconnection of the platform with the base biases the platform toward the fore-aft neutral position relative to the base, and further comprising a tilt biasing arrangement for biasing the platform toward the tilting neutral position relative to the base.

21. The support of claim 12, wherein the movable interconnection of the upper member with the lower member comprises a roller and track arrangement interposed between the upper member and the lower member.

22. An exercise arrangement, comprising:

a cycle device for enabling a user to apply input forces; and a support for the cycle device adapted to be positioned on a support surface that lies in a support surface plane, wherein the support comprises a base adapted for placement on the support surface, and a platform interconnected with the base via a movable interconnection, wherein the platform defines an upper surface configured to support the cycle device above the support surface, and wherein the movable interconnection of the platform with the base is configured to enable the platform to move forwardly and rearwardly in the fore-aft direction relative to the base in response to fore-aft forces that are transferred to the platform from the cycle device in response to operation of the cycle device, wherein the platform is oriented parallel to the support surface plane during movement of the platform relative to the lower member in the fore-aft direction;

wherein the platform is in a fore-aft neutral position relative to the base when the cycle device is not in use, and wherein the movable interconnection of the platform with the base biases the platform toward the fore-aft neutral position relative to the base; and wherein the movable interconnection of the platform with the base comprises a roller and track arrangement interposed between the platform and the base, and wherein the roller and track arrangement is configured to provide a gravity bias of the platform toward the fore-aft neutral position relative to the base.

23. A support for an item of exercise equipment that experiences forces in a fore-aft direction during use, comprising:

a base adapted for placement on a support surface; and a platform interconnected with the base via a movable interconnection, wherein the platform defines an upper surface on which the item of exercise equipment is supported and is configured to support the item of exercise equipment above the support surface, and wherein the movable interconnection of the platform with the base is configured to enable the platform to move in the fore-aft direction relative to the base in response to fore-aft forces that are transferred to the platform from the item of exercise equipment in response to use of the item of exercise equipment;

wherein the platform is in a fore-aft neutral position relative to the base when the item of exercise equipment is not in use, and wherein the movable interconnection of the platform with the base comprises a roller and track arrangement interposed between the platform and the base, wherein the roller and track arrangement is configured to provide a gravity bias of the platform toward the fore-aft neutral position relative to the base.

24. An exercise arrangement, comprising:

a cycle device for enabling a user to apply input forces: and a support for the cycle device adapted to be positioned on a support surface, wherein the support comprises a base adapted for placement on the support surface, and a platform interconnected with the base via a movable interconnection, wherein the platform defines an upper surface on which the cycle device is supported above the support surface, and wherein the movable interconnection of the platform with the base is configured to enable the platform to move in the fore-aft direction relative to the base in response to fore-aft forces that are transferred to the platform from the cycle device in response to operation of the cycle device;

wherein the platform is in a fore-aft neutral position relative to the base when the cycle device is not in use, and wherein the interconnection of the platform with the base biases the platform toward the fore-aft neutral position relative to the base, and wherein the movable interconnection of the platform with the base comprises a roller and track arrangement interposed between the platform and the base, and wherein the roller and track arrangement is configured to provide a gravity bias of the platform toward the fore-aft neutral position relative to the base.

25. A support for an item of exercise equipment that experiences forces in a fore-aft direction during use, comprising:

a lower member adapted for placement on a support surface; and an upper member interconnected with the lower member, wherein the upper member is configured to support the item of exercise equipment above the support surface, and wherein the interconnection of the upper member with the lower member is configured to enable the upper member to move forwardly and rearwardly in the fore-aft direction relative to the lower member between a forward position and a rearward position, in response to fore-aft forces that are transferred to the upper member from the item of exercise equipment in response to use of the item of exercise equipment;

wherein the movable interconnection of the upper member with the lower member is further configured to provide upward and downward movement of the upper member relative to the support surface during movement of the upper member forwardly and rearwardly in the fore-aft direction relative to the lower member, and wherein the forward and rearward positions of the upper member relative to the lower member are offset from each other in the fore-aft direction.

26. The support of claim 25, wherein the movable interconnection of the upper member comprises a roller and track arrangement interposed between the upper member and the lower member.

27. The support of claim 26, wherein the platform defines an upper surface on which the item of exercise equipment is supported.

28. The support of claim 27, wherein the platform is in a fore-aft neutral position relative to the base when the item of exercise equipment is not in use, and wherein the movable interconnection of the platform with the base biases the platform toward the fore-aft neutral position relative to the base.

29. The support of claim 28, wherein the movable interconnection of the platform with the base comprises a roller and track arrangement interposed between the platform and the base, and wherein the roller and track arrangement is configured to provide a gravity bias of the platform toward the fore-aft neutral position relative to the base.

30. The support of claim 25, wherein the lower member comprises a base and the upper member comprises a platform.

31. The support of claim 30, wherein the movable interconnection of the platform with the base is further configured to enable the platform to pivot relative to the base about a longitudinal pivot axis that extends in the fore-aft direction in response to forces applied to the platform from the item of exercise equipment in response to use of the item of exercise equipment.

32. The support of claim 31, wherein the support surface lies in a support surface plane, and wherein the longitudinal pivot axis is oriented parallel to the support surface plane.

33. The support of claim 32, wherein the platform is in a tilting neutral position relative to the base when the item of exercise equipment is not in use, and wherein the movable interconnection of the platform with the base biases the platform toward the tilting neutral position relative to the base.

34. The support of claim 33, wherein the movable interconnection of the platform with the base maintains the longitudinal pivot axis parallel to the support surface plane during upward and downward movement of the platform relative to the support surface and movement of the platform forwardly and rearwardly in the fore-aft direction relative to the base.

35. The support of claim 33, wherein the platform is in a fore-aft neutral position relative to the base when the item of exercise equipment is not in use, and wherein the movable interconnection of the platform with the base biases the platform toward the fore-aft neutral position relative to the base.

* * * * *